US008265502B2

(12) United States Patent
Sato et al.

(10) Patent No.: US 8,265,502 B2
(45) Date of Patent: Sep. 11, 2012

(54) IMAGE FORMING APPARATUS INCLUDING AN ALTERNATIVE PRINTING UNIT

(75) Inventors: Noribumi Sato, Saitama (JP); Mitsuru Iioka, Saitama (JP); Jun Koyatsu, Saitama (JP); Kaoru Yamauchi, Saitama (JP); Takaya Nagasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 509 days.

(21) Appl. No.: 12/541,451

(22) Filed: Aug. 14, 2009

(65) Prior Publication Data

US 2010/0080582 A1 Apr. 1, 2010

(30) Foreign Application Priority Data

Sep. 26, 2008 (JP) ..... 2008-248257

(51) Int. Cl.
*G03G 15/08* (2006.01)

(52) U.S. Cl. ..... 399/54; 399/40; 399/223

(58) Field of Classification Search ..... 399/28, 399/39, 40, 51, 54, 178, 223, 228; 347/14, 347/15, 115, 131, 240, 251–254; 358/1.13, 358/3.01, 3.1, 3.12

See application file for complete search history.

(56) References Cited

U.S. PATENT DOCUMENTS

| | | | | |
|---|---|---|---|---|
| 6,336,704 | B1 * | 1/2002 | Shimada | 347/43 |
| 6,450,606 | B1 * | 9/2002 | Kato et al. | 347/19 |
| 6,577,826 | B1 * | 6/2003 | Misaizu et al. | 399/45 |
| 7,340,205 | B2 * | 3/2008 | Nagao et al. | 399/296 |
| 7,526,235 | B2 * | 4/2009 | Furukawa | 399/231 |
| 7,556,330 | B2 * | 7/2009 | Saito et al. | 347/14 |
| 2005/0105136 | A1 * | 5/2005 | Jung | 358/3.1 |

FOREIGN PATENT DOCUMENTS

| | | | |
|---|---|---|---|
| JP | A 61-290060 | | 12/1986 |
| JP | 2000062250 | A * | 2/2000 |
| JP | 2000247018 | A * | 9/2000 |
| JP | A-2001-111861 | | 4/2001 |
| JP | A-2003-186277 | | 7/2003 |
| JP | A-2004-209947 | | 7/2004 |
| JP | A 2005-148407 | | 6/2005 |

OTHER PUBLICATIONS

Office Action issued in corresponding Japanese Application No. 2008-248257, mailed Aug. 24, 2010 (with English Translation).

* cited by examiner

*Primary Examiner* — Robert Beatty
(74) *Attorney, Agent, or Firm* — Oliff & Berridge, PLC

(57) ABSTRACT

An image forming apparatus includes an alternative printing unit. The alternative printing unit performs alternative printing of a black image by mixing images of color materials of three colors of cyan, yellow, and magenta. The alternative printing unit includes a color material amount control unit that controls amounts of the respective color materials, which form the images of the color materials of the three colors, so as to be smaller than those at a time of normal printing.

22 Claims, 56 Drawing Sheets

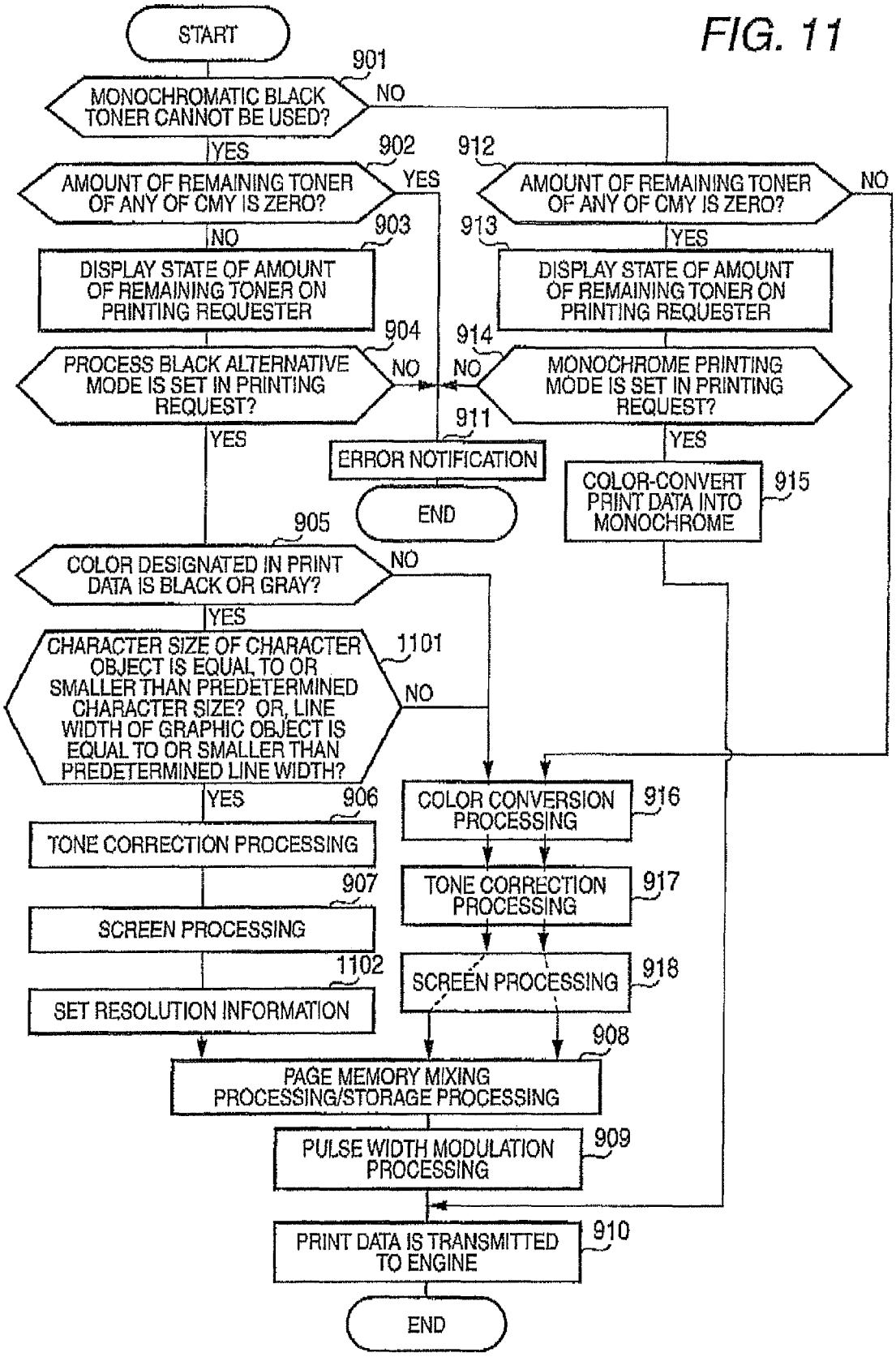
FIG. 11
START
901
MONOCHROMATIC BLACK TONER CANNOT BE USED?
NO
YES
902
AMOUNT OF REMAINING TONER OF ANY OF CMY IS ZERO?
YES
NO
903
DISPLAY STATE OF AMOUNT OF REMAINING TONER ON PRINTING REQUESTER
904
PROCESS BLACK ALTERNATIVE MODE IS SET IN PRINTING REQUEST?
NO
YES
912
AMOUNT OF REMAINING TONER OF ANY OF CMY IS ZERO?
NO
YES
913
DISPLAY STATE OF AMOUNT OF REMAINING TONER ON PRINTING REQUESTER
914
MONOCHROME PRINTING MODE IS SET IN PRINTING REQUEST?
NO
YES
911
ERROR NOTIFICATION
END
COLOR-CONVERT PRINT DATA INTO MONOCHROME
915
905
COLOR DESIGNATED IN PRINT DATA IS BLACK OR GRAY?
NO
YES
1101
CHARACTER SIZE OF CHARACTER OBJECT IS EQUAL TO OR SMALLER THAN PREDETERMINED CHARACTER SIZE? OR, LINE WIDTH OF GRAPHIC OBJECT IS EQUAL TO OR SMALLER THAN PREDETERMINED LINE WIDTH?
NO
YES
906
TONE CORRECTION PROCESSING
907
SCREEN PROCESSING
1102
SET RESOLUTION INFORMATION
COLOR CONVERSION PROCESSING
916
TONE CORRECTION PROCESSING
917
SCREEN PROCESSING
918
908
PAGE MEMORY MIXING PROCESSING/STORAGE PROCESSING
PULSE WIDTH MODULATION PROCESSING
909
PRINT DATA IS TRANSMITTED TO ENGINE
910
END

FIG. 22

| 2201 | 2202 | 2203 |
|---|---|---|
| L* | C* | Duty(%) |
| 40<L* | 10<C* | 100 |
| 35<L*≦40 | 9<C*≦10 | 100 |
| 30<L*≦35 | 8<C*≦9 | 95 |
| 25<L*≦30 | 7<C*≦8 | 90 |
| 20<L*≦25 | 6<C*≦7 | 85 |
| 15<L*≦20 | 5<C*≦6 | 80 |
| 10<L*≦15 | 4<C*≦5 | 75 |
| L*≦10 | C*≦4 | 70 |

FIG. 24

| R=G=B | C | M | Y |
|---|---|---|---|
| 0 | 80% | 75% | 60% |
| 1 | 75% | 70% | 55% |
| 2 | 70% | 65% | 50% |
| | | | |
| | | | |
| 255 | 0% | 0% | 0% |

FIG. 45

| 4501 | 4502 | 4503 |
|---|---|---|
| L* | C* | AMOUNT OF EXPOSURE LIGHT (%) |
| 40<L* | 10<C* | 100 |
| 35<L*≦40 | 9<C*≦10 | 100 |
| 30<L*≦35 | 8<C*≦9 | 95 |
| 25<L*≦30 | 7<C*≦8 | 90 |
| 20<L*≦25 | 6<C*≦7 | 85 |
| 15<L*≦20 | 5<C*≦6 | 80 |
| 10<L*≦15 | 4<C*≦5 | 75 |
| L*≦10 | C*≦4 | 70 |

IMAGE FORMING APPARATUS INCLUDING AN ALTERNATIVE PRINTING UNIT

CROSS-REFERENCE TO RELATED APPLICATIONS

This application is based on and claims priority under 35 USC 119 from Japanese Patent Application No. 2008-248257 filed on Sep. 26, 2008.

BACKGROUND

1. Technical Field

The present invention relates to an image forming apparatus.

2. Related Art

When an image formation process, such as full color printing, is performed using three primary colors of CMY (C: cyan, M: magenta, Y: yellow) in an electrophotographic-type image forming apparatus (for example, a printer) configured to print out print data, it is possible to use a color that is called a "process, black" which is generated by mixing all of the three primary colors to thereby reduce resultant lightness.

The "process black" is used when a black toner (K: black) is not provided in a developing device, when a black toner is out, when black is used for special applications, such as a digital watermark, or when all color printing is performed only with the three primary colors of CMY.

That is, these are the case where image data which can be drawn originally with a single color of black toner is printed by overlapping the three colors. When an image is printed onto a print medium, such as a print sheet, using the "process black" generated by overlapping the three colors, defects may easily occur, such as scattering of characters, poor transfers poor fixation, and ghost.

SUMMARY

According to an aspect of the invention, an image forming apparatus includes an alternative printing unit. The alternative printing unit performs alternative printing of a black image by mixing images of color materials of three colors of cyan, yellow, and magenta. The alternative printing unit includes a color material amount control unit that controls amounts of the respective color materials, which form the images of the color materials of the three colors, so as to be smaller than those at a time of normal printing.

BRIEF DESCRIPTION OF THE DRAWINGS

Exemplary embodiments of the present invention will be described in detail based on the accompanying drawings, wherein

FIG. 11 his a view illustrating a flow of processing in the image forming apparatus when size information of an object is in a predetermined range;

FIG. 22 is a graph illustrating values of the duty (%) relative to the saturation (C*) based on the saturation a* and the saturation b* in the CIE Lab color space;

FIG. 24 is a view illustrating an example of a gray-dedicated tone correction table;

FIG. 45 is a view illustrating the configuration of the table showing the amount of exposure light (%) relative to the saturation (C*) based on the saturation a* and the saturation b* in the CIE Lab color space;

DETAILED DESCRIPTION

Hereinafter, an image forming apparatus according to exemplary embodiments of the invention will be described in detail with reference to the accompanying drawings.

First, a process of printing out print data by a general electrophotographic printer will be described.

The electrophotographic printer performs the printing process by forming an electrostatic image based on print data on a photoconductive drum and making a toner based on the electrostatic image adhere to a print medium, such as a print sheet.

The electrostatic image on the photoconductive drum is formed by the following procedures.

First, charging processing is performed to uniformly onto the photoconductive drum with negative charges. Then, the exposure processing is performed to irradiate an image based on the image data to the photoconductive drum, which are charged with the electric charges, using a laser or an LED (light emitting diode). By this irradiation in the exposure processing, the electric charges corresponding to an image portion are discharged.

Then, development processing is performed to make the toner (particle material), which is a color material in the electrically charged state, adhere to the photoconductive drum from a developing unit. By this development processing, the toner adheres to the image portion.

In a state where the electrostatic image is formed as described above, transfer processing is performed to make the toner on the photoconductive drum adhere to a print sheet by applying positive charges onto the print sheet.

Thus, the printing based on the print data is performed. In addition, fixing processing is typically performed to fix the toner onto the print sheet after the transfer processing.

First Exemplary Embodiment

Figure 1:
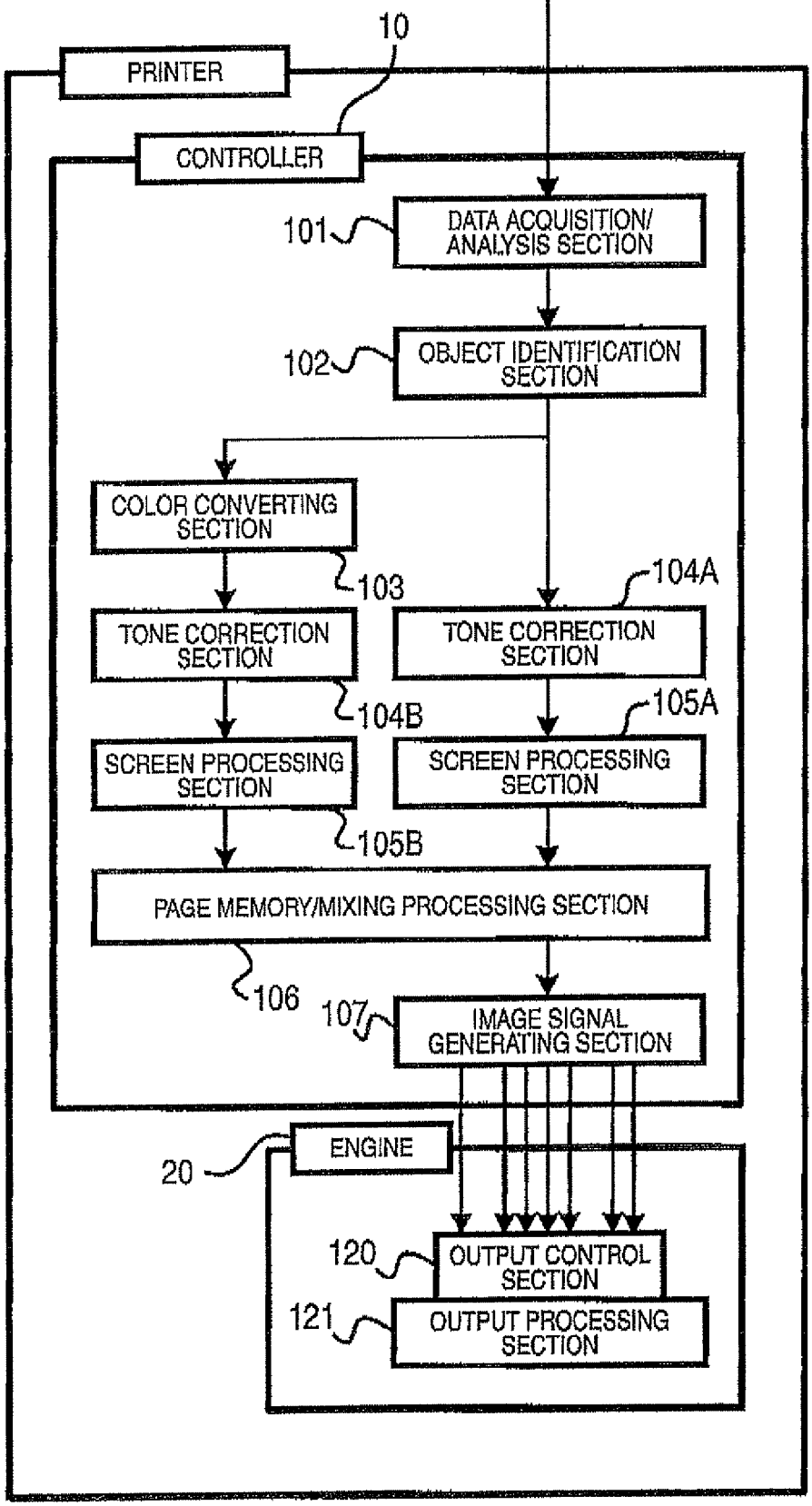
FIG. 1 is a block diagram illustrating an example of the configuration of an image forming apparatus according to an exemplary embodiment of the invention.

FIG. 1 is a block diagram illustrating an example of the configuration of an image forming apparatus according to an exemplary embodiment of the invention.

In FIG. 1, the image forming apparatus is a printer, for example, and is configured to include a controller 10 and an engine 20. The controller 10 is configured to include a data acquisition/analysis section 101, an object identification section 102, a color converting section 103, and tone correction sections 104A and 104B (hereinafter, they may be collectively referred to as a "tone correction section 104"), screen processing sections 105A and 105B (hereinafter, they may be collectively referred to as a "screen processing section 105"), a page memory/mixing processing section 106, and an image signal generating section 107.

In addition, the engine 20 is configured to include an output control section 120 and an output processing section 121.

In the output processing section 121, at least a printing mechanism using color materials of cyan (C), magenta (M), and yellow (Y) is provided. Moreover, a printing mechanism using a color material of a black (K) may also be provided in the output processing section 121.

When the use of black is restricted or the remaining amount of black is deficient, the printout processing using the other color materials (cyan, magenta, and yellow) is performed in the output processing section 121. These cyan, magenta, and yellow are collectively called three primary colors and are also called CMY colors.

In the output processing section 121, it is also possible to generate a color called the "process black", a color of which is similar to black by overlapping the CM colors at a certain rate and to perform the printout.

When the data acquisition/analysis section 101 of the controller 10 receives print data requested to be printed, the data acquisition/analysis section 101 identifies information regarding the printout of the print data by analyzing the received print data. For example, the data acquisition/analysis section 101 identifies as to whether or not a "process black alternative mode" in the printout is set.

For example, the process black alternative mode is a mode that is set when identification information (identification image) of a dot shape is printed on the background of print data. In this case, the identification information of the dot shape is printed out in a monochromatic black, and information, which is instructed in the print data to be printed using the monochromatic black, is printed out using the process black.

Then, the object identification section 102 performs processing for identifying objects (data components) which form the print data. By this processing, character objects, graphic objects, and image objects which form the print data are identified.

In addition, the object identification section 102 may be configured to further perform processing for determining size information (character size and line width) of each object, for each of the identified objects.

Out of these objects, the object identification section 102 transmits the objects for which the printout using the monochromatic black has been instructed, to the tone correction section 104A and transmits to the color converting section 103 the objects for which the printout using colors of the other color materials (cyan, magenta, and yellow) has been instructed.

For the objects for which the printout using the colors has been instructed, the color converting section 103 converts colors, which are constituted on the basis of red (R), green (G), and blue (B), into colors using CMY colors. Then, the color converting section 103 transmits the object, for which color conversion into the CMY colors is performed, to the tone correction section 104B in order to perform tone correction. In addition, when the tone correction has been performed in the tone correction section 104B, it is transmitted to the screen processing section 105B in order to perform screen processing.

When the tone correction and the screen processing have been performed as described above, the screen processing section 105B transmits to the page memory/mixing processing section 106 the objects for which color printing has been instructed.

On the other hand, in the case of the object for which the printout using the monochromatic black has been instructed, the object identification section 102 transmits them to the tone correction section 104A.

In addition, if the object identification section 102 determines the size information of each object and if the size information is in a predetermined size information range, the object identification section 102 transmits the objects to the tone correction section 104A.

The tone correction section 104A performs tone correction in the printout using the process black generated by overlapping the CMY colors.

After the tone correction section 104A performs the tone correction in the printout using the process black, the tone correction section 104A transmits the objects to the screen processing section 105. The screen processing section 105 performs screen processing in the printout using the process black and transmits the objects to the page memory/mixing processing section 106.

The page memory/mixing processing section 106 mixes the objects for which the printout using the monochromatic black has been instructed with the object for which color printing has been instructed and transmits the mixed print data to the image signal generating section 107.

The image signal generating section 107 generates an image signal on the basis of the print data received from the page memory/mixing processing section 106. In addition, toner usage control processing is performed at the time of printout of the image signal in the engine 20.

Figure 4B:
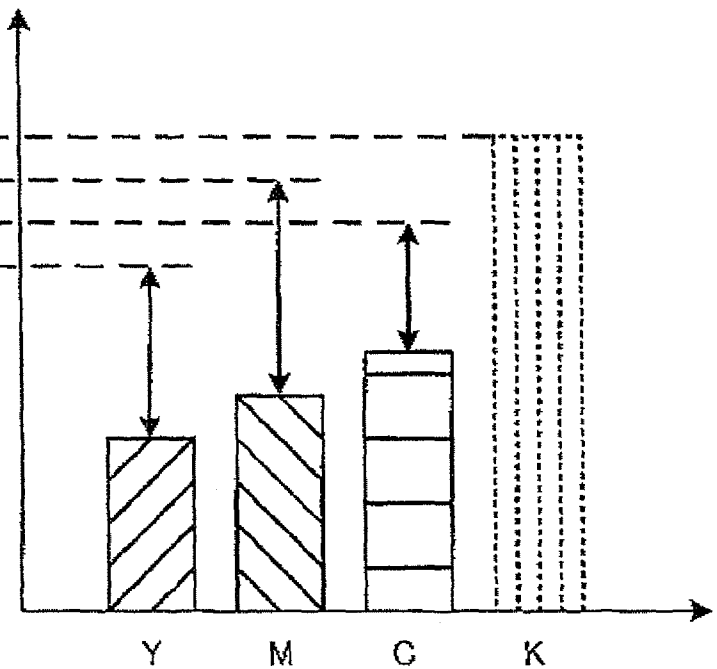
FIGS. 4A and 4B are views illustrating amounts of used toners before and after a potential contrast for development is reduced in printing using three colors of CMY.
Figure 4A:
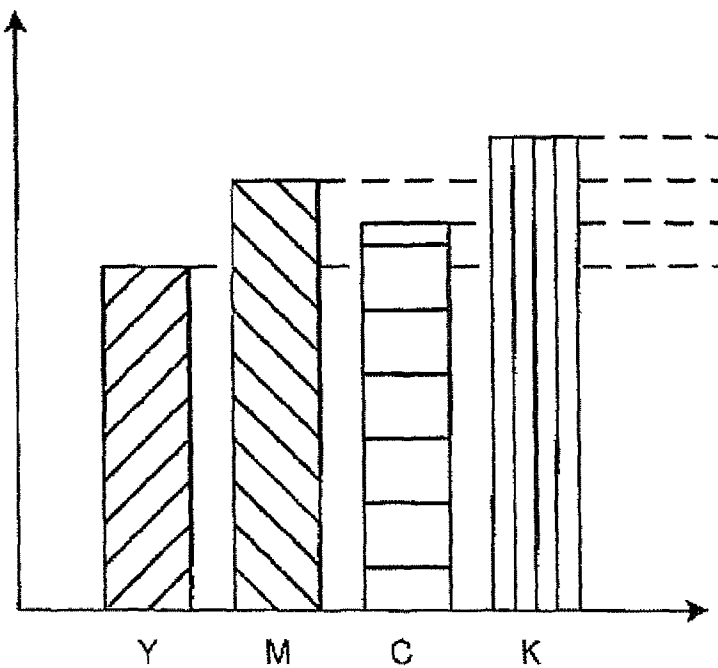

The toner usage control processing is processing that is performed when the objects, for which the printout using the monochromatic black has been instructed, are printed using the process black and is also processing for controlling an amount of each of the CMY colors used in generation of the process black. FIGS. 4A and 4B show a total amount of toner before and after the toner usage control processing is performed. FIG. 4A shows an amount of used toner before it is reduced by the toner usage control processing, and FIG. 4B shows an amount of used toner after it is reduced by the toner usage control processing. The amount of used toner of each of cyan, magenta, and yellow is reduced by performing the toner usage control processing as shown in FIG. 4.

Details of the toner usage control processing will be described later.

The image signal generating section 107, which performs the toner usage control processing as described above, transmits an image signal to the engine 20, and also transmits a control signal based on the control processing to the engine 20 when the toner usage control processing has been performed.

The output control section 120 of the engine 20 receives the image signal and the control signal transmitted from the image signal generating section 107 of the controller 10.

The output control section 120 performs control processing for the printout in the output processing section 121. For example, the control processing includes warm-up processing on the output processing section 121. In addition, the output control section 120 controls the printout based on the control signal.

The output processing section 121 performs the printout by transferring the toner onto the print medium on the basis of the image signal.

Hereinafter, the toner usage control processing will be described.

Figure 2:
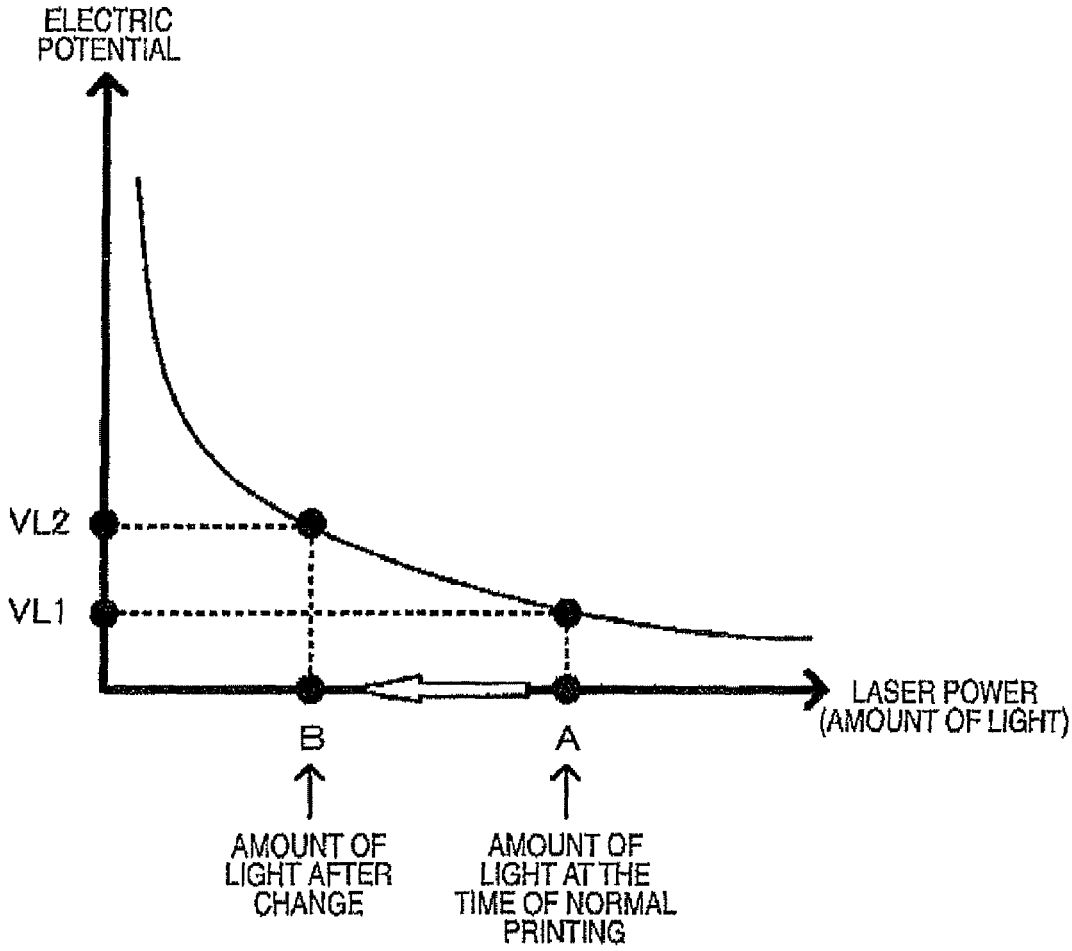
FIG. 2 is a graph illustrating a surface potential of a photoconductor which performs electrophotographic printing.

FIG. 2 is a graph illustrating a surface potential of the photoconductor which performs electrophotographic printing. The horizontal axis indicates an amount of light from a laser or LED irradiated onto the photoconductor, and the vertical axis indicates the surface potential of the photoconductor. The graph of FIG. 2 shows that the electric potential decreases as the amount of light increases and that the electric potential increases as the amount of light decreases.

That is, the graph shows that the electric charges charged on the photoconductor are further discharged as the amount of light increases and accordingly, the surface potential decreases. In addition, the graph shows that the discharge rate of the electric charges charged on the photoconductor is reduced as the amount of light decreases and accordingly, the surface potential increases.

An amount of light at a position A shown in FIG. 2 is an amount of light at the time of normal printing, and the surface potential of the photoconductor corresponding to this amount of light is "VL1". The "normal printing" is, for example, a mode of a color printer in which a color document/object is printed with four colors of yellow, magenta, cyan and black (or five or more colors) and a monochrome document/object is printed only with black (K). An amount of light at position B shown in FIG. 2 is set as an amount of light when the printout is performed using the process black formed of CMY colors in is state.

That is, in the case where the amount of light is smaller than the amount of light used for the normal printout, the surface potential of the photoconductor is set to "VL2". This surface potential "VL2" is a surface potential higher than the surface potential of the photoconductor corresponding to the amount of light at the position A.

That is, as the surface potential of the photoconductor increases as described above, an amount of a toner adhered in the development processing decreases.

In addition, another example of the toner usage control processing is shown below.

Figure 3:
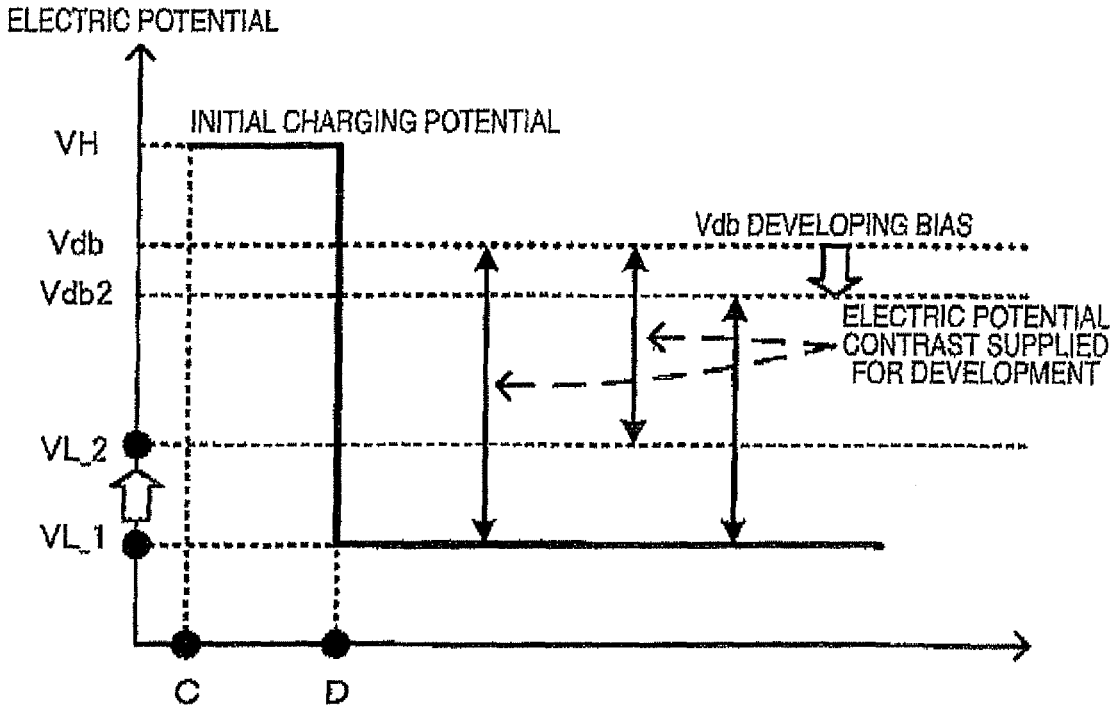
FIG. 3 is a graph illustrating a relationship between the surface potential of the photoconductor and a developing density in the electrophotographic printing.

FIG. 3 is a graph illustrating a relationship between the surface potential of the photoconductor and a developing density in electrophotographic printing. The vertical axis indicates the surface potential of the photoconductor, and the horizontal axis indicates time.

FIG. 3 shows a state where an initial charging potential of the photoconductor is "VH" and a surface potential of a developing member in the developing unit is "Vdb" with respect to the initial charging potential "VH".

Referring to FIG. 3, in the case of printing out each object of a character or graphic and an image with the surface potential "VL1" (shown at the position A of FIG. 2) corresponding to the amount of laser light for the case where normal printing is performed in the above state, the electric potential contrast supplied for development is "Vdb–VL1" obtained by subtracting the surface potential "VL1" from the surface potential "Vdb" of the developing member.

On the other hand, the surface potential for the amount of light shown at the position B of FIG. 2 is "VL2". In the case of printing out each object of a character or graphic and an image with the surface potential "VL2", the electric potential contrast supplied for development is "Vdb—VL2" obtained by subtracting the surface potential "VL2" from the surface potential of the developing member "Vdb".

Since the electric potential "VL2" is higher than the surface potential "VL1", the electric potential contrast of "Vdb–VL2" supplied for development is smaller than that of "Vdb–VL1". That is, the toner amount printed on the printing medium is decreased by reducing the amount of laser light.

Moreover, as another method of reducing the amount of transferred toner, there is a method of reducing (changing) the surface potential of the developing member, which is shown in the graph (FIG. 3) of the relationship between the surface potential of the photoconductor and the developing density, from "Vdb" to "Vdb2".

By reducing the surface potential to "Vdb2", the electric potential contrast supplied for development can be made smaller without the amount of laser light shown in FIG. 2 being changed from the amount of light at the position A. As a result, the amount of toner printed on the printing medium is reduced.

In addition, FIGS. 4A and 4B are views illustrating the amount of used toner before and after the reduction is performed based on the above-described processing when printing is performed using three colors of CMY.

FIG. 4A shows the amount of used toner before the reduction, and FIG. 4B shows the amount of used toner after the reduction.

As shown in FIG. 4B, the reduction rates of cyan (C), magenta (M), and yellow (Y) are different, but the amount of transferred toner of each of cyan (C), magenta (M), and yellow (Y) has been reduced.

Figure 5:
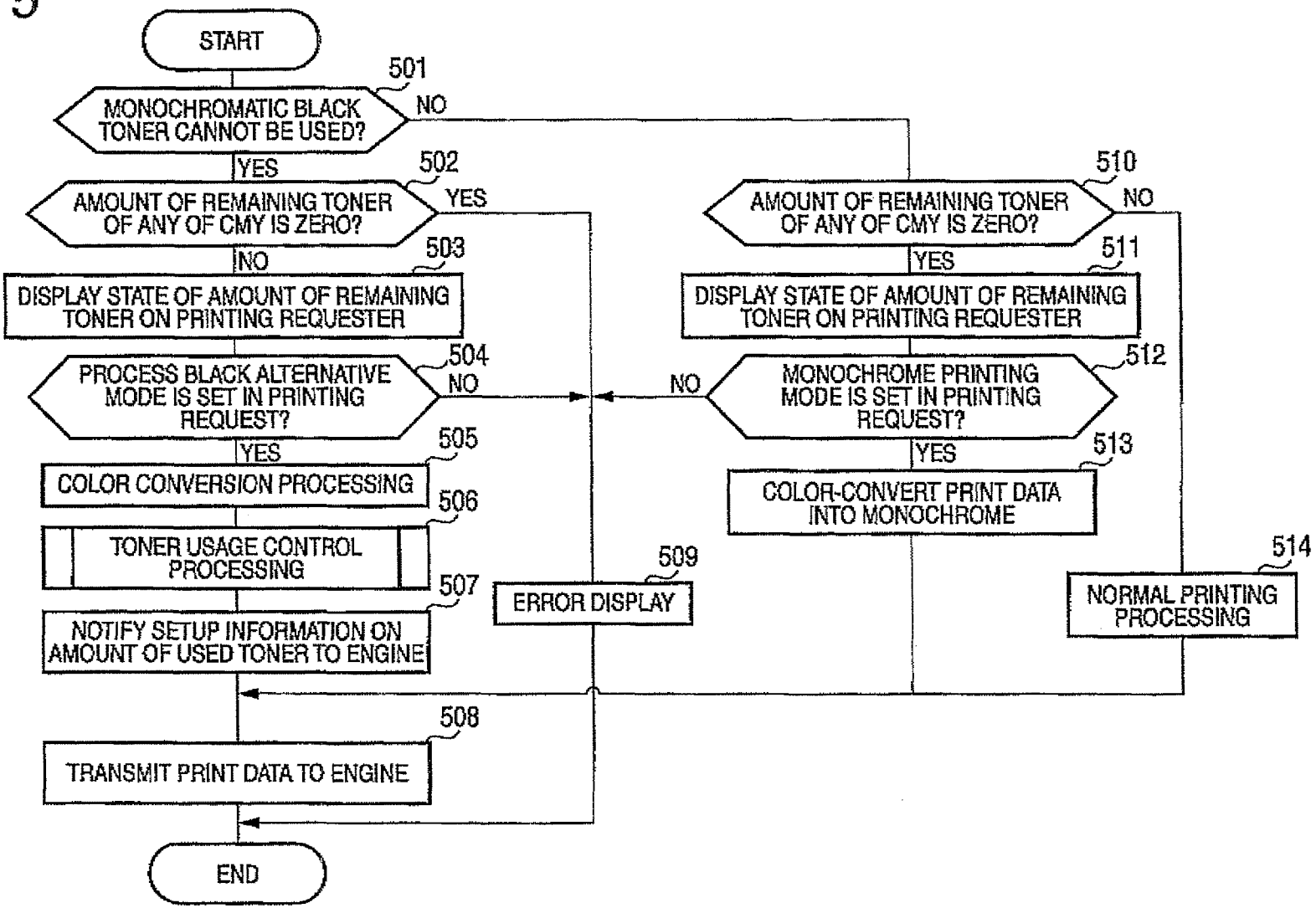
FIG. 5 is a flow chart illustrating a flow of processing performed by the image forming apparatus, which reduces the amount of transferred toner.

A flow of processing performed by the image forming apparatus, which reduces the amount of transferred toner in the toner usage control processing, is shown in FIG. 5.

Referring to FIG. 5, when a printing request of print data is received from a printing requester, the processing starts, and it is determined as to whether or not the image forming apparatus is in a state where the monochromatic black toner cannot be used (501). When the image forming apparatus is in the state where the monochromatic black toner cannot be used (YES in 501), it is then determined as to whether or not any toner of three colors of CMY of cyan (C), magenta (M), and yellow (Y) is in an unusable state (502).

If any toner of three colors of CMY cannot be used (YES in 502), error notification indicating that the printout cannot be performed for the printing requester (509) and then the processing ends. In addition, if all toner of the three colors of CMY can be used (NO in 502), the amount of remaining toner is notified to the printing requester (503).

Then, it is determined as to whether or not the process black alternative mode is set in the printing request (504). The "case where the process black alternative mode is set" means that when an object for which the printout using the black is designated cannot be printed with the monochromatic black, the printout using the process black is allowed instead.

If the process black alternative mode is not set in the printing request (NO in 504), error notification is performed indicating that the printing processing cannot be continued (509) and then the processing ends. On the other hand, if the process black alternative mode is set in the printing request (YES in 504), processing for color conversion of print data requested to be printed from RGB colors into CMY colors is then performed (505).

After the processing for color conversion into the CMY colors is performed, toner usage control processing which is used for printing of the print data based on the CMY colors after the color conversion processing is performed (506). The toner usage control processing is processing for reducing the amount of transferred toner as shown in the graph shown in FIGS. 2 and 3. The detailed flow of this control processing is shown in FIGS. 6 and 7.

Figure 6:
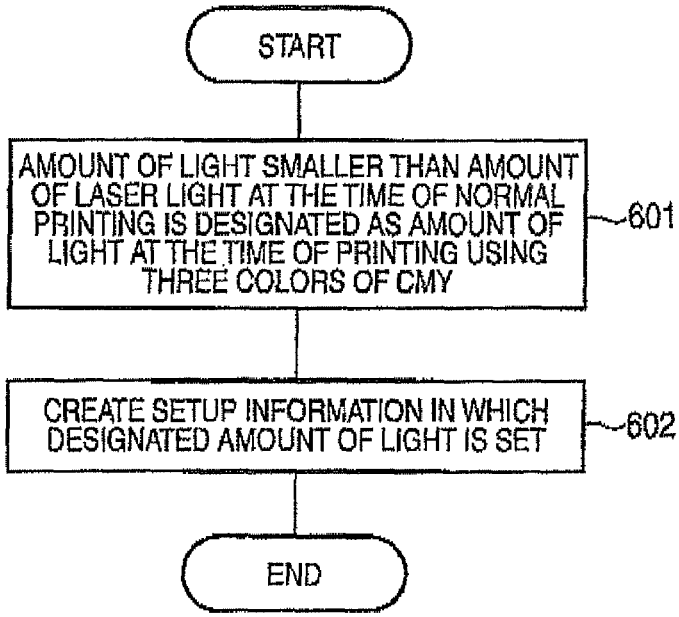
FIG. 6 is a flow chart illustrating a flow of control processing of the amount of used toner which is used in printing print data using CMY colors.

Referring to FIG. 6, an amount of light which is smaller than the amount of laser light at the time of normal printing is designated as the amount of light when printing using three colors of CMY (601). Ten, setup information in which the amount of light is set is created in order to male it possible to transfer the toner based on the designated amount of light (602).

Figure 7:
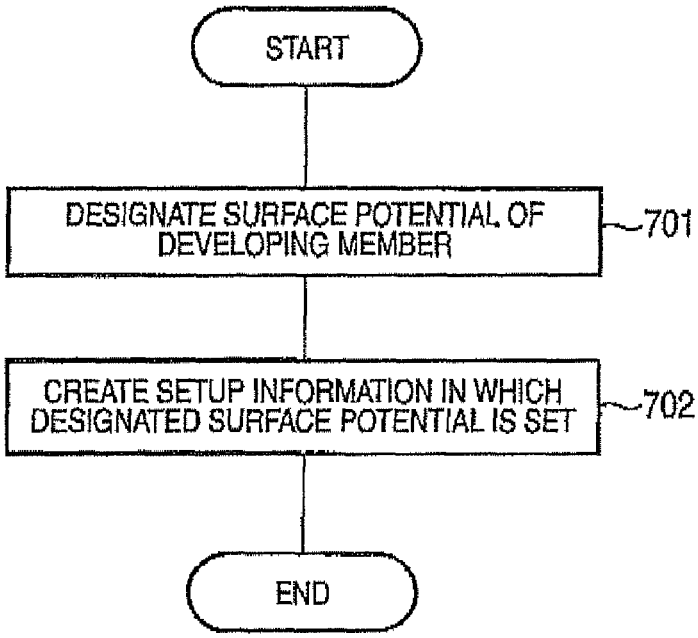
FIG. 7 is a flow chart illustrating a flow of control processing of the amount of used toner which is used in printing print data using CMY colors.

Moreover, referring to FIG. 7, the surface potential of the developing member is designated (701). Then, setup information is created in which the designated surface potential is set (702).

After the toner usage control processing in which the setup information is created by the processing shown in FIGS. 6 and 7 is performed (506), information on the amount of laser light or information on the surface potential of the developing member set by the setup information is notified to the engine, which performs image forming processing of the print data requested to be printed, in the flow chart shown in FIG. 5 (507). Then, the print data requested to be printed is transmitted to the engine (508).

In addition, if it is determined that the monochromatic black toner can be used (NO in 501) in the processing for determining as to whether or not the image forming apparatus is in a state where the monochromatic black toner cannot be used (501), it is then determined as to whether or not any toner of three colors of CMY of cyan (C), magenta (M), and yellow (Y) is in an unusable state (510).

If all toner of three colors of CMY can be used (NO in 510), normal printing processing is performed (514) and the generated print data is transmitted to the engine (508).

In addition, if any toner of three colors of CMY cannot be used (YES in 510), the amount of remaining toner is notified to the printing requester (511) and then it is determined as to whether or not a monochrome printing mode is set in the printing request (512). If the monochrome printing mode is not set in the printing request (NO in 512), error notification is performed indicating that the print data requested to be printed cannot be printed out (509) and then the processing ends.

On the other hand, if the monochrome printing mode is set (YES in 512), color conversion into the monochrome is performed for the print data requested to be printed in order to perform monochrome printing using the monochromatic black toner (513).

Then, the print data color-converted into the monochrome is transmitted to the engine (509).

In this way, the toner usage control processing is performed in the image forming apparatus, such that the amount of used toner is reduced.

Moreover, another toner usage control processing will be described below.

Figure 8:
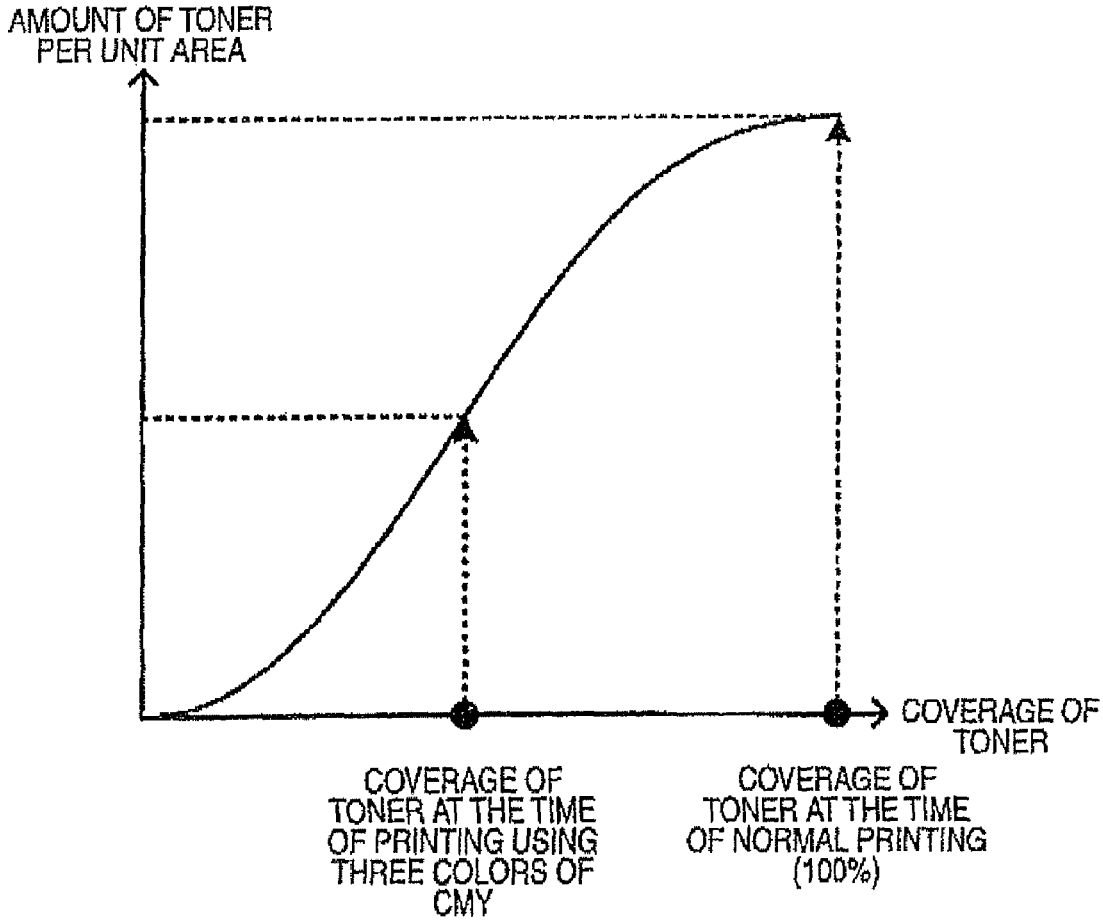
FIG. 8 is a graph illustrating the amount of toner per unit area relative to a coverage of toner of an object of print data.

FIG. 8 is a graph illustrating an amount of toner per unit area relative to a coverage of toner of an object of print data. The horizontal axis indicates the coverage of toner, and the vertical axis indicates the amount of toner per unit area.

Assuming that the coverage of toner at the time of normal printing is "100%", the coverage of toner when the printout is performed using the process black or gray color formed of the three colors of CMY colors is lower than the coverage of toner "100%" at the time of normal printing.

That is, the toner density of an object of print data is decreased and accordingly, a printout is performed which is thinned out compared with the case when the printout is performed with the coverage of toner of "100%".

Figure 9:
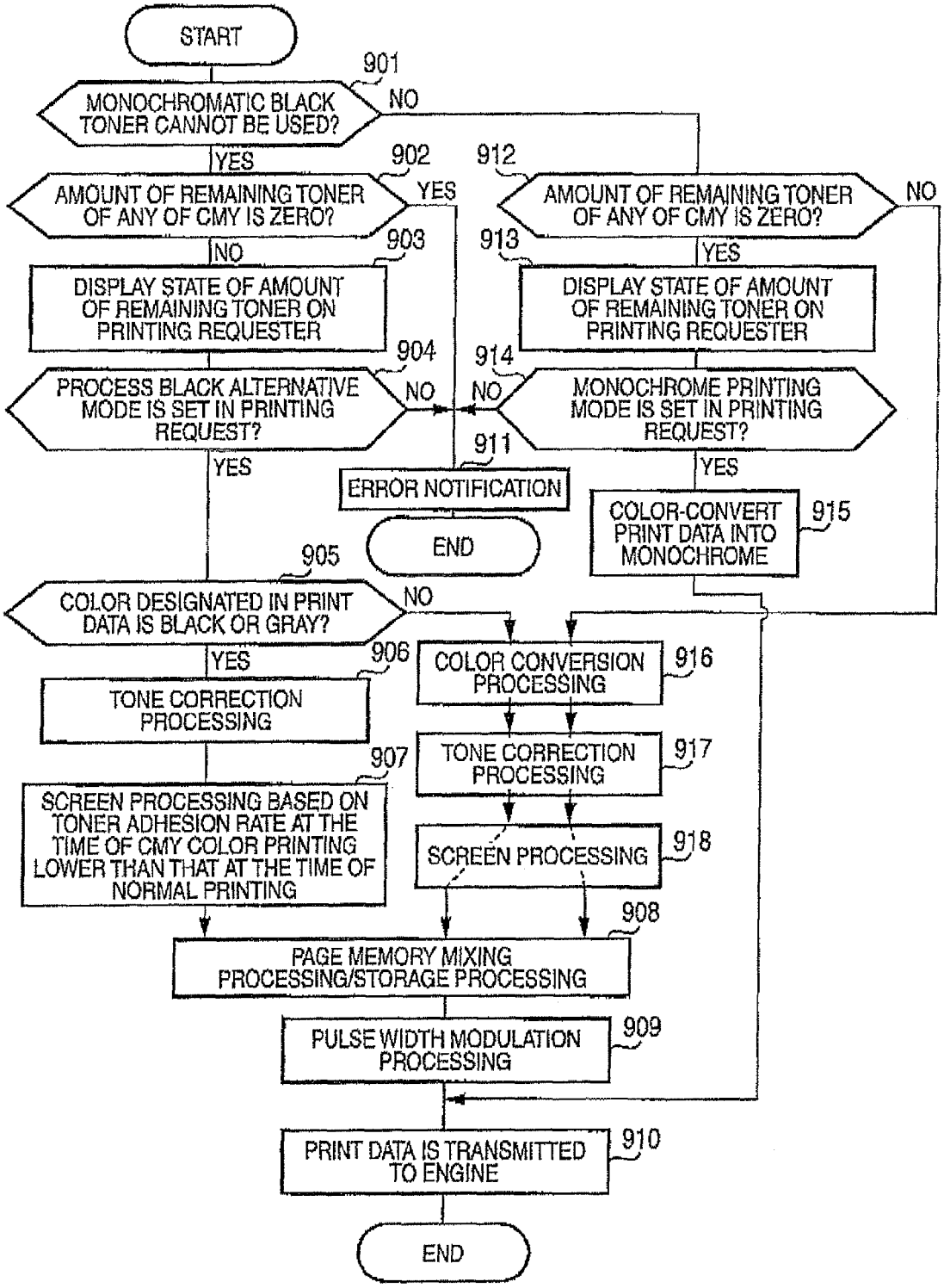
FIG. 9 is a flow cart illustrating a flow of processing in the image forming apparatus according to the exemplary embodiment of the invention.

The flow of processing in a printer which is an example of the image forming apparatus at this time is shown in FIG. 9.

Referring to FIG. 9, when a printing request of print data is received from a printing requester, the processing starts, and it is determined as to whether or not the printer is in a state where a monochromatic black toner cannot be used (901). If the printer is in a state where the monochromatic black toner cannot be used (YES in 901), it is then determined as to whether or not any toner of three colors of CMY of cyan (C), magenta (M), and yellow (Y) is in an unusable state (902).

If any toner of three colors of CMY cannot be used (YES in 902), error notification is performed indicating that the printout cannot be performed for the printing requester (911) and then the processing ends. In addition, if all toner of three colors of CMY can be used (NO in 902), that is, if an object for which the printout based on the black using the process black has been instructed is printed out, the amount of remaining toner is first notified to the printing requester (903).

Then, it is determined as to whether or not the process black alternative mode is set in the printing request (904). The "case where the process black alternative mode is set" means that if an object for which the printout using the black is designated cannot be printed with the monochromatic black, the printout using the process black is allowed instead.

If the process black alternative mode is not set in the printing request (NO in 904), error notification is performed indicating that the printing processing cannot be continued (911) and then the processing ends. On the other hand, if the process black alternative mode is set in the printing request (YES in 904), it is determined as to whether or not the color designated in the print data requested to be printed is black or gray (905). If printing using black or gray is designated (YES in 905), tone correction processing of the print data is performed (906), and then screen processing is performed on the basis of the coverage of toner at the time of CMY color printing which is lower than that at the time of normal printing (907).

Then, page memory mixing processing/storage processing is performed (908), pulse width modulation processing is performed (909), and the print data is transmitted to the engine (910).

On the other hand, if the color designated in the print data is neither black nor gray (NO in 905) in the processing for determining the color designated in the print data (905), color conversion processing is performed first (916) in order to perform the printout with the color designated in the print data. Then, tone correction processing is performed (917), and normal screen processing is performed (918). Then, page memory mixing processing/storage processing is performed (908), pulse width modulation processing is performed (909), and the print data is transmitted to the engine (910).

In addition, if it is determined that the monochromatic black toner can be used (NO in 901) in the processing for determining as to whether or not the printer is in a state where the monochromatic black toner cannot be used (901), it is then determined as to whether or not any toner of three colors of CMY of cyan (C), magenta (M), and yellow (Y) is in an unusable state (912).

If all toner of three colors of CMY can be used (NO in 912), color conversion processing is performed first (916) in order to perform the printout with the color designated in the print data. Then, tone correction processing is performed (917, and normal screen processing is performed (918). Them page memory mixing processing/storage processing is performed (908), pulse width modulation processing is performed (909), and the print data is transmitted to the engine (910).

In addition, if any toner of three colors of CMY cannot be used (YES in 912), the amount of remaining toner is notified to the printing requester (913) and then it is determined as to whether or not a monochrome printing mode is set in the printing request (914). If the monochrome printing mode is not set in the printing request (NO in 914), error notification is performed indicating that the print data requested to be printed cannot be printed out (911) and then the processing ends.

On the other band, if the monochrome printing mode is set (YES in 914), color conversion into the monochrome is performed for the print data requested to be printed in order to perform monochrome printing using the monochromatic black toner (915).

Then, the print data color-converted into the monochrome is transmitted to the engine (910).

In this way, the toner usage control processing is performed in the printer, such that the amount of used toner is reduced.

Furthermore, another toner usage control processing will be described below.

Figure 10:
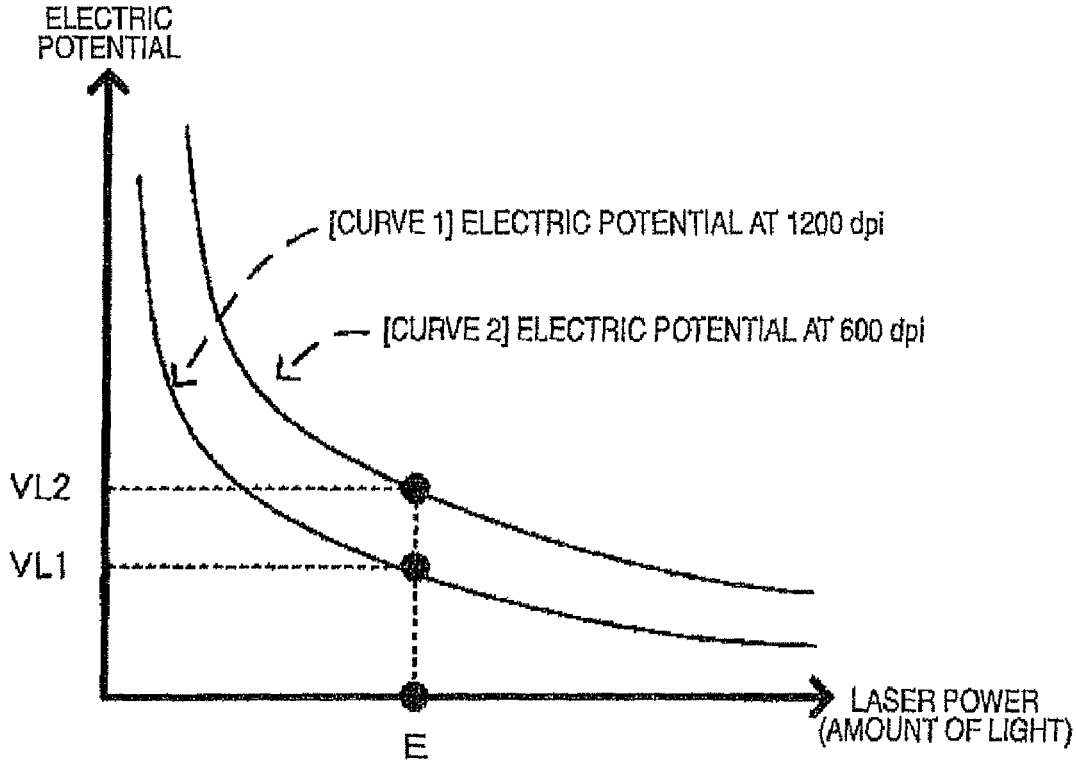
FIG. 10 is a graph illustrating the surface potential of the photoconductor in electrophotographic printing.

FIG. 10 is a graph illustrating the surface potential or a photoconductor in electrophotographic printing. The horizontal as indicates an amount of light from a laser or LED irradiated onto the photoconductor, and the vertical axis indicates the surface potential electrically charged on the photoconductor.

Two graphs are shown in FIG. 10. A curve 1 shows a surface potential when printout is performed with the resolution of 1200 dpi, and a curve 2 shows a surface potential when printout is performed with the resolution of 600 dpi in one of the horizontal and vertical directions. These two graphs show that the electric potential decreases as the amount of light increases and that the electric potential increases as the amount of light decreases.

For an amount of light at a position E, the surface potential is "VL1" in the graph of the resolution of 1200 dpi shown in the curve 1. Similarly, for the amount of light at the same position E, the surface potential is "VL2" in the graph of the resolution of 600 dpi shown in the curve 2. The surface potential "VL2" shown in the graph of the resolution of 600 dpi is higher than the surface potential "VL1" shown in the graph of the resolution of 1200 dpi.

That is, in the curve 2 of small resolution of 600 dpi, a higher surface potential is obtained by the same amount of lit.

Since the surface potential increases if the resolution decreases from 1200 dpi to 600 dpi, the difference between the surface potential of the photoconductor and the surface potential "Vdb" of the developing member shown in the graph of FIG. 3 is reduced. As a result, the electric potential contrast supplied for development is reduced. That is, the amount of toner printed on the printing medium is reduced.

FIG. 11 is a view illustrating a flow of processing in the printer when size information of an object is in a predetermined range, and shows a flow of processing when changing of the resolution is used for controlling the amount of used toner.

Referring to FIG. 11, when a printing request of print data is received from a printing requester, the processing starts, and it is determined as to whether or not the printer is in a state where the monochromatic black toner cannot be used (901). If the printer is in a state where the monochromatic black toner cannot be used (YES in 901), it is then determined as to whether or not any toner of three colors of CMY of cyan (C), magenta (M), and yellow (Y) is in an unusable state (902).

If any toner of three colors of CMY cannot be used (YES in 902), error notification is performed indicating that the printout cannot be performed for the printing requester (911) and then the processing ends. In addition, if all toner of three colors of CMY can be used (NO in 902), that is, if an object for which the printout based on the black using the process black has been instructed is printed out, the amount of remaining toner is first notified to the printing requester (903).

Then, it is determined as to whether or not the process black alternative mode is set in the printing request (904). The "case where the process black alternative mode is set" means that when an object for which the printout using the black is designated cannot be printed with the monochromatic black, the printout using the process black is allowed instead.

If the process black alternative mode is not set in the printing request (NO in 904), error notification is performed indicating that the printing processing cannot be continued (911) and then the processing ends. On the other hand, if the process black alternative mode is set in the printing request (YES in 904), it is then determined as to whether or not the color designated in the print data requested to be printed is black or gray (905). If printing using black or gray is designated (YES in 905), size information of the object for which printing using black or gray is designated is then determined (1101).

In the determination processing (1101), it is determined as to (i) whether or not a character size of a character object is equal to or smaller than a predetermined character size or (ii) whether or not a line width of a graphic object is equal to or smaller than a predetermined line width. If it is determined that the character size of the character object is equal to or smaller than the predetermined character size or that the line width of the graphic object is equal to or smaller than the predetermined line width (YES in 1101), tone correction processing of the print data is performed (906), and then screen processing is performed on the basis of the coverage of toner at the time of CMY color printing which is lower than that at the time of normal printing (907).

Then, a resolution that is used in printing out the objects is changed to a lower one (1102).

Then, page memory mixing processing/storage processing is performed (908), pulse width modulation processing is performed (909), and the print data is transmitted to the engine (910).

On the other hand, if the color designated in the print data is neither black nor gray (NO in 905) in the processing for deterring the color designated in the print data (905) or if it is determined that the character object is not equal to or smaller than the predetermined character size and the line width of the graphic object is not equal to or smaller than the predetermined line width (NO in 1101) in the determination processing of the size information of the object, color conversion processing is performed first (916) in order to perform the printout with the color designated in the print data. Then, tone correction processing is performed (917), and normal screen processing is performed (918).

Then, page memory mixing processing/storage processing is performed (908), pulse width modulation processing is performed (909), and the print data is transmitted to the engine (910).

In addition, if it is determined that the monochromatic black toner can be used (NO in 901) in the processing for determining as to whether or not the printer is in a state where the monochromatic black toner cannot be used (901), it is then determined as to whether or not any toner of three colors of CMY of cyan (C), magenta (M), and yellow (Y) is in an unusable state (912).

If all toner of three colors of CMY can be used (NO in 912), color conversion processing is performed first (916) in order to perform the printout with the color designated in the print data. Then, tone correction processing is performed (917), and normal screen processing is performed (918). Then, page memory mixing processing/storage processing is performed (908), pulse width modulation processing is performed (909), and the print data is transmitted to the engine (910).

In addition, if any toner of tree colors of CMY cannot be used (YES in 912), the amount of remaining toner is notified to the printing requester (913) and then it is determined as to whether or not a monochrome printing mode is set in the printing request (914). If the monochrome printing mode is not set in the printing request (NO in 914), error display is performed indicating that the print data requested to be printed cannot be printed out (911) and then the processing ends.

On the other hand, if the monochrome printing mode is set (YES in 914), color conversion into the monochrome is performed for the print data requested to be printed in order to perform monochrome printing using the monochromatic black toner (915).

Then, the print data color-converted into the monochrome is transmitted to the engine (910).

In this way, the toner usage control processing is performed in the printer, such that the amount of used toner is reduced.

Figure 12A:
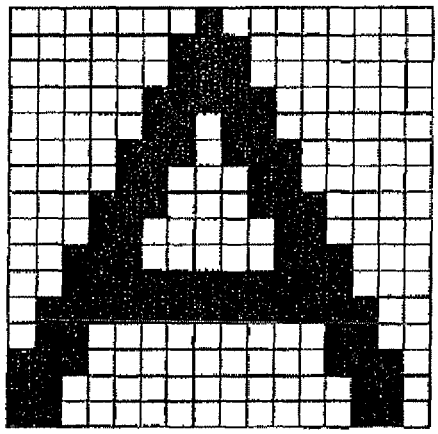
FIGS. 12A to 12C are views illustrating examples of a character printed out with a resolution of 1200 dpi and the character printed oat with a resolution of 600 dpi.
Figure 12B:
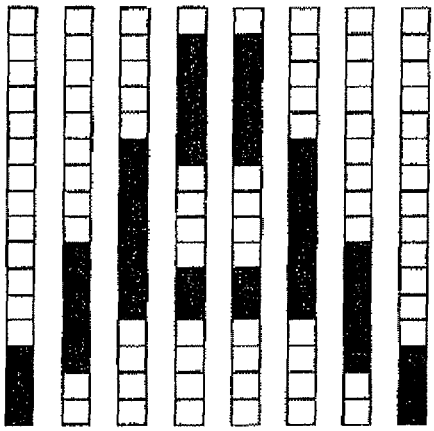
Figure 12C:
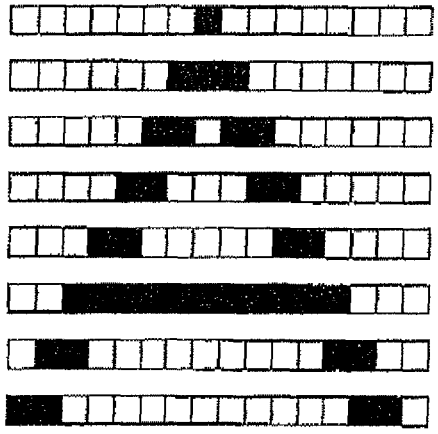

Examples of the character printed out with the resolution of 1200 dpi and the character printed out with the resolution of 600 dpi are shown in FIGS. 12A to 12C.

FIG. 12A shows the character "A" printed out with the resolution of 1200 dpi (vertical direction)×1200 dpi (horizontal direction). FIG. 12B shows the character "A" printed out with the resolution of 600 dpi (vertical direction)×1200 dpi (horizontal direction). FIG. 12C shows the character "A" printed out with the resolution of 1200 dpi (vertical direction)×600 dpi (horizontal direction).

The resolution in the vertical direction of the character with the resolution of 600 dpi (vertical direction)×1200 dpi (horizontal direction) shown in FIG. 12B is half of that of the character shown in FIG. 12A. In addition, the resolution in the horizontal direction of the character with the resolution of 1200 dpi (vertical direction)×600 dpi (horizontal direction) shown in FIG. 12C is half of that of the character with the resolution shown in FIG. 12A.

Figure 13:
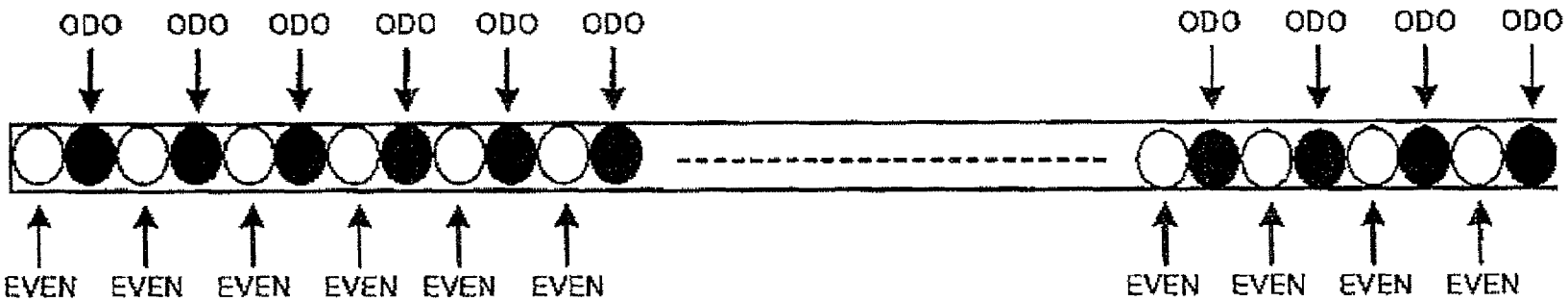
FIG. 13 is a view illustrating an exposure state when an LED is used.

In the case of exposure processing using LEDs, the characters with the resolutions shown in FIGS. 12B and 12C are irradiated by LEDs arrayed with every other one turned off as shown in FIG. 13. That is, irradiation using "ODO" LEDs is not performed when irradiation using "EVEN"[7] LEDs is performed, and irradiation using "EVEN" LEDs is not performed when irradiation using "ODO" LEDs is performed.

Figure 14B:
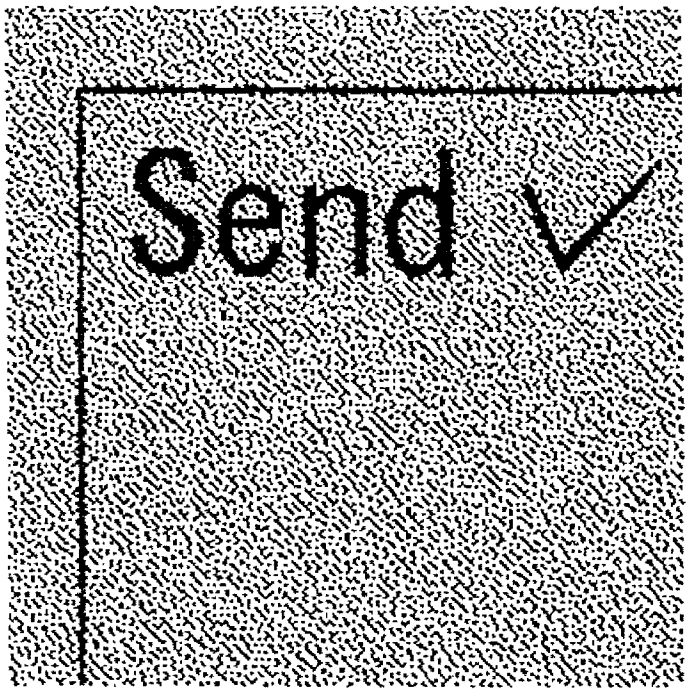
FIGS. 14A and 14B are views illustrating output results of print data.
Figure 14A:
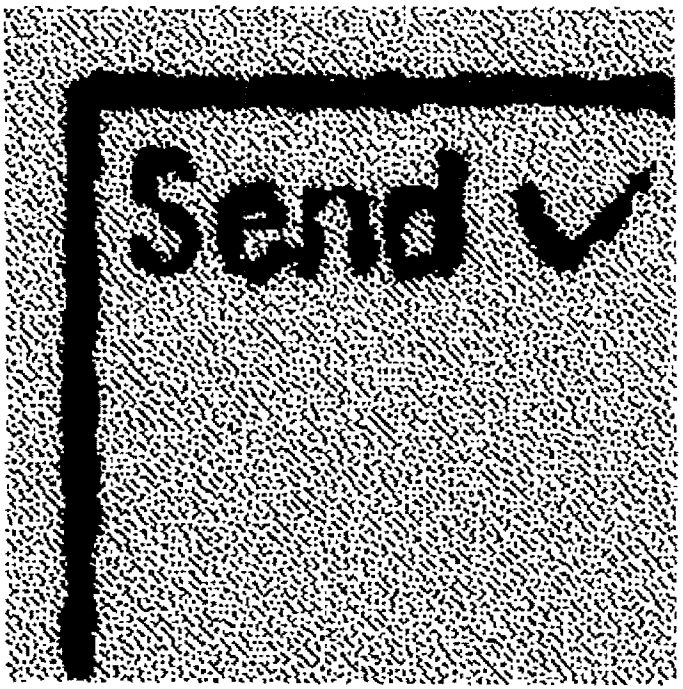

FIGS. 14A and 14B are views illustrating the output results of print data before and after application of the processing shown in FIGS. 5 and 9.

FIGS. 14A and 14B show the states where the watermark of the background is printed out using the monochromatic black and the character of 'Send' and the line are printed out with the process black.

FIG. 14A is a view illustrating the output result of print data before application of the processing shown in FIGS. 5 and 9, and shows the state where the character and the line have spread out. FIG. 14B is a view illustrating the output result of print data after application of the processing shown in FIGS. 5 and 9, and shows the state where the character and the line are printed out more clearly compared with FIG. 14A.

Second Exemplary Embodiment

Figure 15:
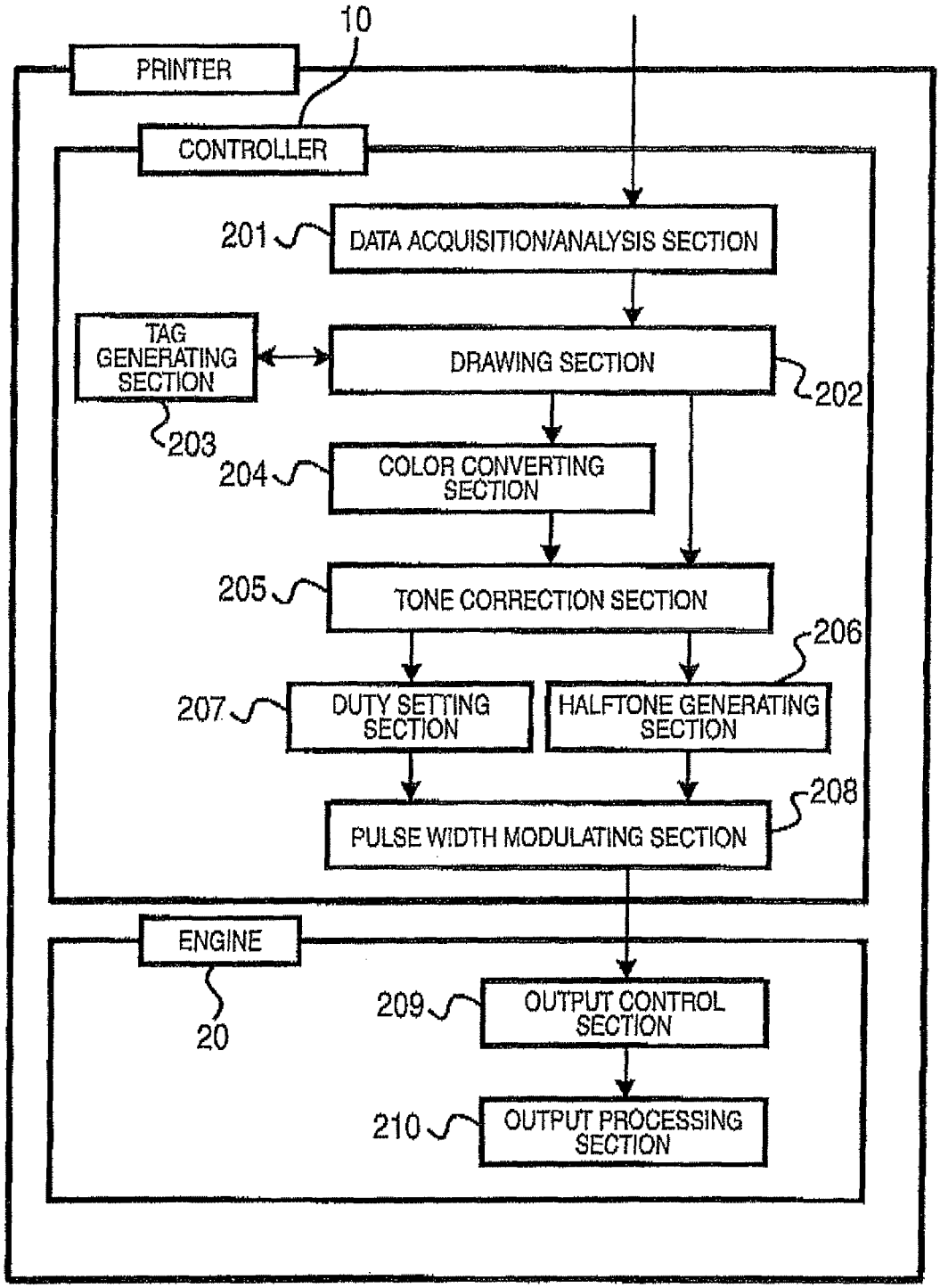
FIG. 15 is a block diagram illustrating the configuration of an image forming apparatus according to another exemplary embodiment of the invention.

FIG. 15 is a block diagram illustrating the configuration of an image forming apparatus according to another exemplary embodiment of the invention.

Referring to FIG. 15, a printer which is an example of the image forming apparatus includes a controller 10 and an engine 20. The controller 10 is configured to include a data acquisition analysis section 201, a drawing section 202, a tag generating section 203, a color converting section 204, a tone correction section 205, a halftone generating section 206, and a pulse width modulating section 208. The engine 20 is configured to include an output control section 209 and an output processing section 210.

The data acquisition/analysis section 201 acquires print data requested to be printed and transmits it to the drawing section 202. The print data requested to be printed at this time is formed of color information of red (R), green (G), and blue (B) (hereinafter, they be collectively referred to as "RGB colors").

The drawing section 202 classifies the print data received from the data acquisition/analysis section 201 into objects, which are components of the print data, and identifies each object after the classification. Examples of the objects that form the print data at this time include character objects, line objects, and image objects.

The character object is an object formed of characters. The line object is an object formed of figure and graphic which are line drawings. The image object is an object formed of an image, such as a photograph.

After the objects are classified by the drawing section 202 and each of the objects is identified, information of the objects which form the print data is transmitted to the tag generating section 203.

When the information of the object received from the drawing section 202 is the character object or the line object, the tag generating section 203 determines as to whether or not it corresponds to a condition, being designated in advance, regarding color material control at the time of printout. If it is determined that any of the objects of the print data is the character object or line object and meet the condition regarding the color material control, tag information is generated based on the condition regarding the color material control of the character object or line object.

For example, the condition regarding the color material control at the time of printout may be (i) a condition that "R, G and B of the character object or line object are equal in lightness to each other (lightness of R=lightness of G=lightness of B) or a difference between maximum lightness and minimum lightness of R, G, and B of the character object or line object is within a predetermined value" or (ii) a condition that "a size of the character object is equal to or smaller than a predetermined character size or a width of the line object is equal to or smaller than a predetermined line width". The condition regarding the color material control at the time of printout is a condition used to determine as to whether or not control is performed for the amount of used color materials, the rate of used color materials, and the like at the time of printout.

The tag information includes not only the information indicating as to whether or not it meets the condition regarding the color material control at the time of printout but also the setup information regarding the color material control. "1" is set as the tag information when it meets the condition regarding the color material control, and "0" is set as the tag information when it does not meet the condition regarding the color material control.

In addition, a feature expressed by the met condition is set as setup information regarding the color material control and is used in processing of the duty setting section 207.

For example, in the case of the character object the information indicating that a character size fearing the character object is equal to or smaller than the predetermined character size is set as the setup information.

Moreover, when the image object is classified and identified by the drawing section 202, tag information in which "0" is set is generated as the tag information of the object.

After the tag generating section 203 generates the tag information of each object as described above, the drawing section 202 receives the tag information from the tag generating section 203. At this time, the drawing section 202 transmits the tag information and each object to the color converting section 204 to request color conversion processing.

The color converting section 204 performs the color conversion processing for each received object. An example of the color conversion processing includes processing of converting color information based on RGB colors of the print data requested to be printed into color information based on cyan (C), magenta M, and yellow (Y) (hereinafter, they may be collectively referred to as 'CMY colors') used at the time of printout.

In addition, there is also processing for color conversion of the color coordinate value of L*a*b* in the CIE L*a*b* color space into CMY colors. In addition, "L*" in the CIE Lab color space indicates a lightness of a color, "a*") indicates a saturation in an axial space of red and green, and "b*" indicates a saturation in an axial space of yellow and blue. Hereinafter, the color coordinates of L*a*b* are simply expressed as "Lab".

After the color converting section 204 performs the processing for color conversion into the CMY colors on the basis of the color information of the original object, the color converting section 204 transmits the object for which the color conversion is performed and the tag information to the tone correction section 205.

The tone correction section 205 performs tone correction on the basis of the converted CMY colors after the color conversion in the color converting section 204. In addition, the tone correction section 205 determines as to whether the tag information generated by the tag generating section 203 is "0" or "1" and also determines as to whether or not it is designated to perform the same processing as in the case where the tag information is determined to be "1" only for a certain specific color (cyan, magenta and yellow).

If the tag information is "1", the tone correction section 205 transmits each object and the tag information to the duty setting section 207. If the tag information is "0", the tone correction section 205 transmits each object and the tag information to the halftone generating section 206.

The duty setting section 207 to which each object and the tag information are transmitted when the tag information is "1" sets an exposure pulse duration (duty) in a pixel unit on the basis of the setup information of the tag information. For example, the duty setting section 207 sets the duty to reduce the total toner amount (pile height) by reducing the duty of each color material of printed CMY colors from the duty (100%) at the time of printing.

The duty at is time may be a value designated in advance or may be set on the basis of the setup information regarding the color material control included in the tag information. Of course, the duty may be set for each of CMY colors.

Figure 17:
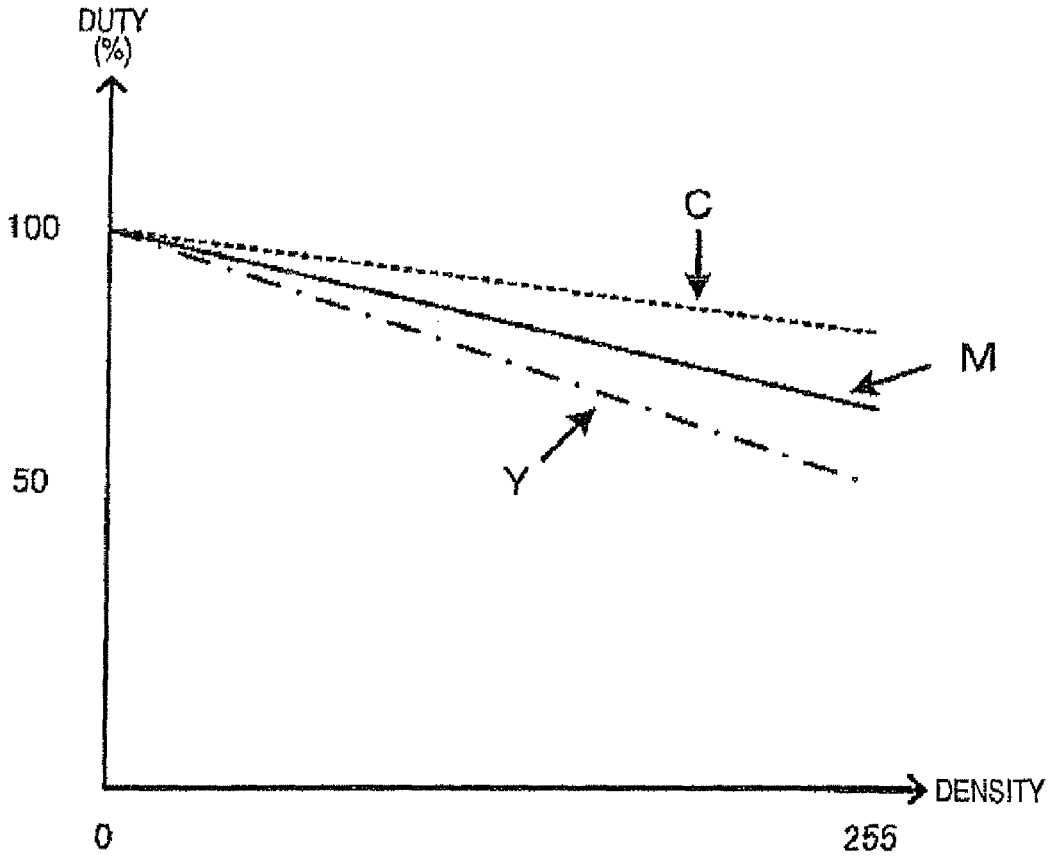
FIG. 17 is a graph illustrating a duty (%) relative to a density of each of CMY colors.
Figure 18:
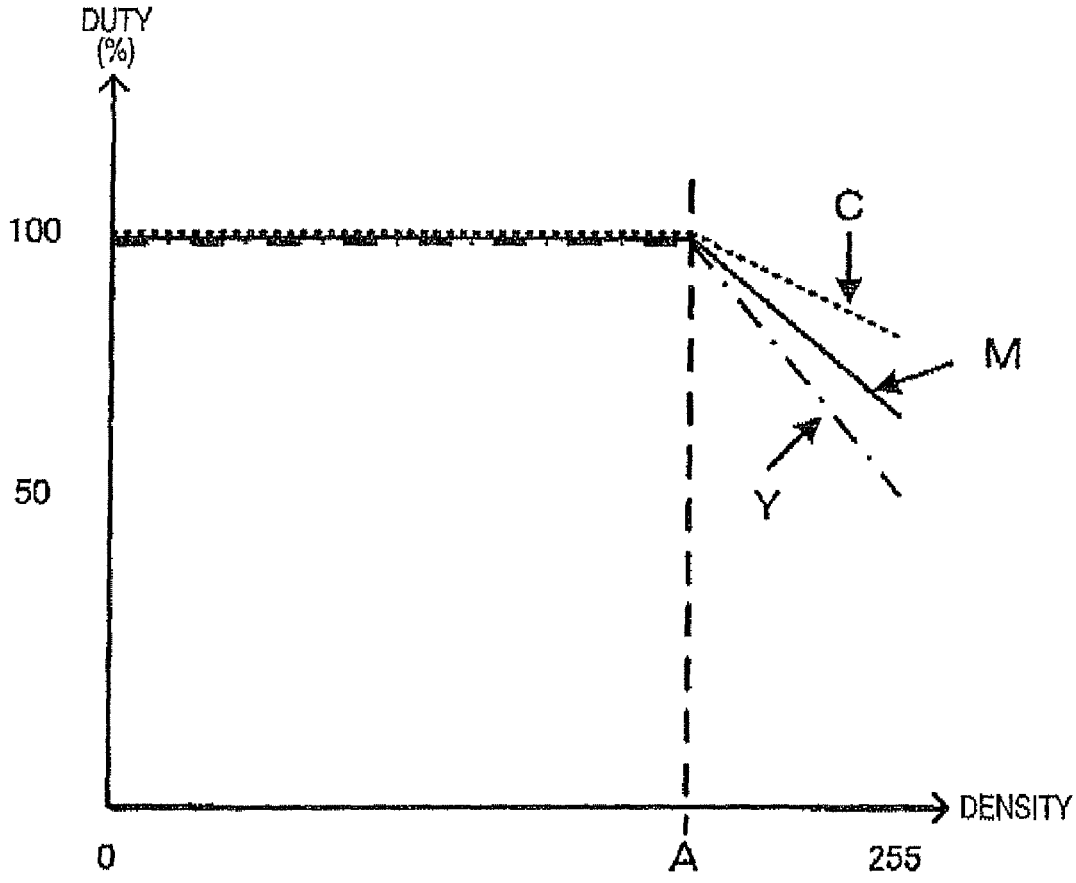
FIG. 18 is another example of the graph illustrating the duty relative to the density of each of the CMY colors shown in FIG. 17.

For example, when "equal to or smaller than the predetermined character size" is set as the setup information regarding the color material control included in the tag information, the duty setting section 207 acquires the duty for the case where it is equal to or smaller than the predetermined character size from a management table that is managed separately and sets it, and also makes a determination on the basis of the graph shown in FIG. 17 or 18.

Then, the halftone generating section 206 to which each object and the tag information are transmitted when the tag information is "0" performs processing for generating a halftone (which may also be referred to as a "dot image") expressing a shade.

Moreover, in the above-described processing, the object and the tag information transmitted from the drawing section 202 is received in the color converting section 204. However, the invention is not limited to such a configuration. When the tone correction section 205 is set to perform tone correction dedicated to the gray color in the case where "R, G and B of the object are equal in lightness to each other (lightness of R=lightness of G=lightness of B) or a difference between maximum lightness and minimum lightness of R, Q, and B of the object is within a predetermined value", the drawing section 202 may identify that the tag information generated by the tag generating section 203 is "1", to thereby transmit the object and the tag information to the tone correction section 205 instead of the color converting section 204.

After the respective processings are performed in the duty setting section 207 and the halftone generating section 206, each object is transmitted to the pulse width modulating section 208. The pulse width modulating section 208 mixes the respective objects. When duty setting is performed for the print data after mixing, processing is performed for modulating the pulse width according to the duty.

After the pulse width modulating section 208 performs the pulse width modulation processing, the print data is transmitted to the engine 20.

The output control section 209 of the engine 20 receives the print data transmitted from the pulse width modulating section 208 and performs an output control based on the print data. Then, the output control section 209 transmits it to the output processing section 210, and the output processing section 210 performs printout processing.

When the duty is set by the duty setting section 207, the output control section 209 performs control processing to enable print out of each pixel with the pulse width based on the duty, such that the printout is performed with a smaller amount of color materials as compared with the printout at the normal duty.

Processing based on the condition regarding the color material control at the fine of printout included in the tag information generated by the tag generating section 203 and the value of the duty set by the duty setting section 207 is shown in FIGS. 16 to 34, and the explanation thereon will be made below.

Figure 16:
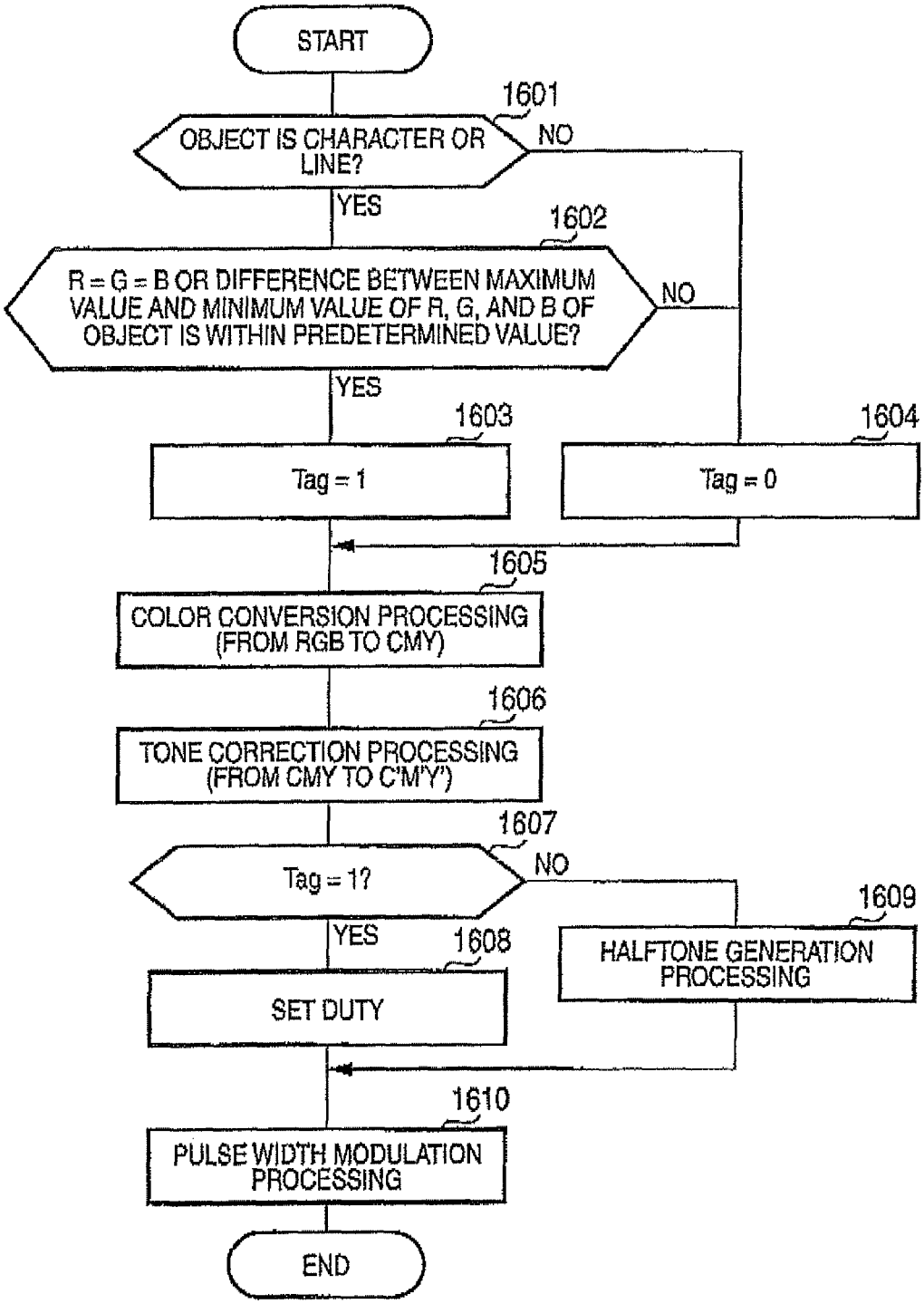
FIG. 16 is a flow chart illustrating the a of processing performed in the image forming apparatus according to the exemplary embodiment of the invention.

FIG. 16 is a flow char illustrating a flow of processing performed by the image forming apparatus according to the exemplary embodiment of the invention when the condition of "R, G and B of the object are equal in lightness to each other (lightness of R=lightness of G lightness of B) or a difference between maximum lightness and minimum lightness of R, G, and B of the object is within the predetermined value" is set.

Referring to FIG. 16, first, it is determined as to whether or not the classified object is a character object or a line object (1601). If the classified object is neither a character object nor a line object (NO in 1601), "0" is set as the tag information (1604). In addition, if the classified object is determined to be a character object or a line object (YES in 1601), it is then determined as to whether or not each object meets the condition regarding the color material control at the time of printout.

As the condition regarding the color material control at the time of printout, it is determined as to whether or not each object meets the condition that "values of R, G and B of the object are equal to each other (a value of R=a value of G=a value of B) or a difference between a maximum value and a minimum value of the values of R, G, and B of the object is within the predetermined value" (1602). When each object meets the condition (YES in 1602), "1" is set as the tag information (1603). In addition, if each object does not meet the condition (NO in 1602), "0" is sets as the tag information (1604).

After the tag information is set as described above, processing for color conversion from RGB colors to CMY colors is then performed (1605). Then, tone correction of the CMY colors after conversion is performed (1606). Then, it is determined as to whether or not "1" is set as the tag information of each object for which the tone correction is performed (1607). If "1" is set as the tag information (YES in 1607), the duty is set on the basis of the value set in advance or the setup information regarding the color material control included in the tag information (1608). For example, the duty is set to "70%".

In addition, if "0" is set as the tag information (NO in 1607), halftone generation processing is performed (1609).

After the duty is set, pulse width modulation processing is then performed on the basis of the set duty (1610). After the halftone generation processing is performed, pulse width modulation is performed on the print data in which the respective objects after halftone processing are mixed (1610).

The duty at this time is determined on the basis of the graphs shown in FIG. 17 or FIG. 18.

FIG. 17 is a graph illustrating the duty (%) relative to the density of each of CMY colors. The horizontal axis indicates the density of each of CMY colors, and the vertical axis indicates the value of the duty.

FIG. 17 shows that as the density of each of CMY colors increases, the duty decreases at a fixed rate. In addition, it is shown that the fixed rate increases in order of yellow, magenta, and cyan. That is, it is shown that as the density of each of CMY colors increase, the duty of magenta becomes smaller than that of cyan, and the duty of yellow becomes smaller than that of magenta.

FIG. 18 is another example of the graph illustrating the duty relative to the density of each of the CMY colors shown in FIG. 17, and shows that as the density increases, the duty of each of the CMY colors decreases at a fixed rate only in a specific range where the total toner amount (pile height) of CMY colors increases.

FIG. 18, up to the density at the point A, the normal duty (100%) is set for all of the CMY colors. However, for the density exceeding the point A, the duty is decreased at a fixed rate for each color. In addition, it is shown that the fixed rate increases in order of yellow, magenta, and cyan.

The duty is determined using these figures, thereby setting the duty used at the time of printout (1618).

Figure 19:
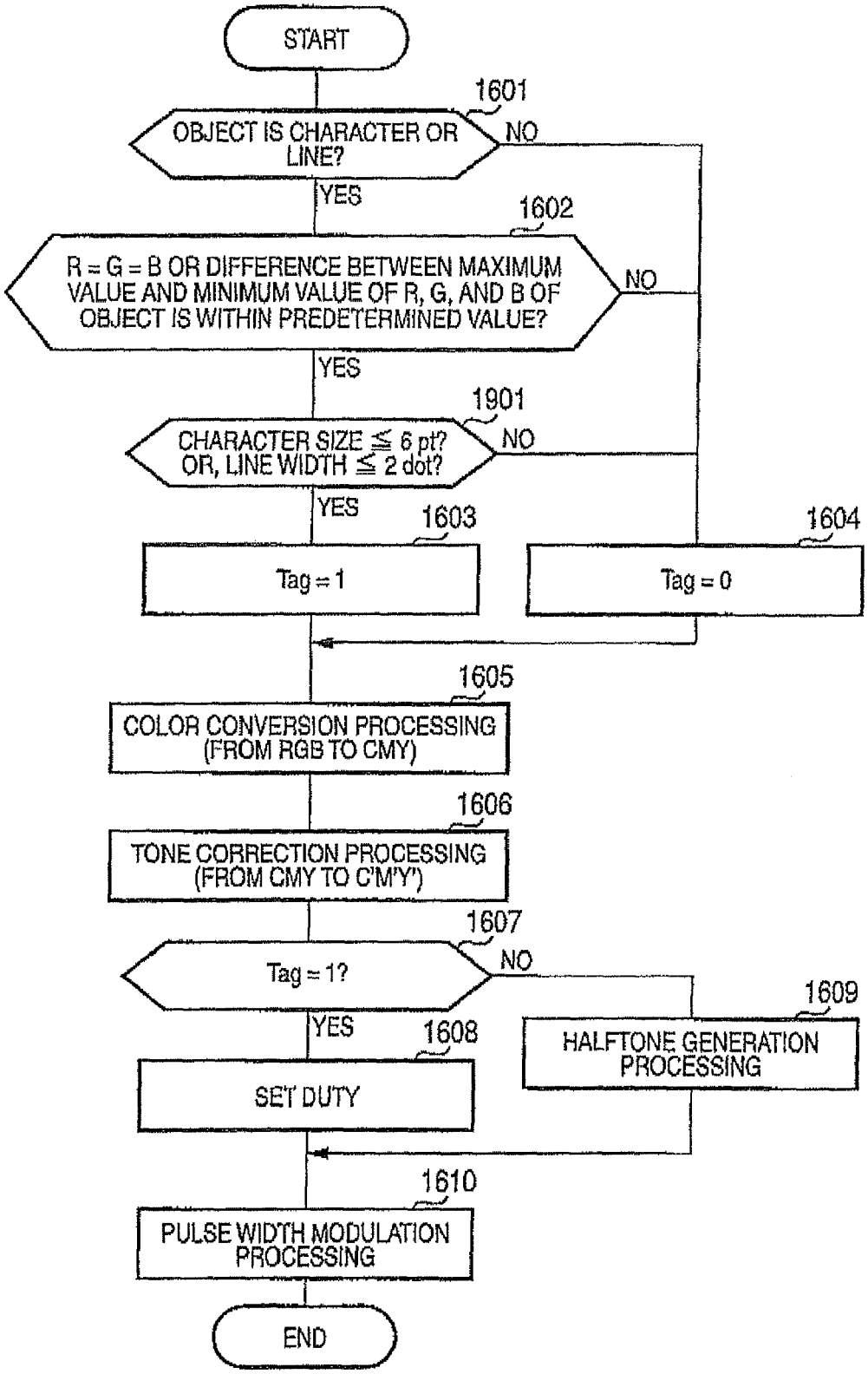
FIG. 19 is a flow chart illustrating a flow of processing performed in the image forming apparatus according to the exemplary embodiment of the invention.

FIG. 19 is a flow chart illustrating a flow of processing performed by the image forming apparatus according to the exemplary embodiment of the invention when the conditions of "R, G and B of the object are equal in lightness to each other (lightness of R=lightness of G=lightness of B) or a difference between maximum lightness and minimum lightness of R, G, and B of the object is within the predetermined value" and the condition that "a size of a character object is equal to or smaller than the predetermined character size or a line width of the fine object is equal to or smaller than the predetermined line width" are set.

Referring to FIG. 19, first, it is determined as to whether or not the classified object is a character object or a line object (1601). If the classified object is neither a character object nor a line object (NO in 1601), "0" is set as the tag information (1604). In addition, If the classified object is determined to be a character object or a line object (YES in 1601), it is then determined as to whether or not each object meets the condition regarding the color material control at the time of printout.

As the condition regarding the color material control at the time of printout, it is determined as to whether or not each object meets the condition that "values of R, C and B of the object are equal to each other (a value of R=a value of G=a value of B) or a difference between a maximum value and a minimum value of the values of R, Q and B of the object is within the predetermined value" (1602). If it meets the condition (YES in 1602), it is then determined as to whether or tot it meets the condition that "a size of character object is equal to or smaller than the predetermined character size or a line width of the line object is equal to or smaller than the predetermined line width" (1901).

If the character object is equal to or smaller than the predetermined character size or the line object is equal to or smaller than the predetermined line width (YES in 1901), "1" is set as the tag information (1603). In addition, if it meets neither the condition in the processing of 1602 nor the condition in the processing of 1901 (NO in 1602 and No in 1901), "0" is set as the tag information (1604).

After the tag information is set as described above, processing for color conversion from RGB colors to CMY colors is then performed (1605). Then, tone correction of the CMY colors after conversion is performed (1606). Then, it is determined as to whether or not "1" is set as the tag information of the object for which the tone correction is performed (1607). If "1" is set as the tag information (YES in 1607), the duty is set on the basis of the value set in advance or the setup information regarding the color material control included in the tag information (1608). In addition, if "0" is set as the tag information (NO in 1607), halftone generation processing is performed (1609).

After the duty is set, pulse width modulation processing is performed on the basis of the set duty (1610). After the halftone generation processing is performed, pulse width modulation is performed on the print data in which the respective objects after halftone processing are mixed (1610).

Figure 20:
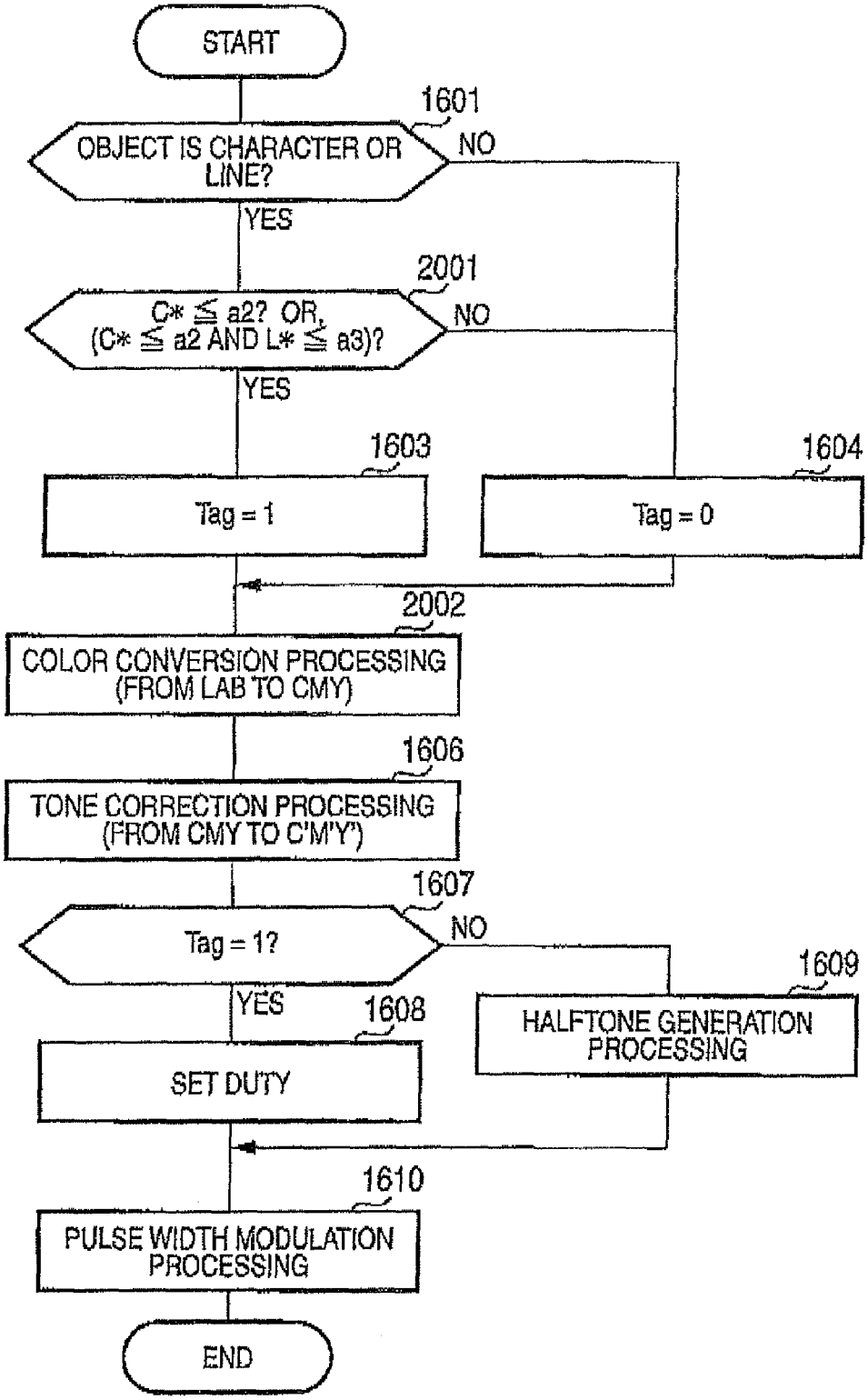
FIG. 20 is a flow chart illustrating a flow of processing performed in the image forming apparatus according to the exemplary embodiment of the invention.

FIG. 20 is a flow chart illustrating a flow of processing performed by the image forming apparatus according to the exemplary embodiment of the invention when the conditions that "saturation (C*) based on the saturation a* and the saturation b* in the CIE L*a*b* color space is within a fixed value and the lightness of L* is within a fixed value" are set.

Referring to FIG. 20; first, it is determined as to whether or not the classified object is a character object or a line object (1601). If the classified object is neither a character object nor a line object (NO in 1601), "0" is set as the tag information (1604). In addition, if the classified object is determined to be a character object or a line object (YES in 1601), it is then determined as to whether or not each object meets the condition regarding the color material control at the time of printout (2001).

As to the condition regarding the color material control at the time of printout, it is determined as to whether or not each object meets both of the condition that "saturation (C*) based on the saturation a* and the saturation b* in the CIE L*a*b color space is within the fixed value (e.g., a certain value "a2")" and the condition that "the lightness of L* is within the fixed value (e.g., a certain value "a3")" (2001). When it meets the both conditions (YES in 2001), "1" is set as the tag information (1603). When it does not meet any of the conditions (NO in 2001), "0" is set as the tag information (1604).

After the tag information is set as described above, processing for color conversion from the Lab space to CMY colors is then performed (2002). Then, tone correction of the CMY colors after conversion is performed (1606). Then, it is determined as to whether or not "1" is set as the tag information of the object for which the tone correction is performed (1607). If "1" is set as the tag information (YES in 1607), the duty is set on the basis of the value set in advance or the setup information regarding the color material control included in the tag information (1608). In addition, if "0" is set as the tag information (NO in 1607), halftone generation processing is performed (1609).

After the duty is set, pulse width modulation processing is then performed on the basis of the set duty (1610). After the halftone generation processing is performed, pulse width modulation is performed on the print data in which the respective objects after halftone processing are mixed (1610).

Figure 21:
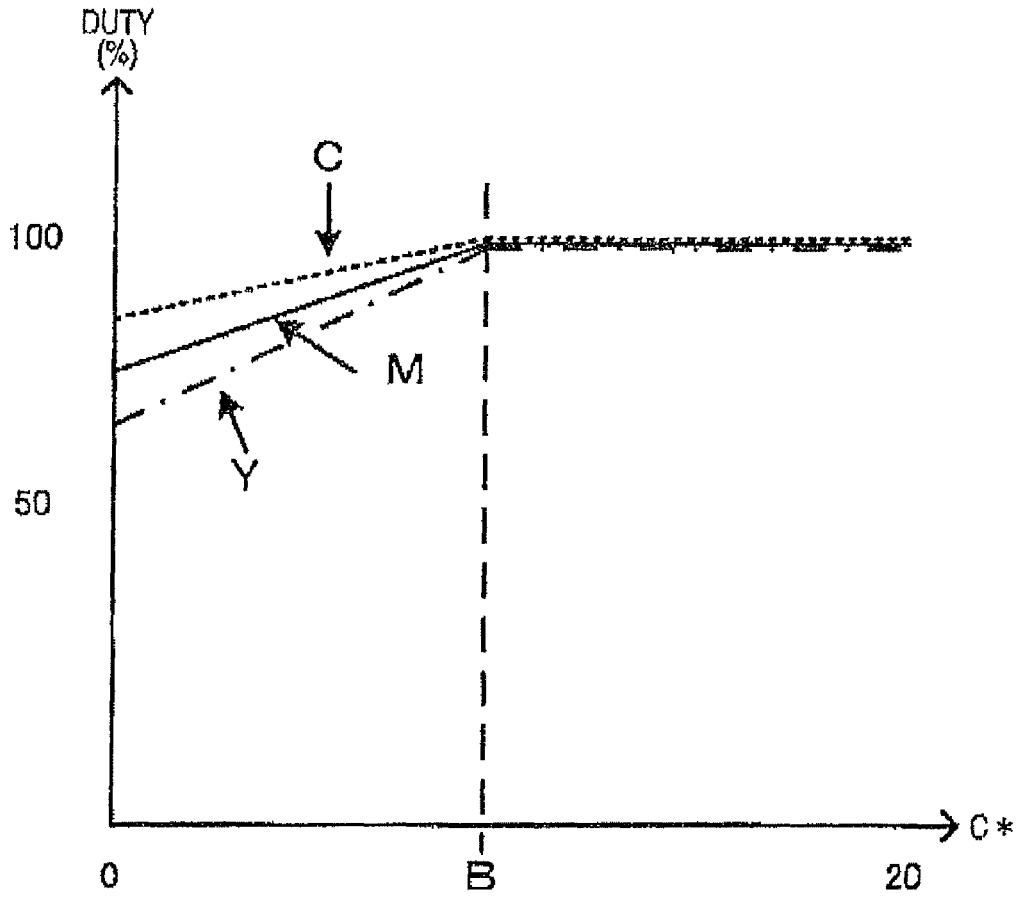
FIG. 21 is a graph illustrating the duty (%) relative to the saturation (C*) based on a saturation of a* and a saturation of b* in the CIE Lab color space.

FIG. 21 is a graph illustrating the duty (%) relative to the saturation (C*) based on the saturation a* and the saturation b* in the CIE Lab color space. The horizontal axis indicates the density of C*, and the vertical axis indicates the value of the duty.

The C* is a value calculated by the following expression.

$$C^*=\sqrt{a^{*2}+b^{*2}}$$

This indicates that the saturation increases as the value of C* increases. In FIG. 21, the duty is set to be smaller than the normal duty (100%) in a specific range where the value of C* is between "0" and the point B, and when the value of C* exceeds the value of the point B, the subsequent duty is set to the normal duty (100%). When the value of C* is between "0" and the point B, the duty is set to increase at a fixed rate for each of the CMY colors. The duty is set to 100% when the value of C* is at the point B. The rate of increase in the fixed rate is higher in order of yellow, magenta, and cyan.

The specific values in this case are shown in FIG. 22. Moreover, in FIG. 22, an example is shown in which the value of C* and the value of L* are used to determine the value of duty.

In FIG. 22, an L* column 2201, a c* column 2202, and a duty column 2203 are provided.

FIG. 22 shows that when L* indicated in the L* column 2201 is "35<L*≦40" and C* indicated in the C* column 2202 is "9<C*≦10", the duty indicated in the duty column 2203 is "100%". In addition, FIG. 22 shows that when L* indicated in the L* column 2201 is "L*≦10" and C* indicated in the C* column 2202 is "C*≦4", the duty indicated in the duty column 2203 is "70%".

Figure 23:
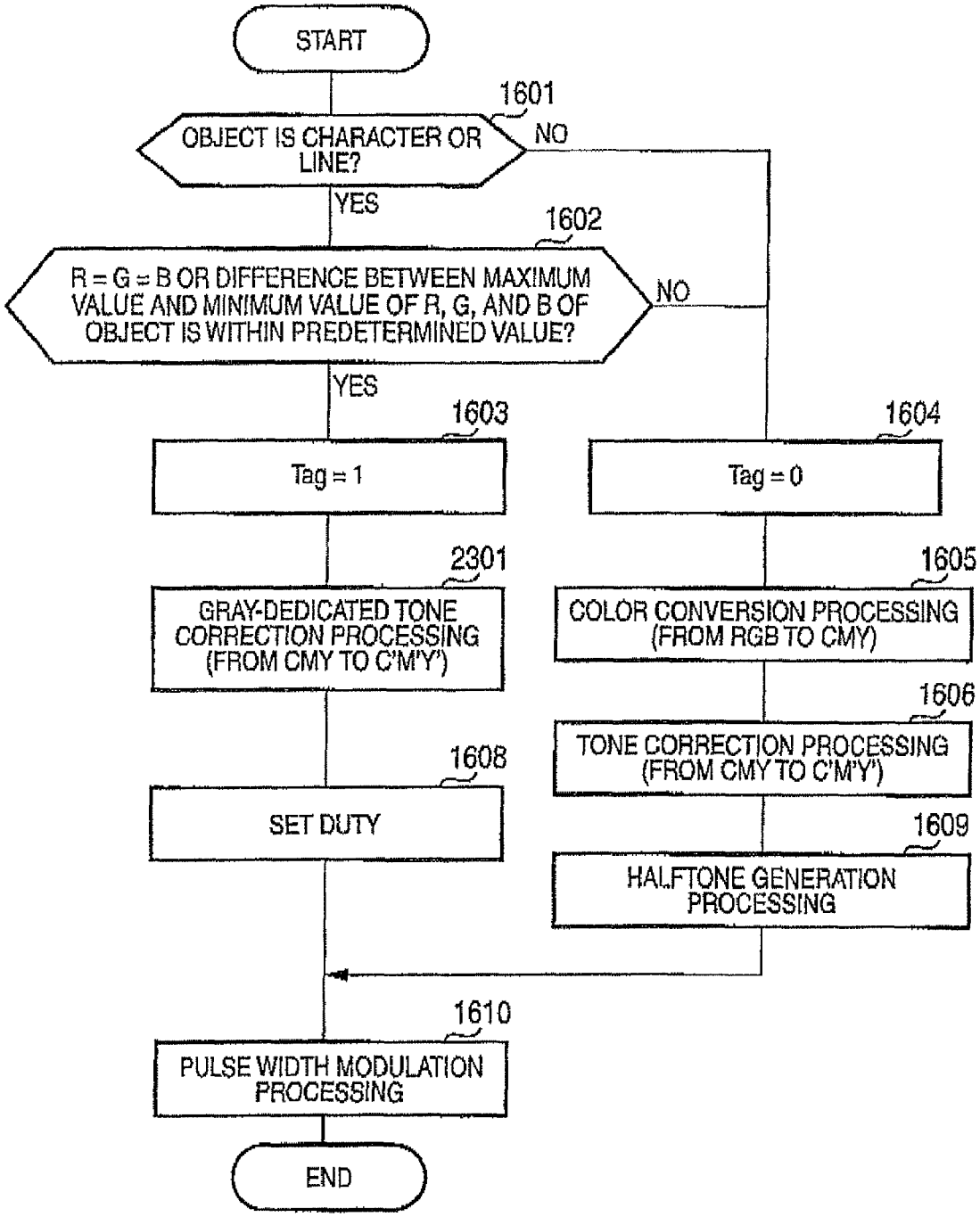
FIG. 23 is a flow chart illustrating a flow of processing performed in the image forming apparatus according to the exemplary embodiment of the invention.

FIG. 23 is a flow chart illustrating a flow of processing performed by the image forming apparatus according to the exemplar embodiment of the invention when the condition that "R, G and B of the object are equal in lightness to each other (lightness of R=lightness of G=lightness of B) or a difference between maximum lightness and minimum lightness of R, G, and B of the object is within the predetermined value" is set.

First, it is determined as to whether the classified object is a character object or a line object (1601). If the classified object is neither a character object nor a line objet (NO in 1601), "0" is set as the tag information (1604). In addition, if the classified object is determined to be a character object or a line object (YES in 1601), it is then determined as to whether or not each object meets the condition regarding the color material control at the time of printout.

As the condition regarding the color material control at the time of printout, it is determined as to whether or not each object meets the condition that "values of R, G and B of the object are equal to each other (a value of R=a value of G=a value of B) or a difference between a maximum value and a minimum value of the values of R, G, and B of the object is within the predetermined value" (1602). If it meets the condition (YES in 1602), "1" is set as the tag information (1603). In addition, if it does not meet the condition (NO in 1602), "0" is set as the tag information.

After "1" is set as the tag information as described above, tone correction is then performed using the gray-dedicated tone correction table (2301). An example of the gray-dedicated tone correction table is shown in FIG. 24.

After the tone correction is performed using the gray-dedicated tone correction table, the duty is set on the basis of the value set in advance or the setup information regarding the color material control included in the tag information (1608). For example, the duty is set to "70%".

After the duty is set as described above, pulse width modulation processing is performed on the basis of the set duty (1610).

In addition, if "0" is set as the tag information, processing for color conversion from RGB colors to CMY colors is then performed (1605). Then, tone correction of the CMY colors after conversion is performed (1606). Then, halftone generation processing is performed on the object for which the tone correction processing was performed (1609).

After performing the halftone generation processing, pulse width modulation is performed on the print data in which the respective objects after halftone processing are mixed (1610).

FIG. 24 is a view illustrating an example of the gray-dedicated tone correction table, and shows the mixing ratio of CMY color when the respective colors of the RGB color are expressed by the same lightness and the RGB color is reproduced as black.

For example, when RGB are all "0" cyan is set to "80%", magenta is set to "75%", and yellow is set to "60%". Moreover, when ROD are all "2", cyan is set to "70%", magenta is set to "65%", and yellow is set to "50%".

Figure 25D:
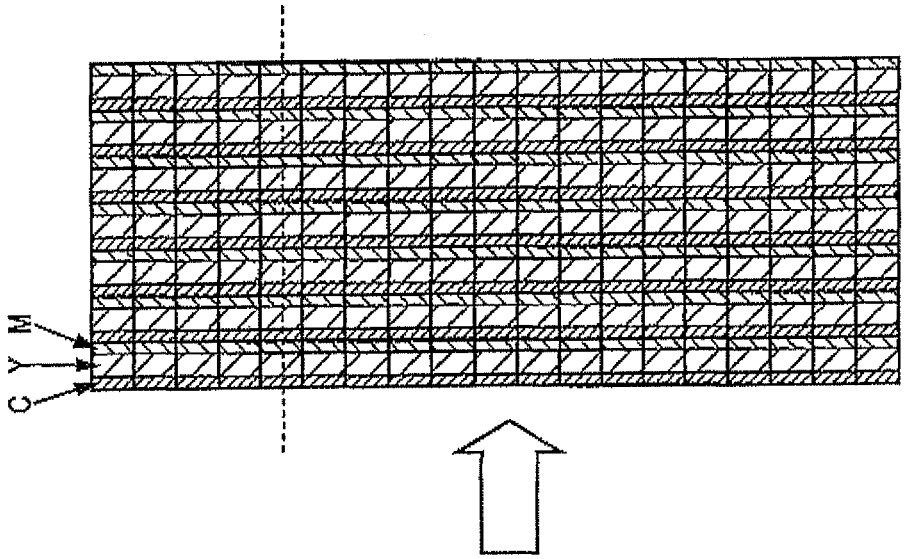
FIGS. 25A to 25D are views illustrating printout states based on a set duty.
Figure 25C:
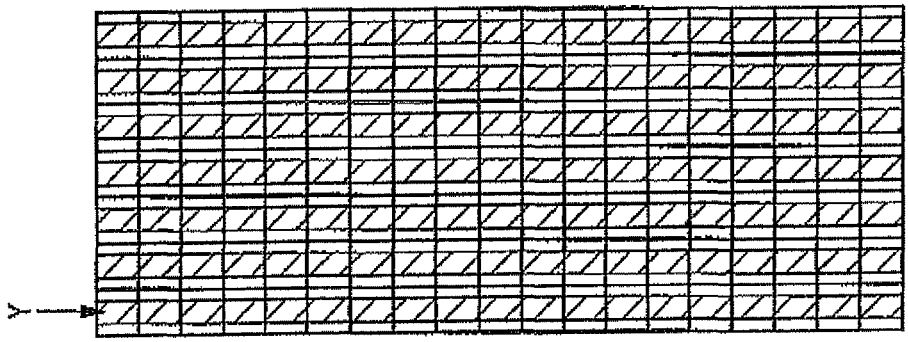
Figure 25B:
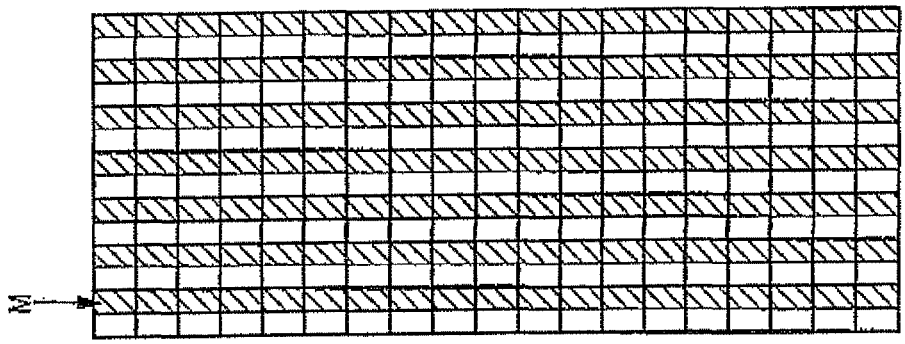
Figure 25A:
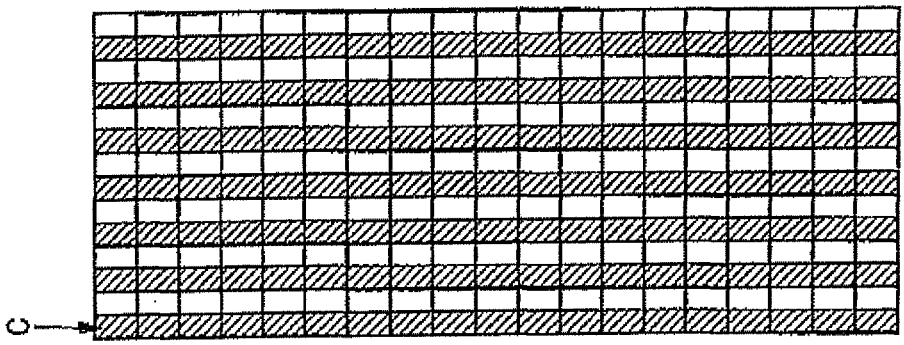
Figure 26:
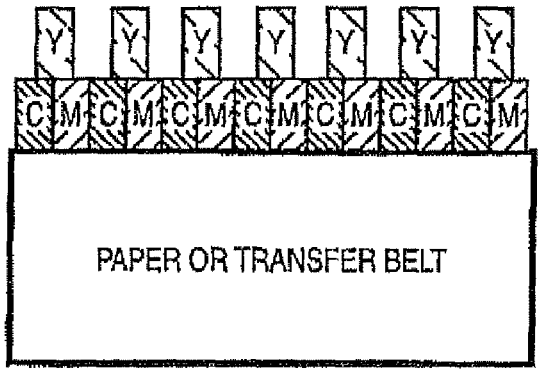
FIG. 26 is a view illustrating the printout state based on the set duty.

The printout states based on the duty of FIGS. 16 to 24 are shown in FIGS. 25A to 26.

FIGS. 25A to 25D show print states where the tag information is "1", the duty is "50%" and different print patterns are used for the respective colors of CMY in terms of pixel.

FIG. 25A shows a print state of cyan, in which the left half of each pixel is colored. FIG. 25B shows a print state of magentas in which the right half of each pixel is colored. FIG. 25C shows a print state of yellow in which quarters of each pixel on the left and right sides of the center of each pixel are colored.

FIG. 25D is a view illustrating a state obtained by overlapping FIGS. 25A to 25C, and shows the state where FIGS. 25A to 25C overlap in order of FIG. 25A, FIG. 25B, and FIG. 25C.

That is, in each pixel unit, a color on a lower side can be seen if it does not overlap a color on an upper side. Cyan of FIG. 25A can be seen for portions where it does not overlap magenta of FIG. 25B and yellow of FIG. 25C.

The overlapping state at this time is shown in FIG. 26.

FIG. 26 shows the state where each of cyan and magenta is printed with the duty of "50%" in each pixel unit and yellow is printed thereon.

Figure 27:
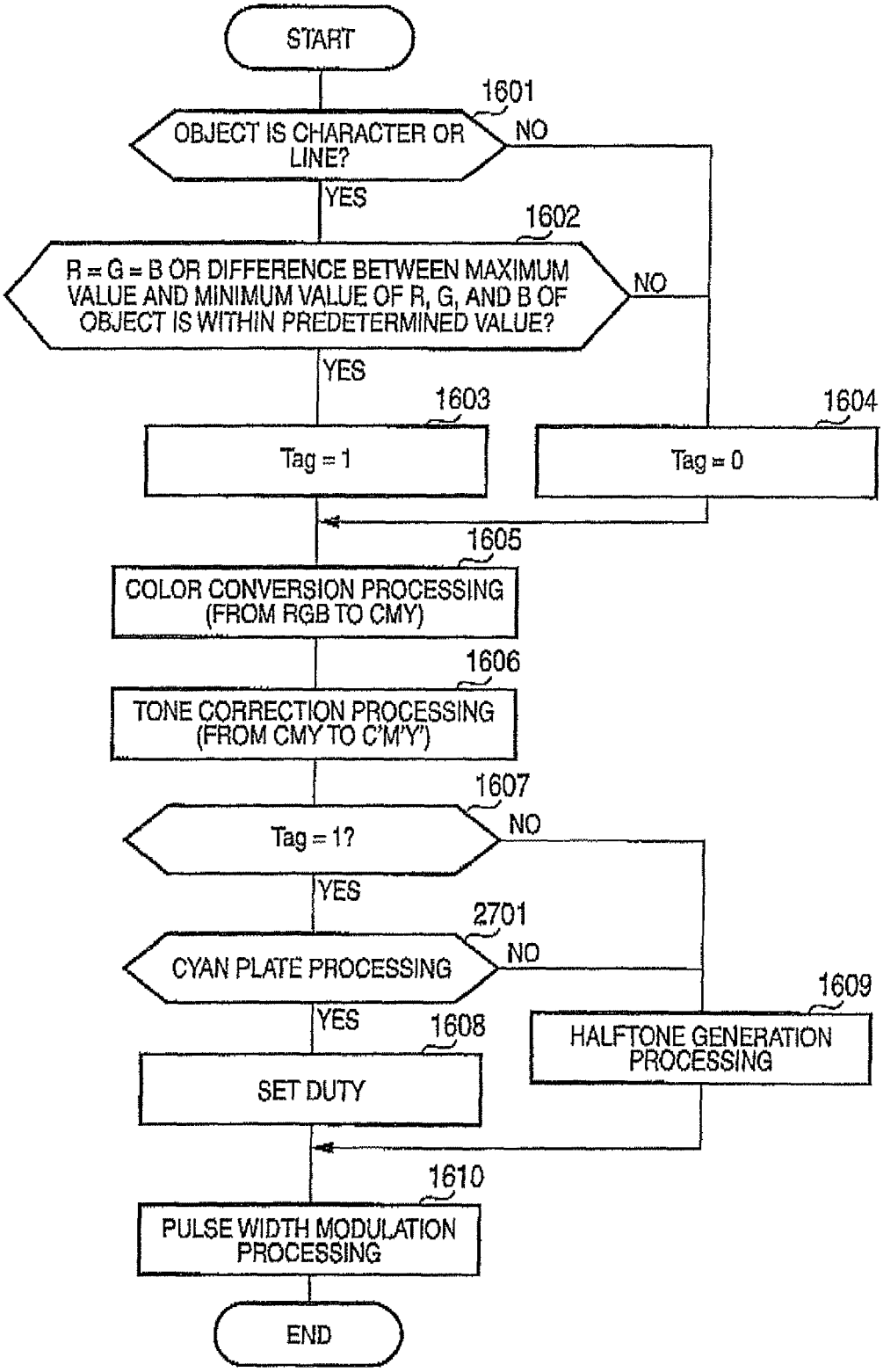
FIG. 27 is a flow chart illustrating a flow of processing performed in the image forming apparatus according to the exemplary embodiment of the invention.

FIG. 27 is a flow chart illustrating a flow of processing performed by the image forming apparatus according to the exemplary embodiment of the invention when the condition that "R, G and B of the object are equal in lightness to each other (lightness of R=lightness of G=lightness of B) or a difference between maximum lightness and minimum lightness of R, Q and B of the object is within the predetermined value" is set.

Referring to FIG. 27, first, it is determined as to whether the classified object is a character object or a line object (1601). If the classified object is neither a character object nor a line object (NO in 1601), "0" is set as the tag information (1604). In addition, if the classified object is determined to be a character object or a line object (YES in 1601), it is then determined as to whether or not each object meets the condition regarding the color material control at the time of printout.

As the condition regarding the color material control at the time of printout, it is determined as to whether or not each object meets the condition that "values of R, G and B of the object are equal to each other (a value of R=a value of G=a value of B) or a difference between a maximum value and a minimum value of the values of R, G and B of the object is within the predetermined value" (1602). If it meets the condition (YES in 1602), "1" is set as the tag information (1603). In addition, if it does not meet the condition (NO in 1602), "0" is set as the tag information.

After the tag information is set as described above, processing for color conversion from RGB colors to CMY colors is then performed (1605). Then, tone correction of the CMY colors after conversion is performed (1606). Then, it is determined as to whether or not "1" is set as the tag information of the object for which tone correction processing was performed (1607). If "1" is set as the tag information (YES in 1607), subsequent processing is changed according to a color plate.

For example, in the case of plate processing using cyan (YES in 2701), the duty is set on the basis of the value set in advance or the setup information regarding the color material control included in the tag information (1608).

In cases of magenta and yellow other than cyan (NO in 2701), halftone generation processing is performed (1609) in the same manner as the case where "0" is set as the tag information (NO in 1607).

After the duty is set, pulse width modulation processing is then performed on the basis of the set duty (1610). After the halftone generation processing is performed, pulse width modulation is performed on the print data in which the respective objects after halftone processing are mixed (1610).

Figure 28:
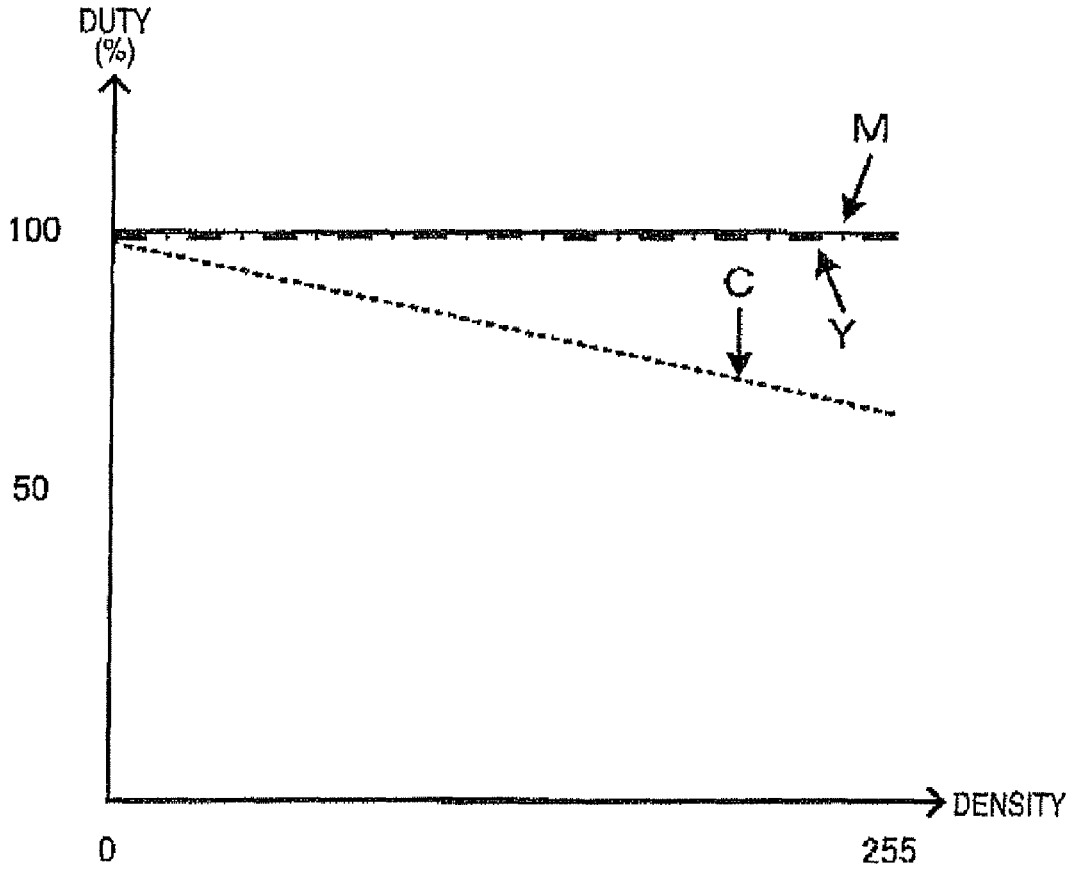
FIG. 28 is a graph illustrating the duty relative to the density of each of CMY colors.

FIG. 28 is a graph illustrating the duty relative to the density of each of CMY colors. The horizontal axis indicates the density of each of CMY colors, and the vertical axis indicates the value of the duty (%).

FIG. 28 shows that as the density of each of CMY colors increases, the duty of the designated color material (cyan in the example show in FIG. 27) decreases at a fixed rate. For the other color materials (magenta and yellow in the example shown in FIG. 27), the normal duty (100%) is set.

Figure 29:
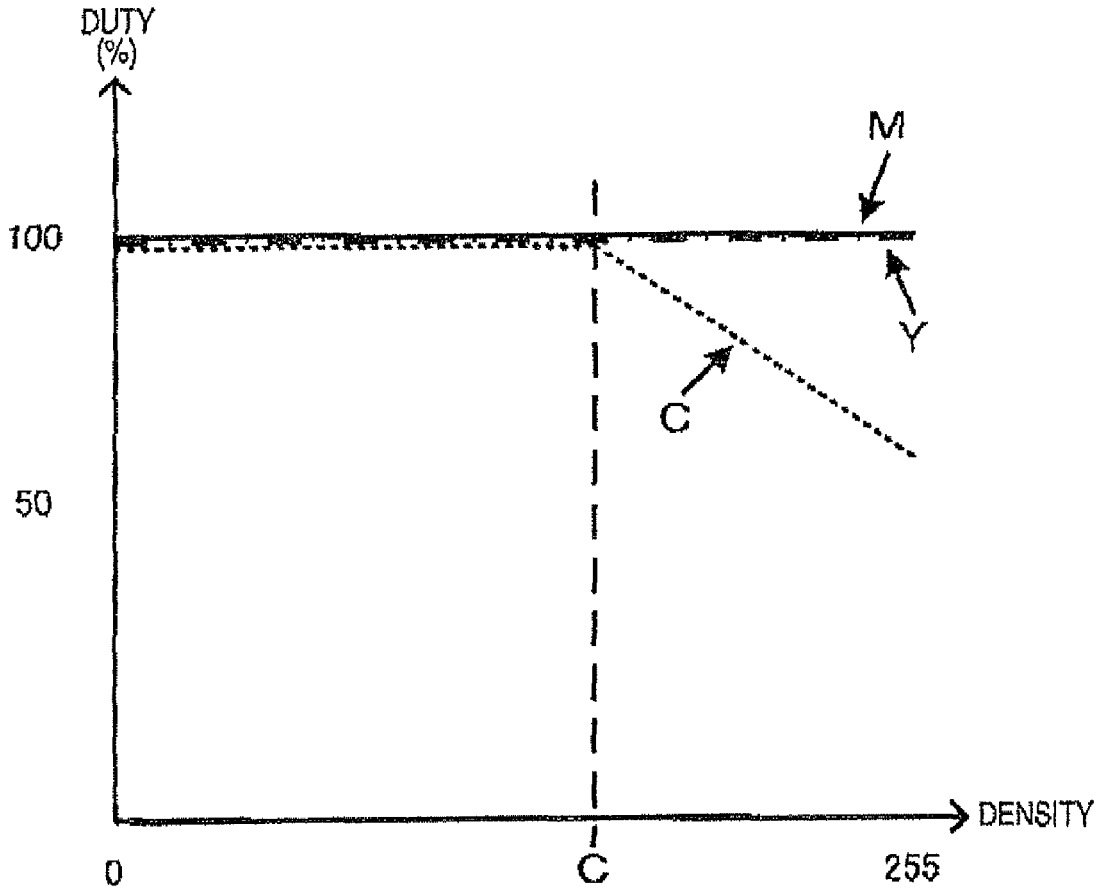
FIG. 29 is another example of the graph illustrating the duty relative to the density of each of the CMY colors shown in FIG. 28.

FIG. 29 is another example of the graph illustrating the duty relative to the density of each of the CMY colors, and shows that the duty only for cyan is made small when a density is larger than the point C, at which the tot toner amount (pile height) of CMY colors is high. FIG. 29 shows that when the density becomes larger than that at the point C, the duty of the cyan is decreased at a fixed rate.

Figure 30D:
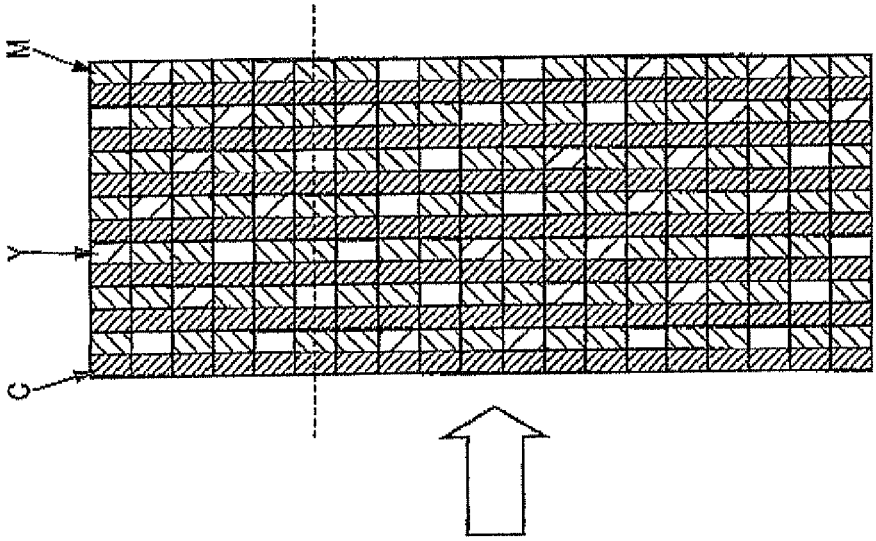
FIGS. 30A to 30D are views illustrating printout states.
Figure 30C:
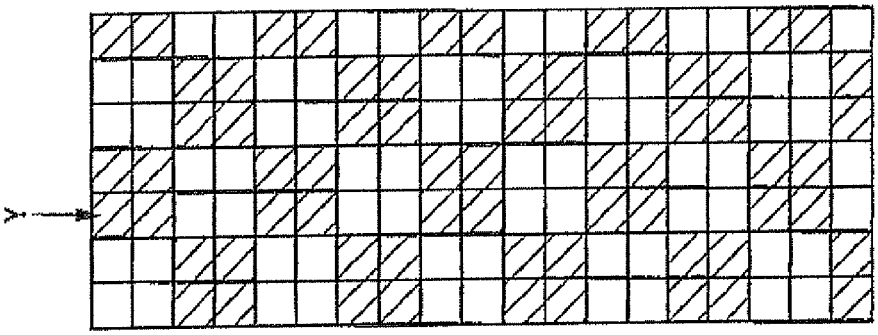
Figure 30B:
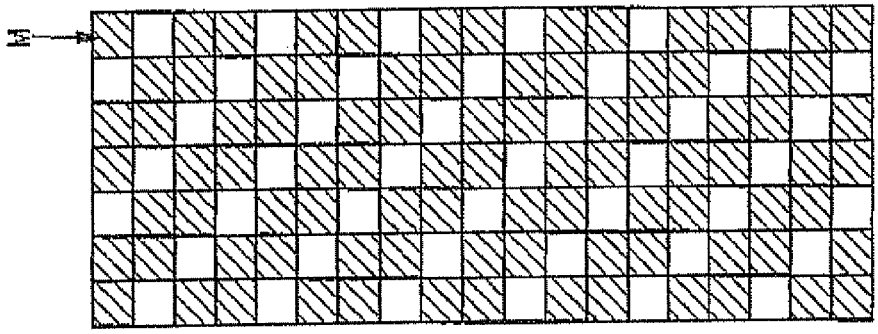
Figure 30A:
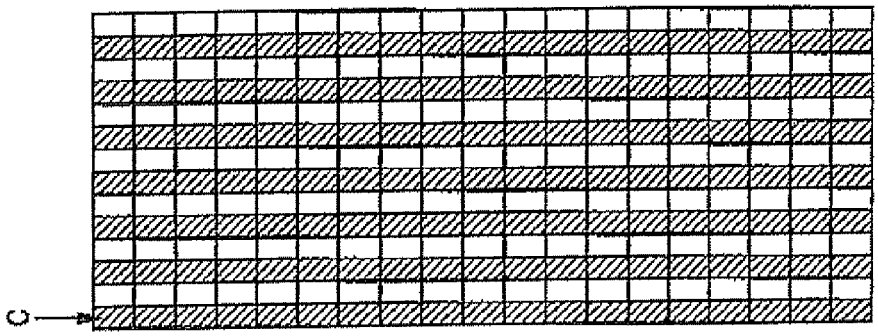
Figure 31:
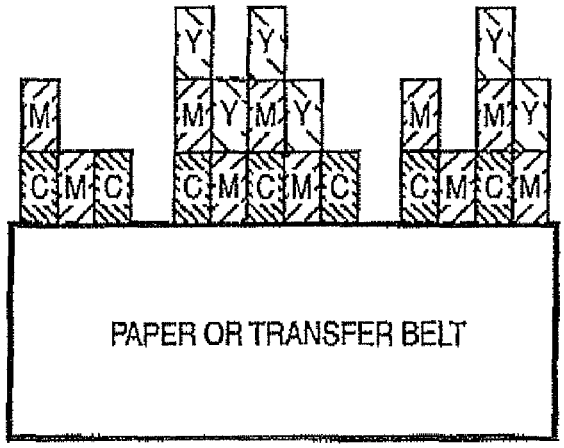
FIG. 31 is a view illustrating the printout state.

The print states at this time are shown in FIGS. 30A to 31.

FIG. 30A shows a state where the duty is set to 50% only for cyan and pulse width modulation processing based on setting of the duty is not performed for magenta shown in FIG. 30B and yellow shown in FIG. 30C.

The state where FIGS. 30A to 30C overlap in this order is shown in FIG. 30D.

FIG. 31 is a view illustrating the overlapping state of the print states shown in FIGS. 30A to 30C, and shows the state where cyan, magenta, and yellow overlap.

Figure 32:
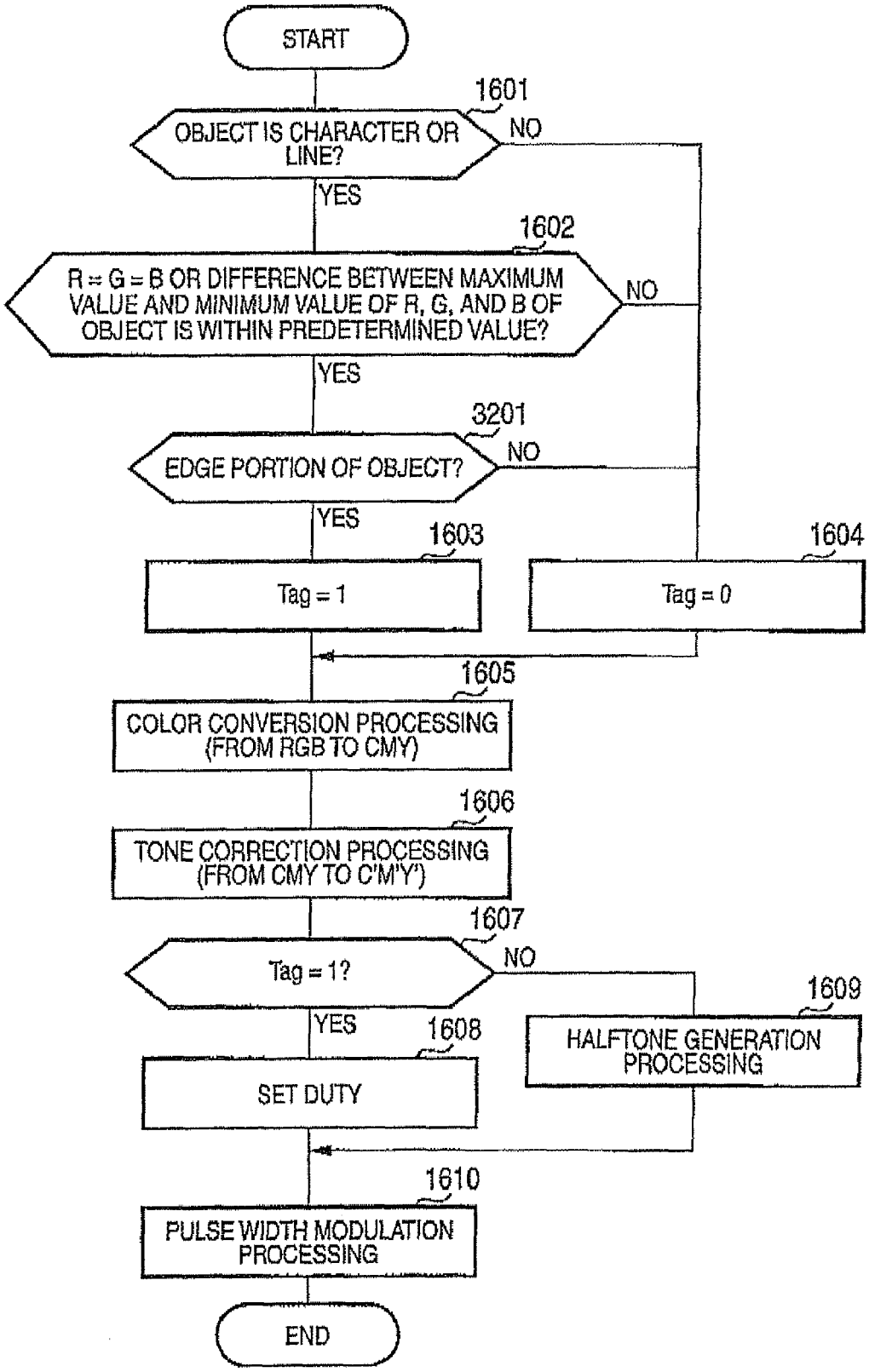
FIG. 32 is a flow chart illustrating a flow of processing performed in the image forming apparatus according to the exemplary embodiment of the invention.

FIG. 32 is a flow chart illustrating the flow of processing performed by the image forming apparatus according to the exemplary embodiment of the invention when the condition that "R, G and B of the object are equal in lightness to each other (lightness of R=lightness of G=lightness of B) or a difference between maximum lightness and minimum lightness of R, G and B of the object is within the predetermined value" and the condition of "extraction of an edge portion of the object" are set.

Referring to FIG. 32, first, it is determined as to whether the classified object is a character object or a line object (1601). If the classified object is neither a character object nor a line object (NO in 1601), "0" is set as the tag information (1604). In addition, if the classified object is determined to be a character object or a line object (YES in 1601), it is then determined as to whether or not each object meets the condition regarding the color material control at the time of printout.

As the condition regarding the color material control at the time of printout, it is first determined whether or not each object meets the condition that "values of R, G and B of the object are equal to each other (a value of R=a value of G=a value of B) or a difference between a maximum value and a minimum value of the values of R, G, and B of the object is within the predetermined value" (1602). If it does not meet the condition (NO in 1602), "0" is set as the tag information. Moreover, If it meets the condition (YES in 1602), it is then determined as to whether or not it meets the condition of "extraction of an edge portion of the object" (3201).

If it meets the condition of "extraction of an edge portion of the object" (YES in 3201), "1" is set as the tag information (1603). In addition, if it does not meet (NO in 3201), "0" is set as the tag information.

After the tag information is set as described above, processing for color conversion from RGB colors to CMY colors is then performed (1605). Then, tone correction of the CMY colors after conversion is performed (1606). Then, it is determined as to whether or not "1" is set as the tag information of the object for which the tone correction is performed (1607). If "1" is set as the tag information (YES in 1607), the duty is set on the basis of the value set in advance or the setup information regarding the color material control included in the tag information (1608). For example, the duty is set to "70%".

In addition, if "0" is set as the tag information (NO in 1607), halftone generation processing is performed (1609).

After the duty is set, pulse width modulation processing is then performed for the edge portion of the object on the basis of the set duty (1610). After the halftone generation processing is performed, pulse width modulation is performed on the print data in which the respective objects after halftone processing are mixed (1610).

FIGS. 33A to 33D show the states where the duty is set to "50%" only for the edge portions.

Figures 33A, 33B, 33C, 33D:
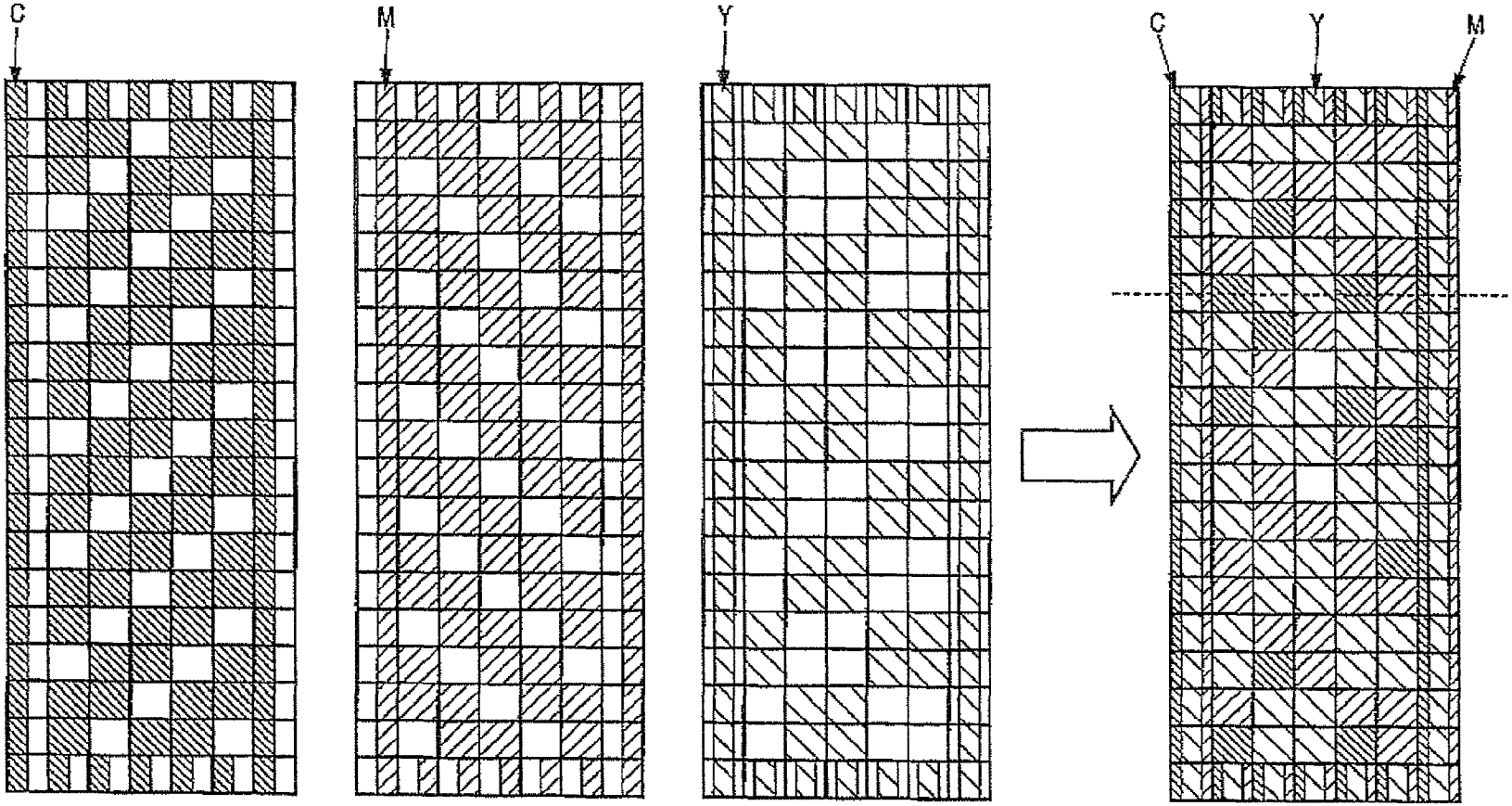
FIGS. 33A to 33D are views illustrating a states where the duty is set to 50% only for an edge portion and printout is performed.

FIG. 33A shows a print state of cyan in which a left half of each pixel is colored in the edge portions. FIG. 33B shows a print state of magenta in which a right half of each pixel is colored in the edge portions. FIG. 33C shows a print state of yellow in which quarters of each pixel on the left and right sides of the center of each pixel are colored.

FIG. 33D is a view illustrating the state obtained by overlapping of FIGS. 33A to 33C, and shows the state where FIGS. 33A to 33C overlap in order of FIG. 33A, FIG. 33B, and FIG. 33C.

That is, in each pixel unit, a color on a lower side can be seen in a portion where it does not overlap a color on an upper side.

Figure 34:
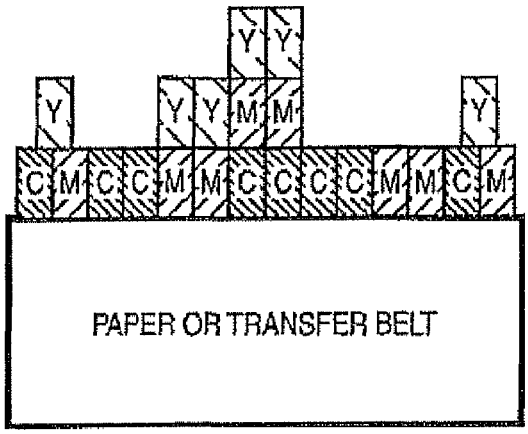
FIG. 34 is a view illustrating the state where the duty is set to 50% for pixels of the edge portion and the printout is performed.

The overlapping state at this time is shown in FIG. 34.

FIG. 34 shows the state where the duty is set to 50% for the pixel of the edge portion and the printout is performed.

Third Exemplary Embodiment

Figure 35:
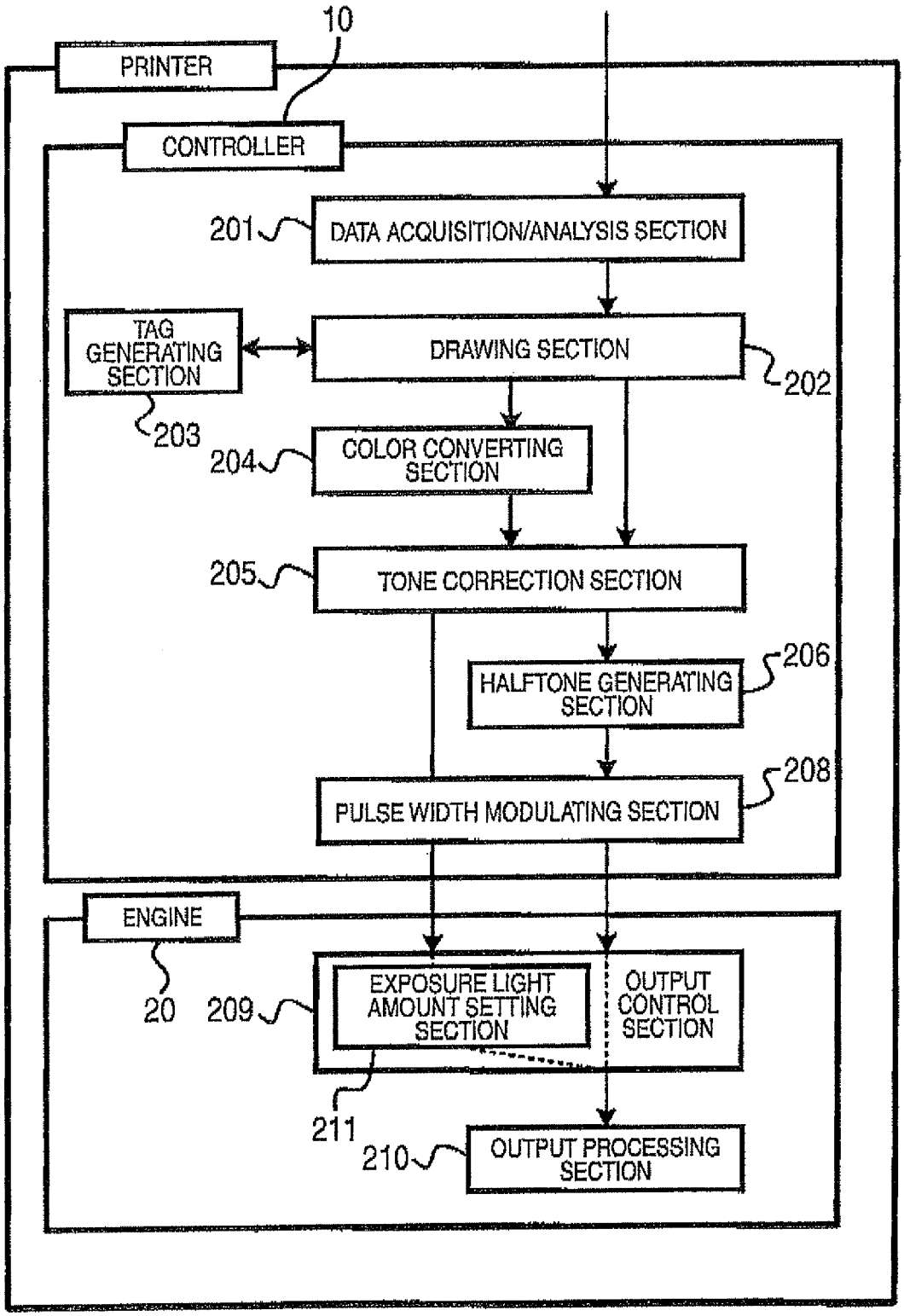
FIG. 35 is a block diagram illustrating the configuration of an image forming apparatus according to still another exemplary embodiment of the invention.

FIG. 35 is a block diagram illustrating the configuration of an image forming apparatus according to still another exemplary embodiment of the invention.

Referring to FIG. 35, a printer which is an example of the image forming apparatus includes a controller 10 and an engine 20. The controller 10 is configured to include a data acquisition/analysis section 201, a drawing section 202, a tag generating section 203, a color converting section 204, a tone correction section 205, a halftone generating section 206, and a pulse width modulating section 208. The engine 20 is configured to further include an output control section 209 and an output processing section 210.

The data acquisition/analysis section 201 acquires print data requested to be printed and transmits it to the drawing section 202. The print data requested to be printed at this time is formed by color information of red (F), green (G), and blue (B) (hereinafter, they may be collectively referred to as "RGB colors").

The drawing section 202 classifies the print data received from the data acquisition/analysis section 201 into objects, which are components of the print data, and identifies each object after the classification. Examples of the objects that form the print data at this time include character objects, line objects, and image objects.

The character object is an object formed of characters. The line object is an object formed of figure and graphic which are drawings. The image object is an object formed of an image, such as a photograph.

After the objects are classified by the drawing section 202 and each of the objects is identified, information of the objects which form the print data is transmitted to the tag generating section 203.

When the information of the object received from the drawing section 202 is the character object or the line object, the tag generating section 203 determines as to whether or not it meets the condition regarding the color material control at the time of printout designated beforehand. If it is determined that the character object or line object meets the condition regarding the color material control, tag information is generated based on the condition regarding the color material control of the character object or line object.

For example, the condition regarding the color material control at the time of printout includes a condition that "R, G and B of the object are equal in lightness to each other (lightness of R=lightness of G=lightness of B) or a difference between maximum lightness and minimum lightness of R, G and B of the object is within the predetermined value" and/or a condition that "a size of a character object is equal to or smaller than a predetermined character size of a line width of the line object is equal to or smaller than a predetermined line width". The condition regarding the color material control at the time of printout is a condition used to determine as to whether to control an amount of used color materials, a rate of used color materials, and the like at the time of printout.

The tag information includes information indicating whether or not a corresponding object meets the condition regarding the color material control at the time of printout. "1" is set as the tag information when a corresponding object meets the condition regarding the color material control, and "0" is set as the tag information when a corresponding object does not meet the condition.

Moreover, when the image object is classified and identified by the drawing section 202, tag information in which "0" is set is generated as the tag information of the object.

After the tag generating section 203 generates the tag information of each object as described above the drawing section 202 receives the tag information from the tag generating section 203. At this time, the drawing section 202 transmits the tag information and each object to the color converting section 204 to request color conversion processing.

The color converting section 204 performs color conversion processing for each received object. An example of the color conversion processing includes processing of converting color information based on RGB colors of print data requested to be printed into color information based on cyan (C), magenta (M), and yellow (Y) (hereinafter, they may be collectively referred to as "CMY colors") used at the time of printout.

In addition to this, there is also processing for color conversion of the color coordinate value of L*a*b* in the CIE L*a*b* color space into CMY colors. In addition, L* in the CIE Lab color space indicates a lightness of color, a* indicates a saturation in the axial space of red and green, and b* indicates a saturation in the axial space of yellow and blue. Hereinafter; the color coordinates of L*a*b* may be simply expressed as "Lab".

After the color converting section 204 performs the color conversion processing into the CMY colors on the basis of the color information of the original object, the color converting section 204 transmits the object for which the color conversion is performed and the tag information to the tone correction section 205.

The tone correction section 205 performs tone correction on the basis of the convened CMY colors after the color conversion in the color converting section 204. In addition, the tone correction section 205 determines as to whether the tag information generated by the tag generating section 203 is "0" or "1" and also determines as to whether or not it is designated to perform the same processing, as that in the case where the tag information is determined to be "1", only for a certain specific color (cyan, magenta, and yellow).

If the tag information is "1", the tone correction section 205 transmits the object to the output control section 209 of the engine 20. If the tag information is "0", the tone correction section 205 transmits each object and the tag information to the halftone generating section 206.

The output control section 209 of the engine 20 to which the object is transmitted when the tag information was "1" performs output control on the basis of the predetermined amount of exposure light that is designated in advance, using an exposure light amount setting section 211. The amount of exposure light is an amount indicating an intensity of irradiation from a laser or an LED in the exposure processing.

Then, the halftone generating section 206, to which each object and the tag information are transmitted when the tag information is "0", performs processing for generating a halftone (also referred to as a "dot image") expressing shade. After the processing is performed by the halftone generating section 206, the object is transmitted to the pulse width modulating section 208. The pulse width modulating section 208 performs processing for modulating the pulse width for the print data formed by the object.

After the pulse width modulation processing is performed by the pulse width modulating section 208, the print data is transmitted to the engine 20.

In the above-described processing, the object and the tag information transmitted from the drawing section 202 is received in the color converting section 204. However, the invention is not limited to such a configuration. When the tone correction section 205 is set to perform tone correction dedicated to the gray color in the case where "R, G and B of the object are equal in lightness to each other (lightness of R=lightness of G=lightness of B) or a difference between maximum lightness and minimum lightness of R, G, and B of the object is within the predetermined value", the drawing section 202 may identity that the tag information generated by the tag generating section 203 is "1" so that the object and the tag information are transmitted to the tone correction section 205 instead of the color converting section 204.

Then, the output control section 209 of the engine 20 receives the print data transmitted from the pulse width modulating section 208 and performs the output control based on the print data. Then, the output control section 209 transmits it to the output processing section 210, and the output processing section 210 performs printout processing.

Processing based on the condition which relates to the color material control at the time of printout and which is included in the tag information generated by the tag generating section 203 is shown in FIGS. 36 to 50, and the explanation will be made below.

Figure 36:
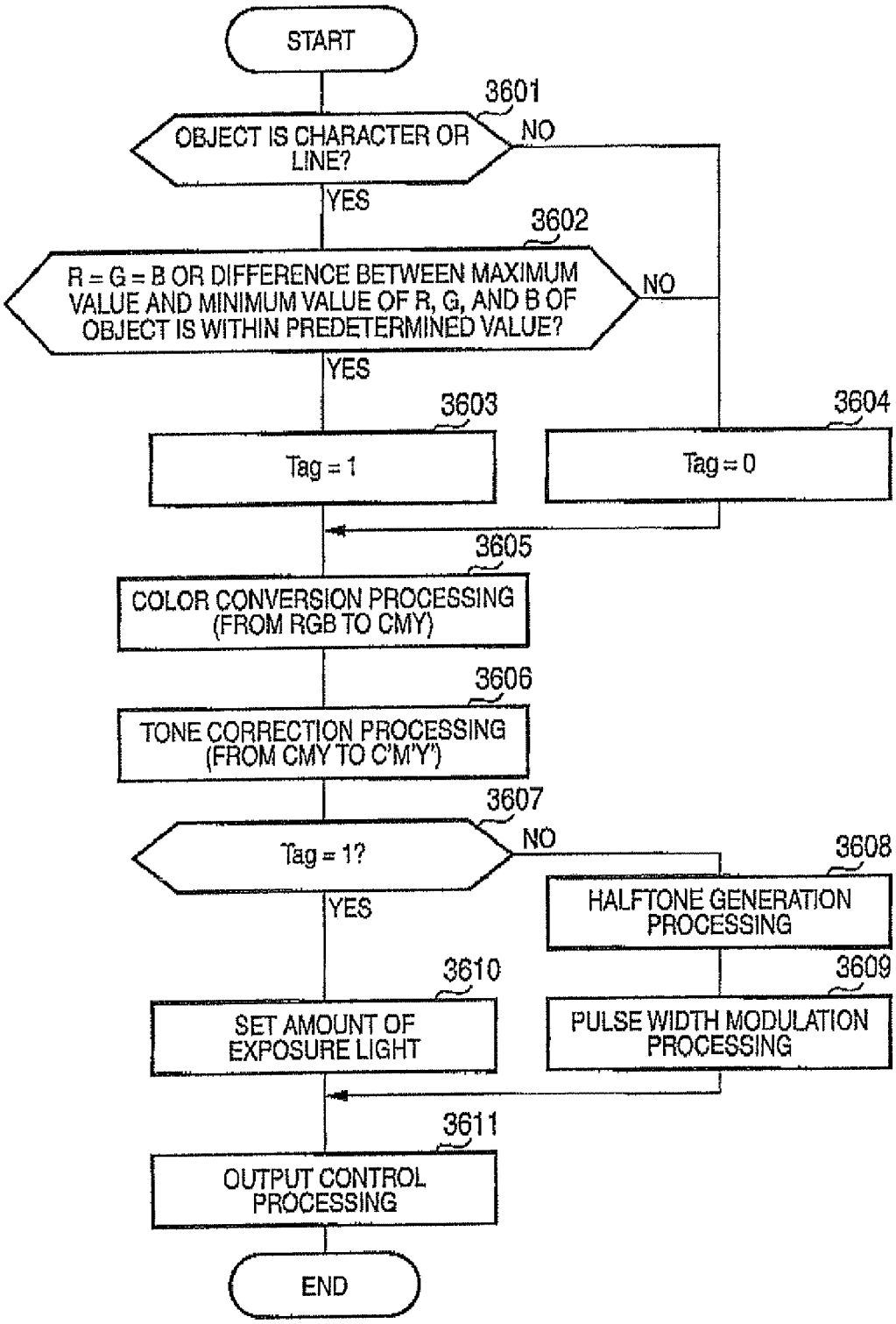
FIG. 36 is a flow chart illustrating a flow of processing performed in the image forming apparatus according to the exemplary embodiment of the invention.

FIG. 36 is a flow chart illustrating a flow of processing performed by the image forming apparatus according to the exemplary embodiment of the invention when the condition that "R, G and 13 of the object are equal in lightness to each other (lightness of R=lightness of G=lightness of B) or a difference between maximum lightness and minimum lightness of R, G, and B of the object is within the predetermined value" is set.

Referring to FIG. 36, first, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or not each object meets the condition regarding the color material control at the time of printout (3602).

As the condition regarding the color material control at the time of printout it is determined as to whether or not each object meets the condition that "values of R, G and B of the object are equal to each other (a value of R=a value of G=a value of B) or a difference between a maximum value and a minimum value of the values of R, G, and B of the object is within the predetermined value" (3602). If it meets the condition (YES in 3602), "1" is set as the tag information (3603). In addition, if it does not meet the condition (NO in 3602), "0" is sets as the tag information (3604).

After the tag information is set as described above, processing for color conversion from RGB colors to CMY colors is then performed (3605). Then, tone correction of the CMY colors after the conversion is performed (3606). Then, it is determined as to whether or not "1" is set as the tag information of the object for which tone correction processing was performed (3607). If "1" is set as the tag information (YES in 3607), an amount of exposure light is set (3610), and the output control processing is performed (3611).

Figure 42:
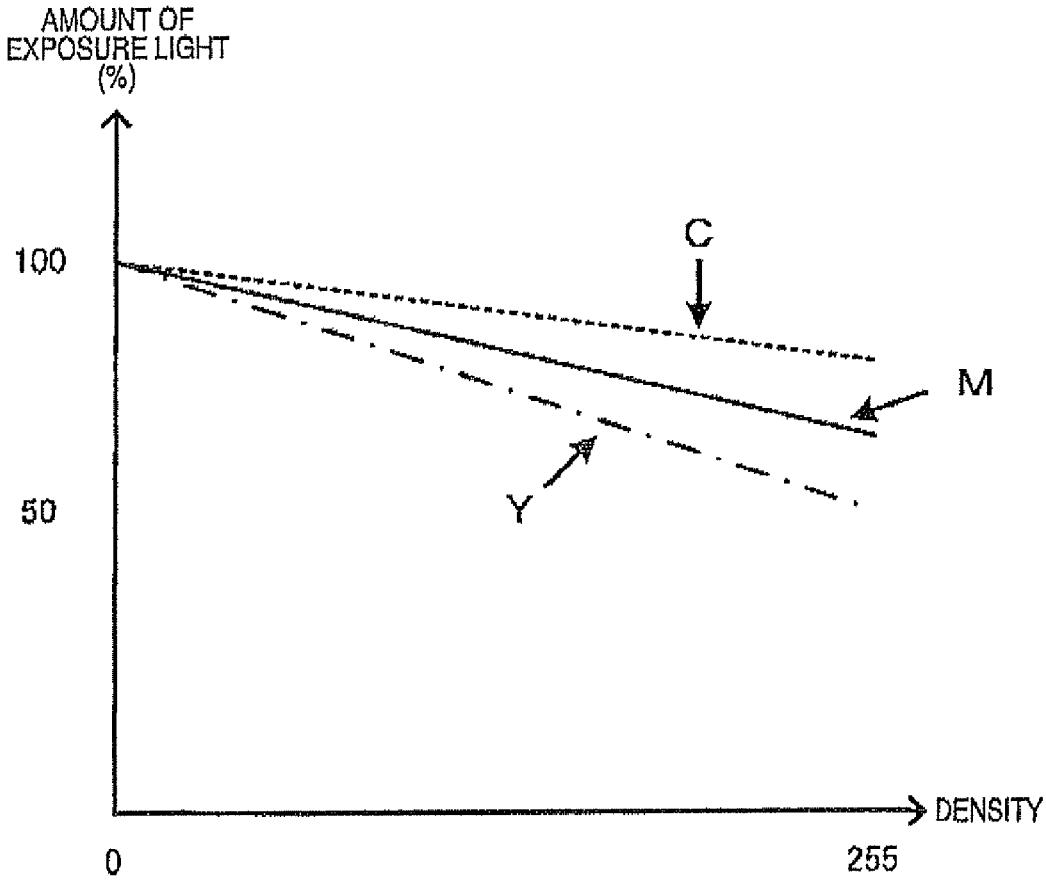
FIG. 42 is a graph illustrating an amount of exposure light (%) relative to the density of each of CMY colors.
Figure 43:
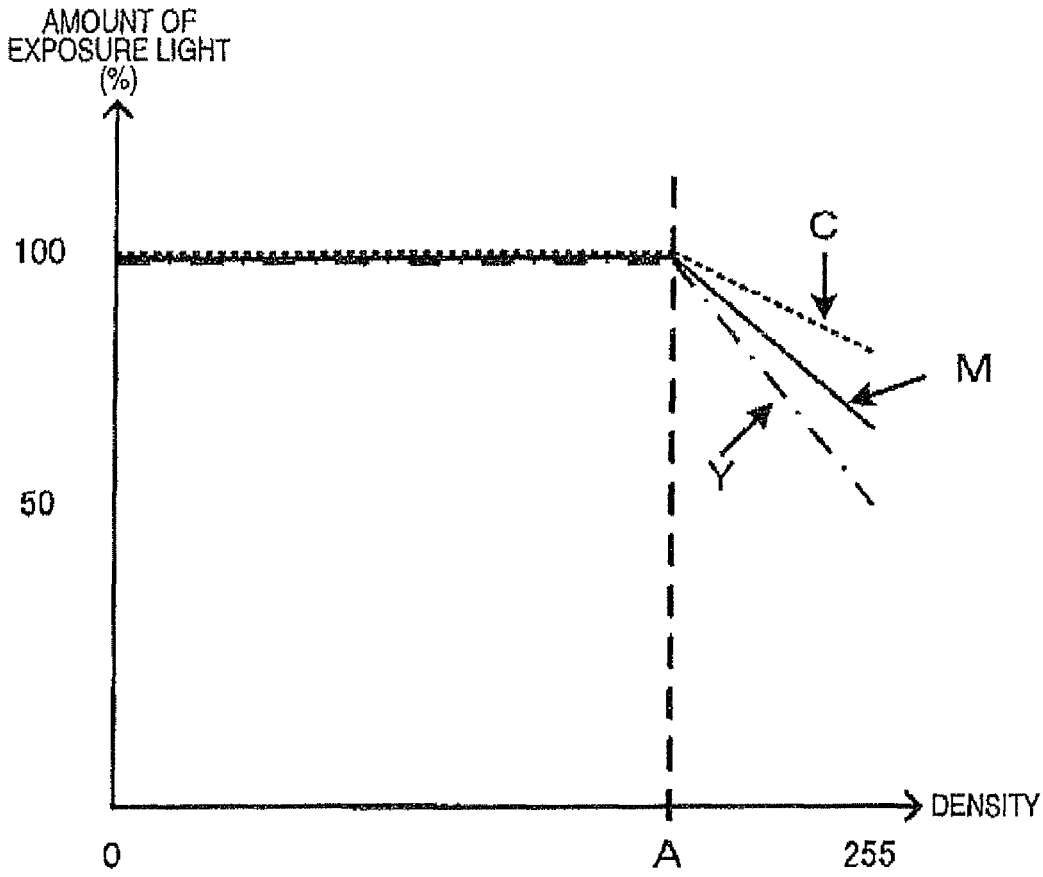
FIG. 43 is another example of a graph illustrating the amount of exposure light relative to the density of each of the CMY colors shown in FIG. 42.

The amount of exposure light at this time is determined on the basis of the graphs shown in FIGS. 42 and 43.

FIG. 42 is a graph illustrating the amount of exposure light (%) relative to the density of each of CMY colors. The horizontal axis indicates the density of each of CMY colors, and the vertical axis indicates the value of the amount of exposure light.

FIG. 42 shows that as the density of each of CMY colors increases, the amount of exposure light decreases at a fixed rate. In addition, it is shown that the fixed rate increases in order of yellow, magenta, and cyan. That is, it is shown that as the densities of CMY colors increase, the amount of exposure light of magenta becomes smaller than that of cyan, and the amount of exposure light of yellow becomes smaller than that of magenta.

FIG. 43 is another example of the graph illustrating the amount of exposure light relative to the density of each of the CMY colors, and shows that when the density increases, the amount of exposure light of each of the CMY colors is decreased at a fixed rate only in a specific range where the total toner amount (pile height) of CMY colors is high.

In FIG. 43, for the density up to the point A, the normal amount of exposure light (100%) is set for all of the CMY colors However, for the density exceeding the point A, the amount of exposure light is decreased at a fixed rate for each color. In addition, it is shown that the fixed rate increases in order of yellow, magenta, and cyan.

The amount of exposure light is determined using these drawings, thereby setting the amount of exposure light used at the time of printout (3610).

Then, if "0" is set as the tag information (NO in 3607), halftone generation processing is performed (3608) and pulse width modulation processing is performed (3609). After the pulse width modulation processing is performed, an output control on the printout of print data based on the processing is performed (3611).

Then, printout processing is performed on the basis of the output control.

Figure 37:
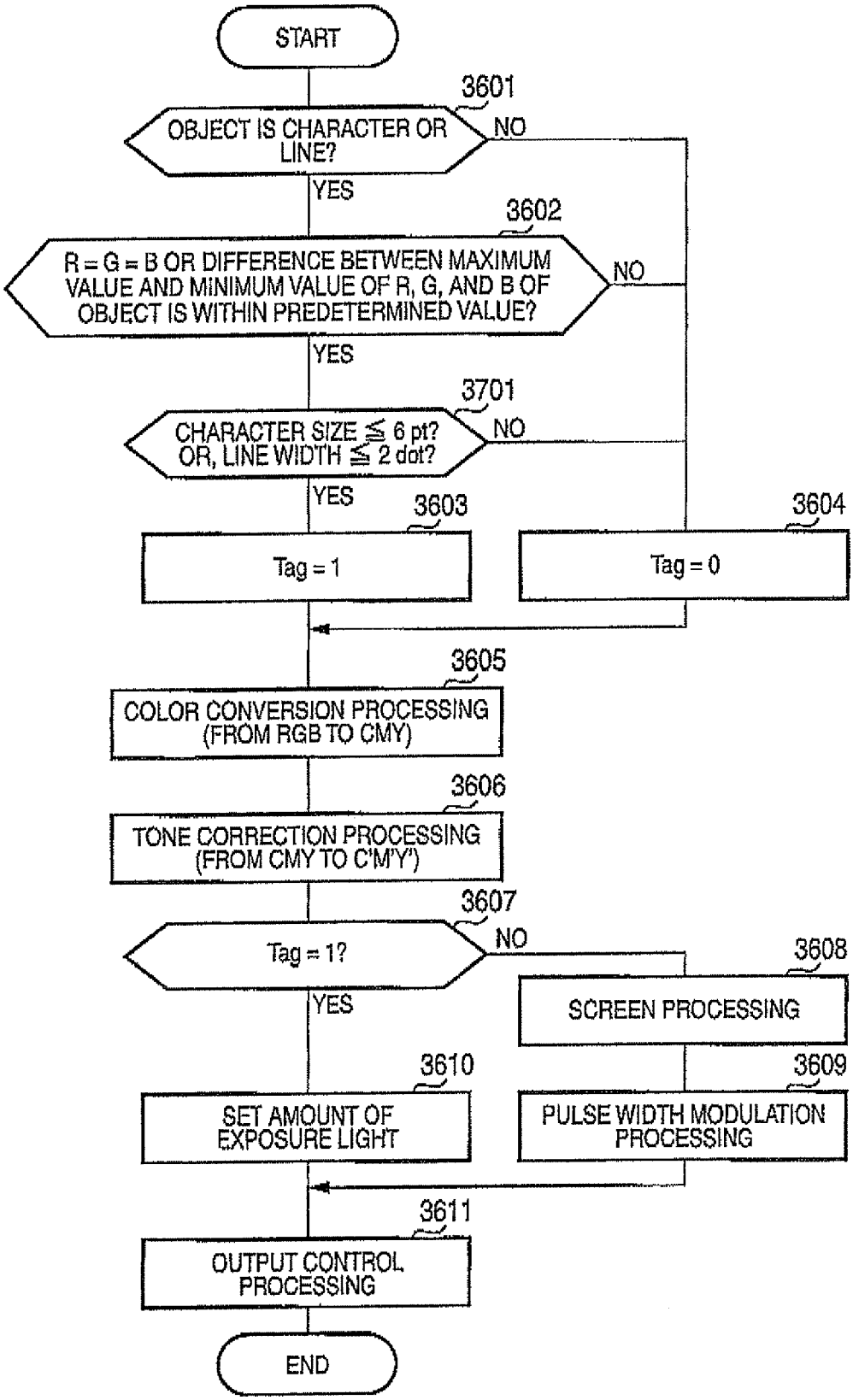
FIG. 37 is a flow chart illustrating a flow of processing performed in the image forming apparatus according to the exemplary embodiment of the invention.

FIG. 37 is a flow chart illustrating a flow of processing performed by the image forming apparatus according to the exemplary embodiment of the invention when the conditions that "R, G and B of the object are equal in lightness to each other (lightness of R=lightness of G=lightness of B) or a difference between maximum lightness and minimum lightness of R, G, and B of the object is within the predetermined value" and "a size of a character object is equal to or smaller than the predetermined character size or a line width of the line object is equal to or smaller than the predetermined line width" are set.

Referring to FIG. 37, first, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or tot each object meets the condition regarding the color material control at the time of printout (3602).

As the condition regarding the color material control at the time of printout, it is determined as to whether or not each object meets the condition that "values of R, G and B of the object are equal to each other (a value of R=a value of G=a value of B) or a difference between a maximum value and a minimum value of the values of R, G, and B of the object is within the predetermined value" (3602). If it meets the condition (YES in 3602), it is then determined as to whether or not it meets the condition that "a size of character object is equal to or smaller than the predetermined character size or a line width of the line object is equal to or smaller than the predetermined line width" (3701).

If the size of the character object is equal to or smaller than the predetermined character size or the line width of the line object is equal to or smaller than the predetermined line width (YES in 3701), "1" is set as the tag information (3603). In addition, if it meets neither the condition in the processing of 3602 nor the condition in the processing of 3701 (NO in 3602 and No in 3701), "0" is set as the tag information (3604).

After the tag information is set as described above, processing for color conversion from RGB colors to CMY colors is then performed (3605). Then, tone correction of the CMY colors after conversion is performed (3606). Then, it is determined as to whether or not "1", is set as the tag information of the object for which tone correction processing was performed (3607). If "1" is set as the tag information (YES in 3607), the amount of exposure light is set (3610), and the output control processing is performed (3611).

Then, if "0" is set as the tag information (NO in 3607), halftone generation processing is performed (3608) and pulse width modulation processing is performed (3609). After the pulse width modulation processing is performed, an output control on the printout of print data based on the processing is performed (3611).

Figure 44:
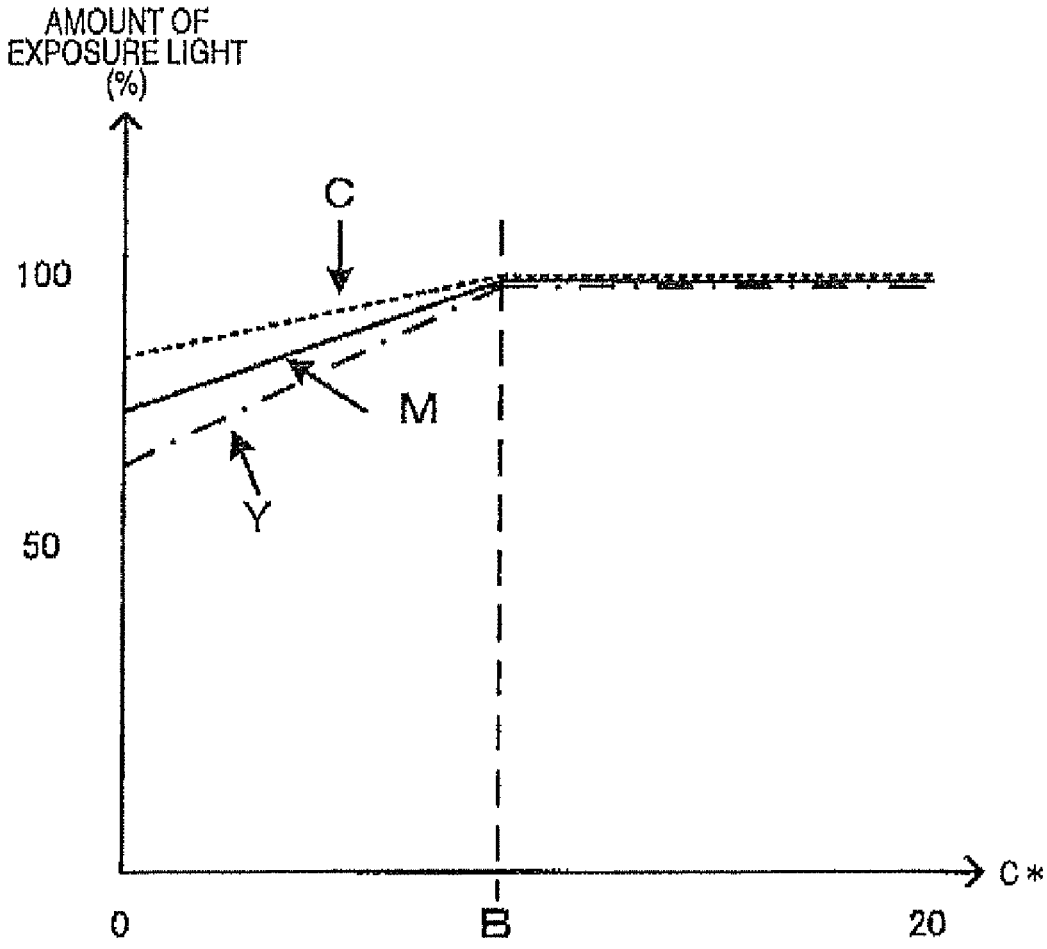
FIG. 44 is a graph illustrating the amount of exposure light (%) relative to the saturation (C*) based on the saturation a* and the saturation b* in the CIE Lab color space.

The amount of exposure light at this time is determined on the basis of the graph shown in FIG. 44.

FIG. 44 is a graph illustrating the amount of exposure light (%) relative to the saturation (C*) based on a saturation a* and a saturation b* in the CIE Lab color space. The horizontal axis indicates the density of C*, and the vertical axis indicates the amount of exposure light.

This indicates that the saturation increases as the value of C* increases.

In FIG. 44, the amount of exposure light is set to be smaller than the normal amount of exposure light (100%) in a specific range where the value of C* is between "0" and the point B, and when the value of C* exceeds the value of the point B, the subsequent amount of exposure light is set to the normal amount of exposure light (100%). When the value of C* is between "0" and the point B, the amount of exposure light is set to increase at a fixed rate for each of the CMY colors. The duty is set to 100% when the value of C* is at the point B. The rate of increase in the fixed rate is higher in order of yellow, magenta, and cyan.

The specific values in this case are shown in FIG. 45. Moreover, in FIG. 45, an example is shown in which the value of C* and the value of L* axe used to determine the amount of exposure light.

In FIG. 45, an L* column 4501, a C* column 4502, and an amount of exposure light column 4503 are provided.

FIG. 45 shows that when L* indicated in the L* column 4501 is "35<L*≦40" and C* indicated in the C* column 4502 is "9<C*≦10" an amount of exposure light indicated by in the amount of exposure light column 4503 is "100%". In addition, FIG. 45 shows that when L* indicated in the L* column 4501 is "L*≦10" and Ca indicated in the C* column 4502 is "C*≦4", an amount of exposure light indicated in the amount of exposure light column 4503 is "70%".

The amount of exposure light is determined using these drawings, thereby setting the amount of exposure light used at the time of printout (3610).

Then, printout processing is performed on the basis of the output control.

Figure 38:
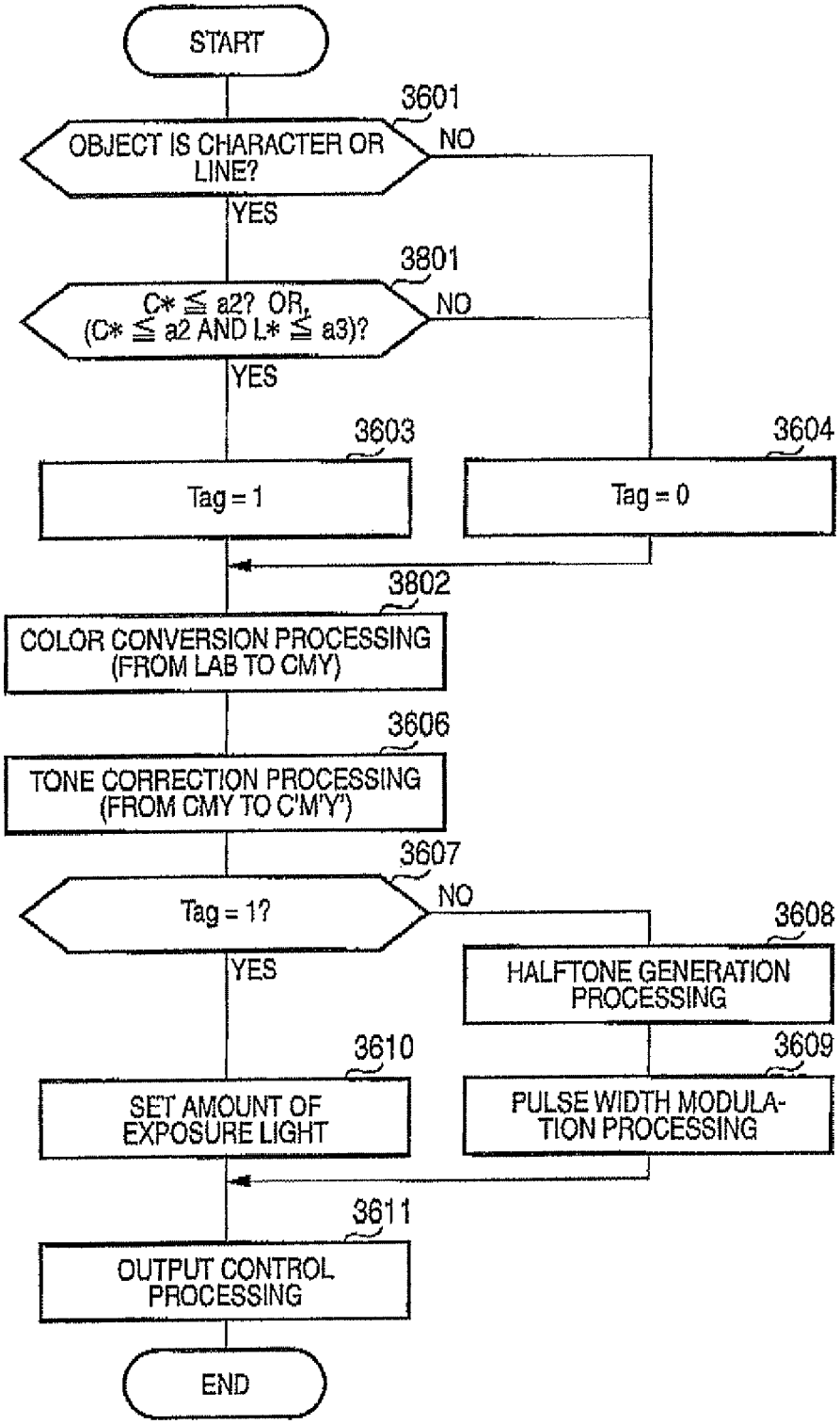
FIG. 38 is a flow chart illustrating a flow of processing performed in the image forming apparatus according to the exemplary embodiment of the invention.

FIG. 38 is a flow hart illustrating a flow of processing performed by the image forming apparatus according to the exemplary embodiment of the invention when the condition that "the saturation (C*) based on the saturation a* and the saturation b* in the CIE L*a*b* color space is within a fixed value and the lightness of L* is within a fixed value" is set.

Referring to FIG. 38, first, it is determined as to whether the classified object is a character object or a the object (3601). If the classified object is neither a character object nor a line object (NO in 3601), "0" is set as the tag information (3604). In addition, if the classified object is determined to be a character object or a line object (YES in 3601), it is then determined as to whether or not each object meets the condition regarding the color material control at the time of printout.

As the condition regarding the color material control at the time of printout, it is determined as to whether or not the "saturation (C*) based on the saturation a* and the saturation b* in the CIE L*a*b* color space is within the fixed value (e.g., a value "a2") and the lightness of L* is within the fixed value (e.g., a value "a3") (3801). If it meets the condition (YES in 3801), "1" is set as the tag information (3603). If it does not meet the condition (NO in 3801), "0" is set as the tag information (3604).

After the tag information is set as described above, processing for color conversion from Lab space to CMY colors is then performed (3802). Then, tone correction of the CMY colors after conversion is performed (3606). Then, it is determined as to whether or not "1" is set as the tag information of the object for which tone correction processing was performed (3607). If "1" is set as the tag information (YES in 3607), the amount of exposure light is set (3610), and output control processing is performed (3611).

Then, if "0" is set as the tag information (NO in 3607), halftone generation processing is performed (3608) and pulse width modulation processing is performed (3609). After the pulse width modulation processing is performed, an output control on the printout of print data based on the processing is performed (3611).

Then, printout processing is performed on the basis of the output control.

Figure 39:
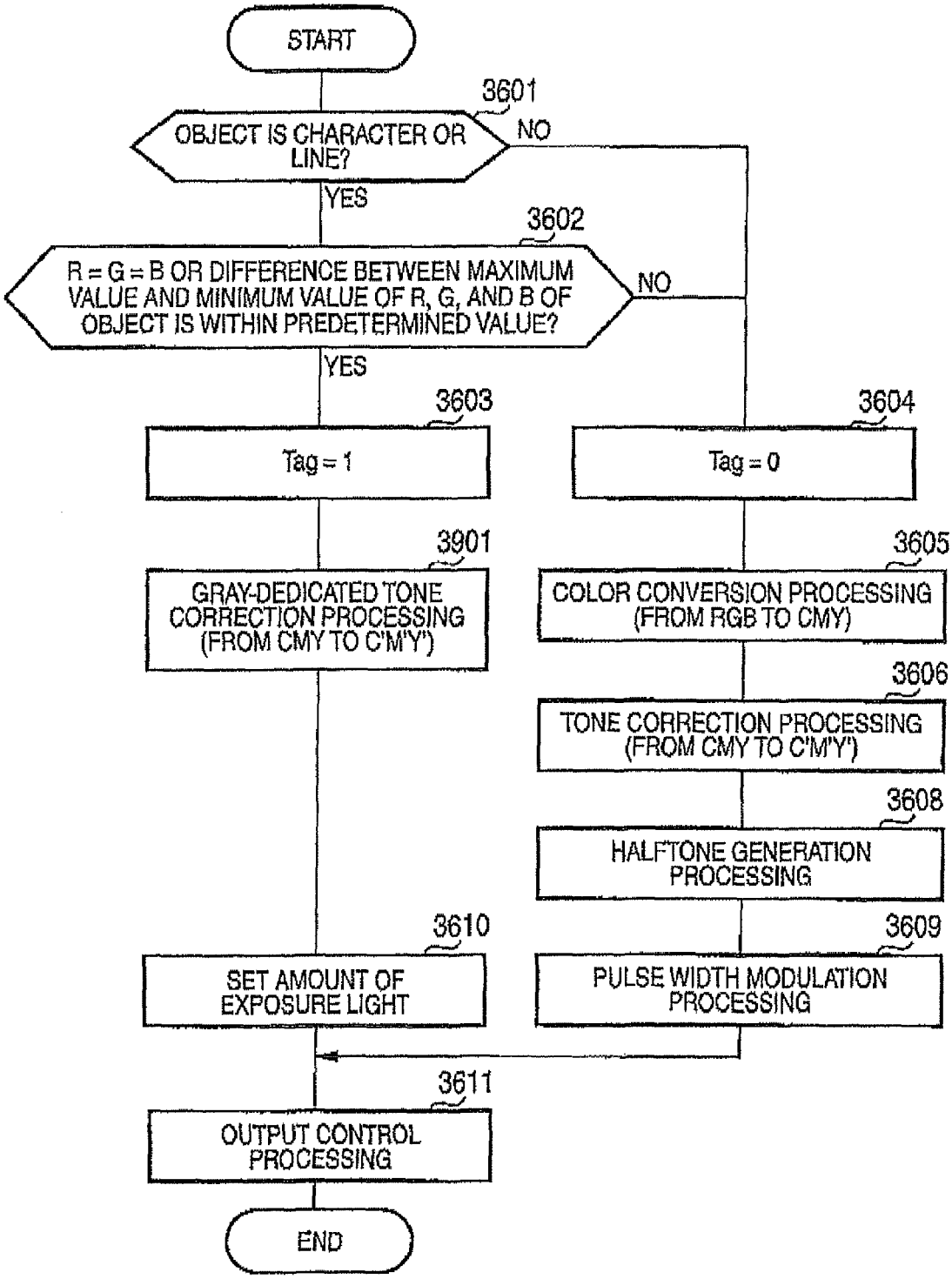
FIG. 39 is a flow chart illustrating a flow of processing performed in the image forming apparatus according to the exemplary embodiment of the invention.

FIG. 39 is a flow chart illustrating a flow of processing performed by the image forming apparatus according to the exemplary embodiment of the invention when the condition that "R, G, and B of the object are equal in lightness to each other (lightness of R=lightness of G=lightness of B) or a difference between maximum lightness and minimum lightness of R, G, and B of the object is within the predetermined value" is set.

First, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or not each object meats the condition regarding the color material control at the time of printout (3602).

As the condition regarding the color material control at the time of printout, it is determined as to whether or not the "values of R, G and B of the object are equal to each other (a value of R=a value of G=a value of B)" or whether or not "a difference between a maximum value and a minimum value of the values of R, G, and B of the object is within the predetermined value" (3602). If it meets the condition (YES in 3602), "1" is set as the tag information (3603). In additions if it does not meet the condition (NO in 3602), "0" is sets as the tag information (3604).

After "1" is set as the tag information as described above, tone correction is performed using the gray-dedicated tone correction table (3901).

After the tone correction is performed using the gray-dedicated tone correction table, the amount of exposure light is set (3610) and output control processing is performed (3611).

In addition, when "0" is set as the tag information, processing for color conversion from RGB colors to CMY colors is then performed (3605). Then, tone correction of the CMY colors after conversion is performed (3606). Then, halftone generation processing is performed on the object for which the tone correction processing was performed (3608).

After performing the halftone generation processing, pulse width modulation is performed on the print data in which the respective objects after halftone processing are mixed (3609). After the pulse width modulation processing is performed, the amount of exposure light is set (3610) and output control processing is performed (3611).

FIGS. 40A to 40D are views illustrating sites where the printout is performed with the amount of exposure light shown in the flow chars of FIGS. 35 to 39.

Figure 40D:
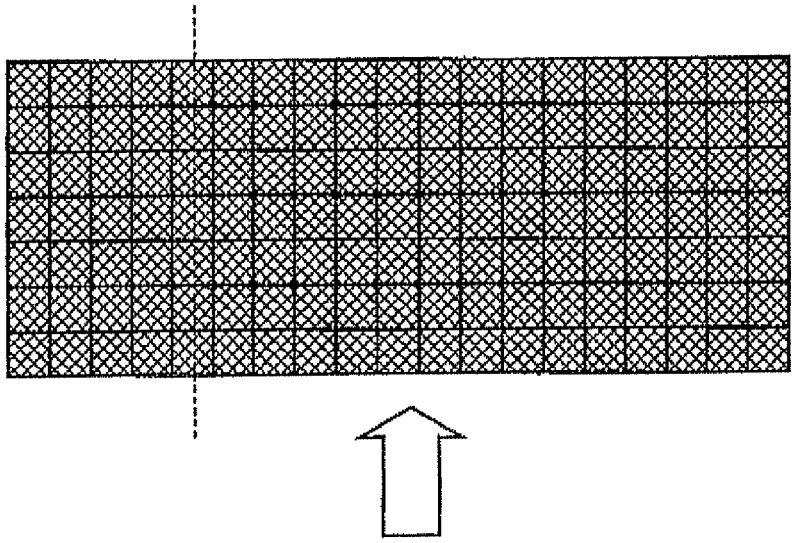
FIGS. 40A to 40D are views illustrating printout states.
Figure 40C:
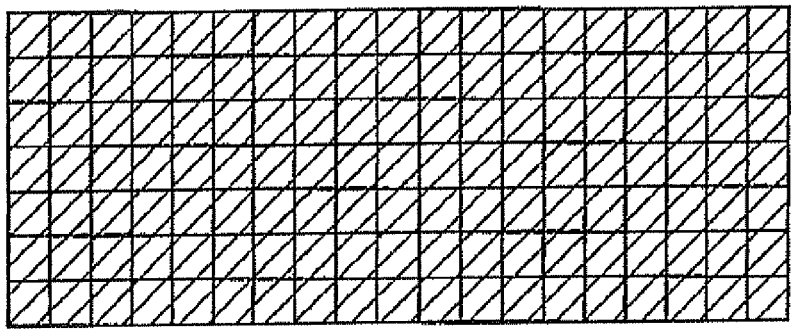
Figure 40B:
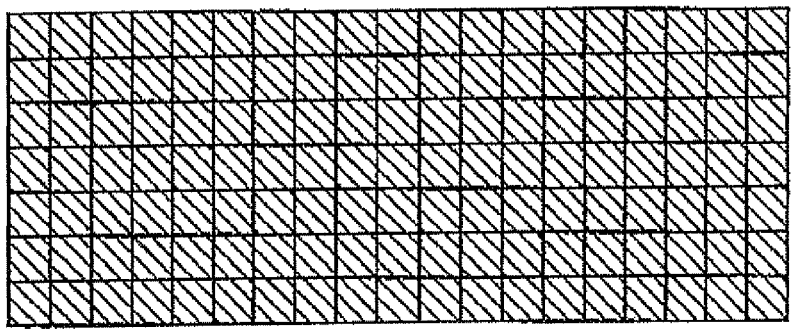
Figure 40A:
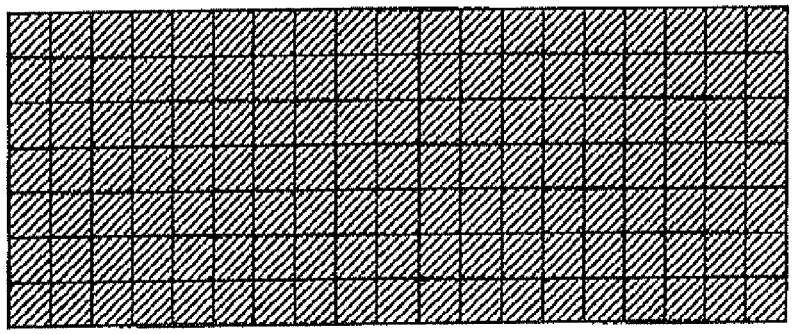

FIG. 40A shows a state where the amount of exposure light is reduced from the normal amount of exposure light (100%)

to "70%" and cyan is printed out for all pixels. FIG. 40B shows a state where the amount of exposure light is reduced from the normal amount of exposure light (100%) to "70%" and magenta is printed out for all pixels. FIG. 40C shows a state where the amount of exposure light is reduced from the normal amount of exposure light (100%) to "70%" and yellow is printed out for all pixels.

FIG. 40D is a view illustrating a state where printout is performed with overlapping of (i) cyan of the amount of exposure light of 70% shown in FIG. 40A, (ii) magenta of the amount of exposure light of 70% shown in FIG. 40B, and (iii) yellow of the amount of exposure light of 70% shown in FIG. 40C. FIG. 40D is foamed by the layers of color materials shown in FIG. 41.

Figure 41:
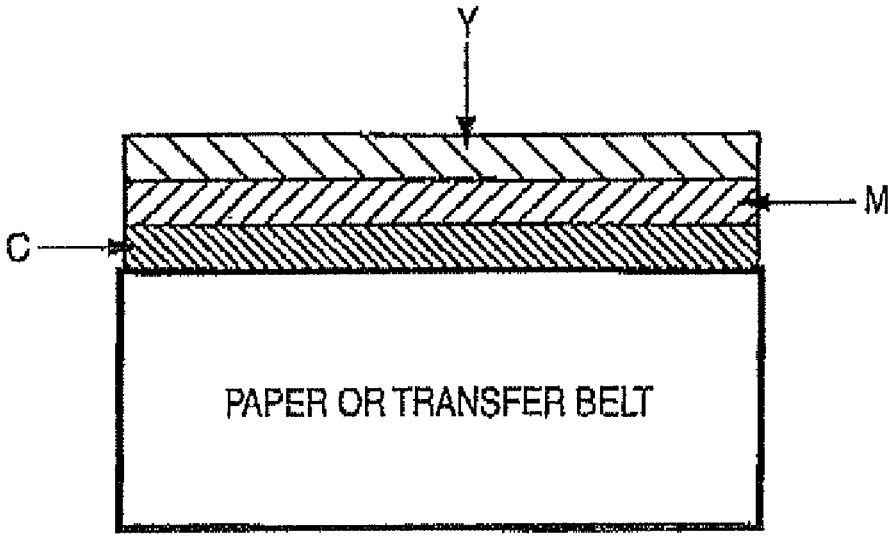
FIG. 41 is a view illustrating the printout state.

That is, FIG. 41 shows a state where the color materials overlap in order of cyan, magenta, and yellow on a sheet of paper or a transfer belt. In this case, the total toner amount (pile height) is smaller than that in the case where each of cyan, magenta, and yellow is printed out with the amount of exposure light being set to 100%.

Assuming that the case where each of cyan, magenta, and yellow is printed out with the amount of exposure light being set to 100% is expressed as "300", the amount of exposure light of the three colors shown in FIG. 41 corresponds to "210".

Figure 46:
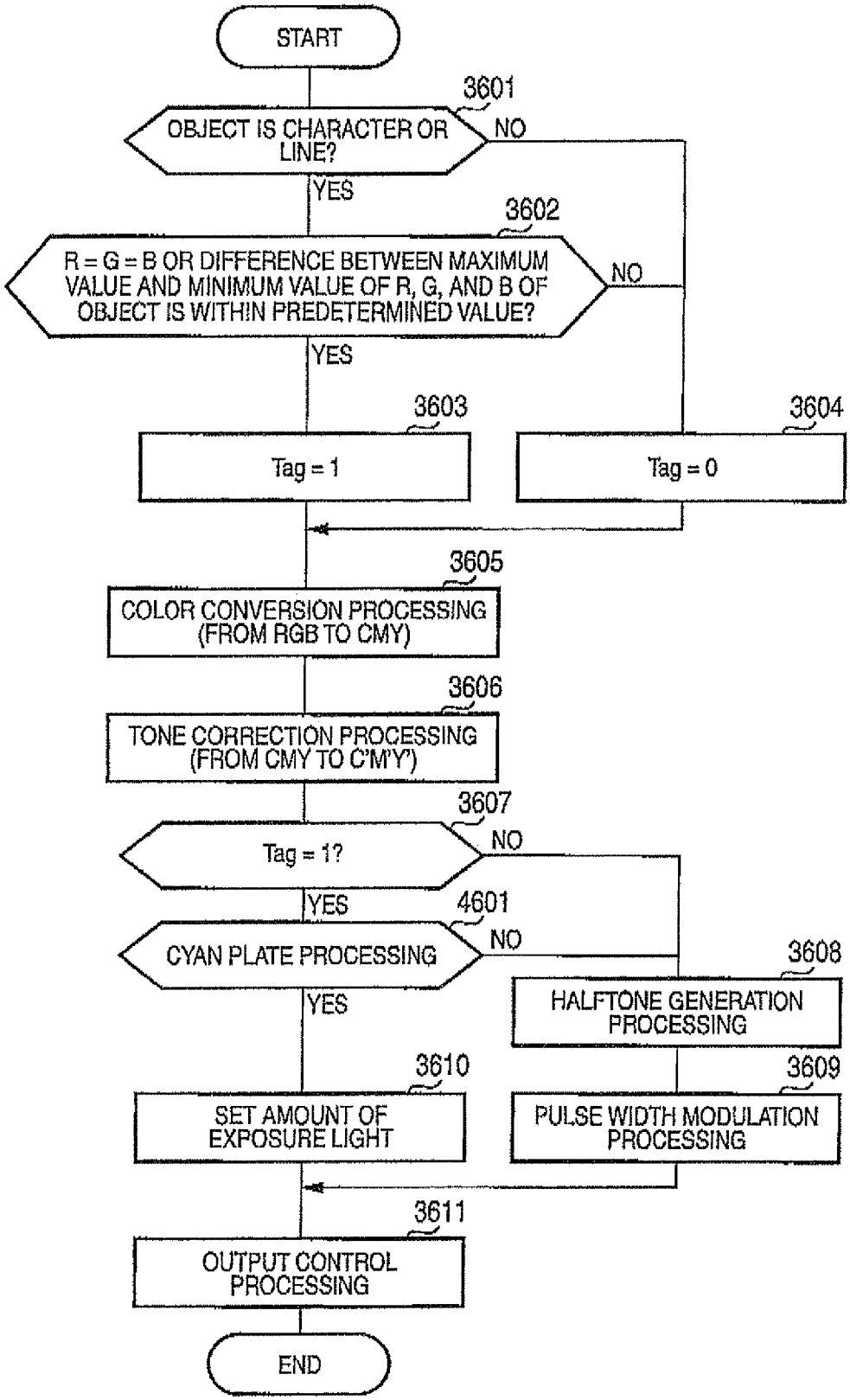
FIG. 46 is a flow chart illustrating a flow of processing performed in the image forming apparatus according to the exemplary embodiment of the invention.

FIG. 46 is a flow chart illustrating a flow of processing performed by the image forming apparatus according to the exemplary embodiment of the invention when the condition that "R, G and B of the object are equal in lightness to each other (lightness of R=lightness of G=lightness of B) or a difference between maximum lightness and minimum lightness of R, G, and B of the objet is within the predetermined value" is set.

Referring to FIG. 46, first, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or not each object meets the condition regarding the color material control at the time of printout (3602).

As the condition regarding the color material control at the time of printout, it is determined as to whether or not the "values of R, G and B of the object are equal to each other (a value of R=a value of G=a value of B)" or whether or not "a difference between a maxima value and a minimum value of the values of R, G, and B of the object is within the predetermined value" (3602). If it meets the condition (YES in 3602), "1" is set as the tag information (3603). In addition, if it does not meet the condition (NO in 3602), "0" is sets as the tag information (3604).

After the tag information is set as described above, processing for color conversion from RGB colors to CMY colors is then performed (3605). Then, tone correction of the CMY colors after conversion is performed (3606). Then, it is determined as to whether or not "1" is set as the tag information of the object for which tone correction processing was performed (3607). If "1" is set as the tag information (YES in 3607), processing is changed according to a color plate.

For example, in the case of plate processing using cyan (YES in 4601), the amount of exposure light is set (3610) and output control processing is performed (3611).

In cases of magenta and yellow other than cyan (NO in 4601), halftone generation processing is performed (3608) and pulse width modulation processing is performed (3609) in the same manner as the case where "0" is set as the tag information (NO in 3607). After the pulse width modulation processing is performed, an output control on the printout of print data based on the processing is performed (3611).

Then, printout processing is performed on the basis of the output control.

Figure 47D:
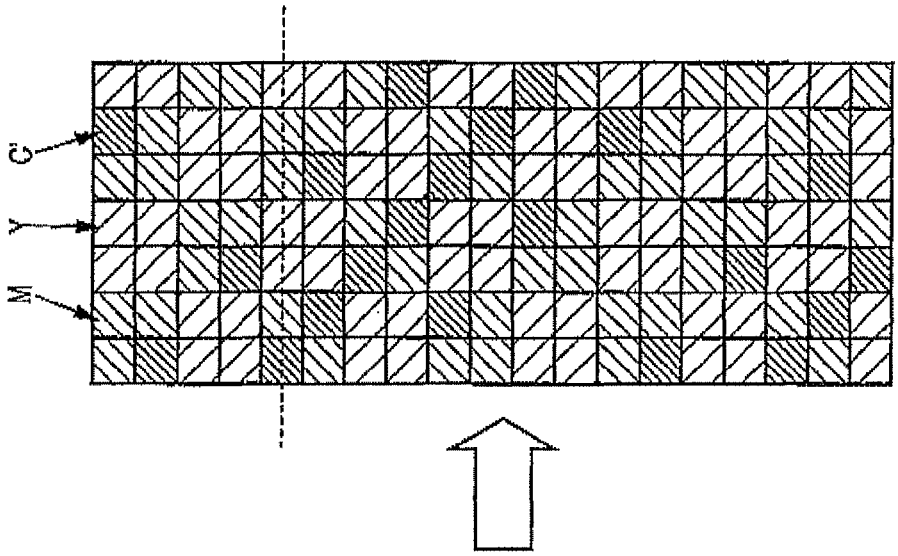
FIGS. 47A to 47D are views illustrating printout states of all pixels using cyan for which an amount of exposure light is reduced.
Figure 47C:
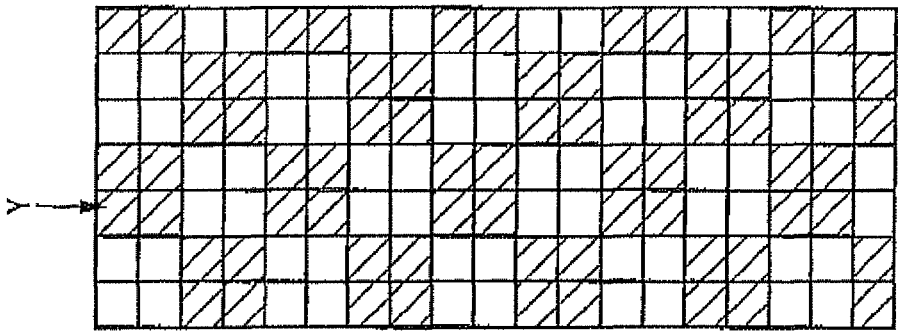
Figure 47B:
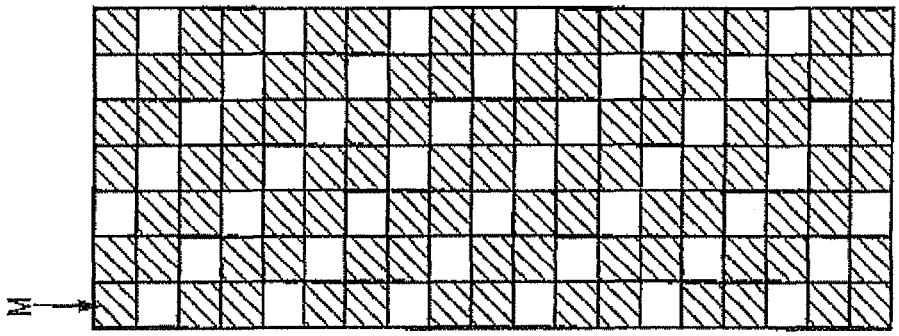
Figure 47A:
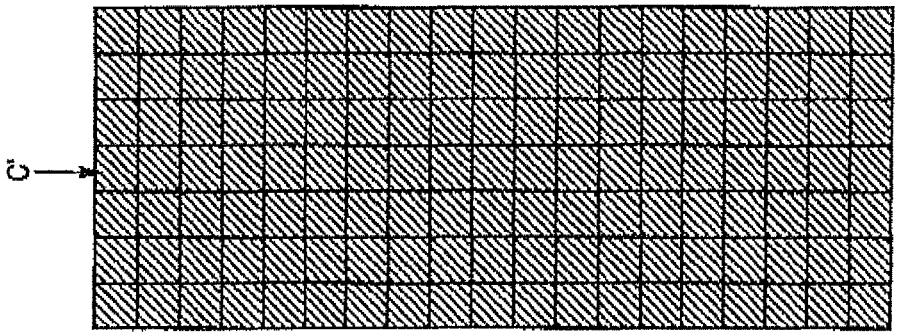
Figure 48:
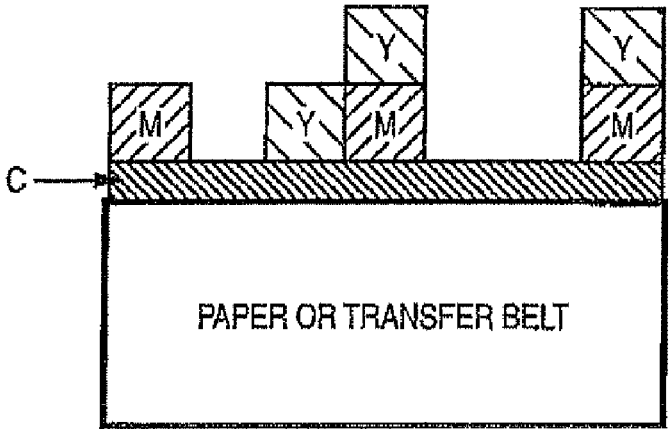
FIG. 48 is a view illustrating an overlapping state of the print states shown in FIGS. 47A to 47D.

The print states at this time are shown in FIGS. 47A to 48.

FIG. 47A shows a printout state of all pixels using cyan in which the amount of exposure light is reduced, and FIGS. 47B and 47C are views illustrating print states with the amount of exposure light being set to 100% for magenta and yellow.

The state where FIGS. 47A to 47C overlap in this order is shown in FIG. 47D.

FIG. 48 is a view illustrating the overlapping state of the print states shown in FIGS. 47A to 47C, and shows the state where magenta and yellow overlap cyan in each pixel unit. FIG. 48 illustrates the state where cyan is printed out with the amount of exposure light being smaller than those for the other color materials (magenta and yellow).

Figure 49:
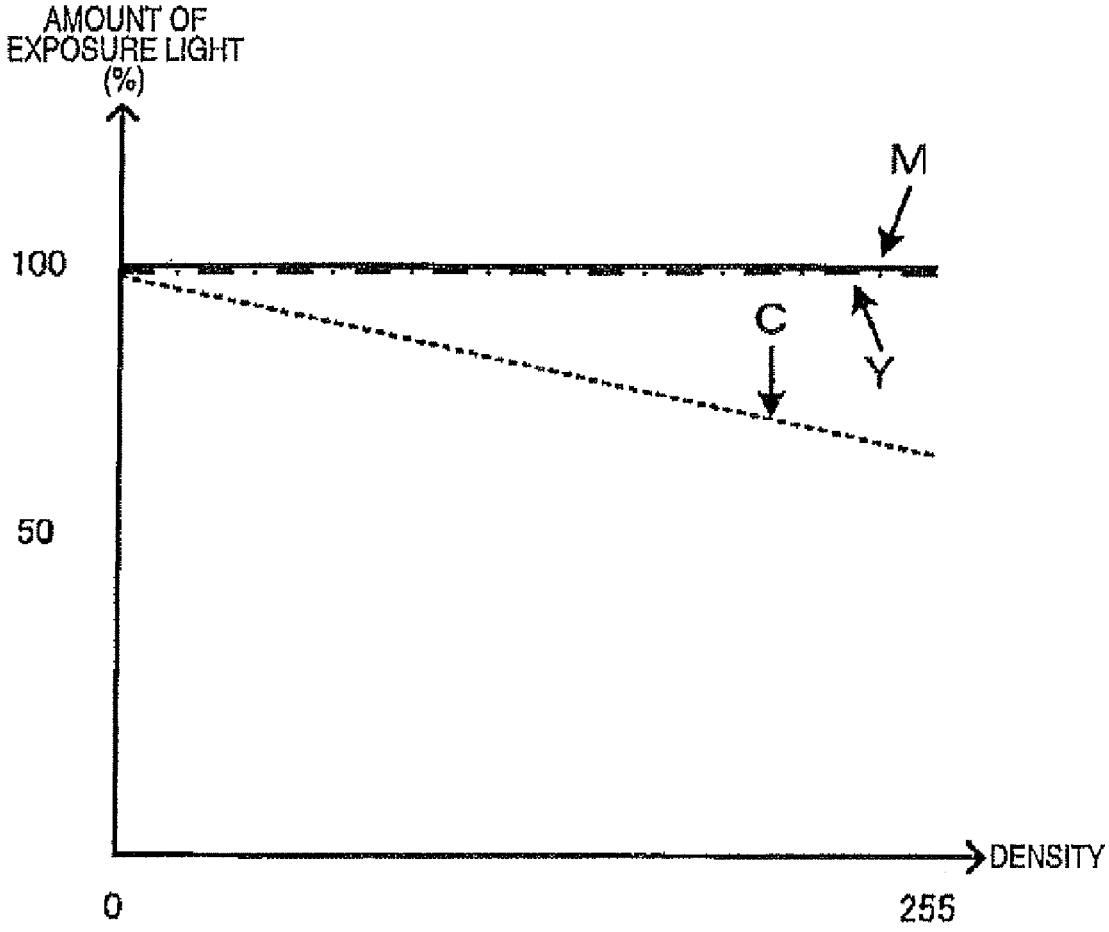
FIG. 49 is a graph illustrating the amount of exposure light relative to the density of each of CMY colors.

FIG. 49 is a graph illustrating the amount of exposure light relative to the density of each of CMY colors. The horizontal axis indicates the density of each of CMY colors, and the vertical axis indicates the value of the amount of exposure light (%).

FIG. 49 shows that as the density of each of CMY colors increases, the amount of exposure light for the designated color material (cyan in the example shown in FIG. 46) decreases at a fixed rate. For the other color materials (magenta and yellow in the example shown in FIG. 46), the normal amount of exposure light (100%) is set.

Figure 50:
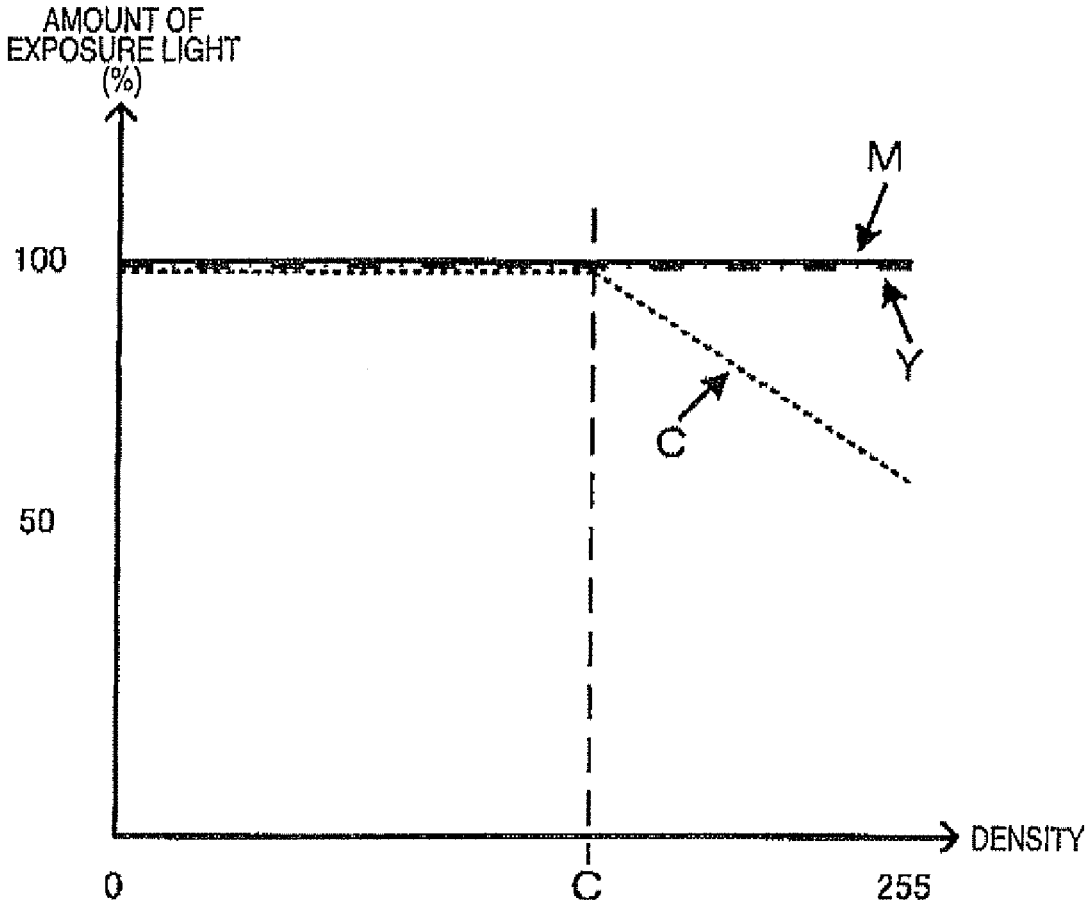
FIG. 50 is another example of the graph illustrating the amount of exposure light relative to the density of each of the CMY colors shown in FIG. 49.

FIG. 50 is another example of the graph illustrating the amount of exposure light relative to the density of each of the CMY colors, and shows that when the density exceeds the point C at which the total toner amount (pile height) of CMY colors becomes high, the amount of exposure light is made small only for cyan. FIG. 50 shows that when the density becomes higher than that at the point C, the amount of exposure light for the cyan is decreased at a fixed rate.

Figure 51:
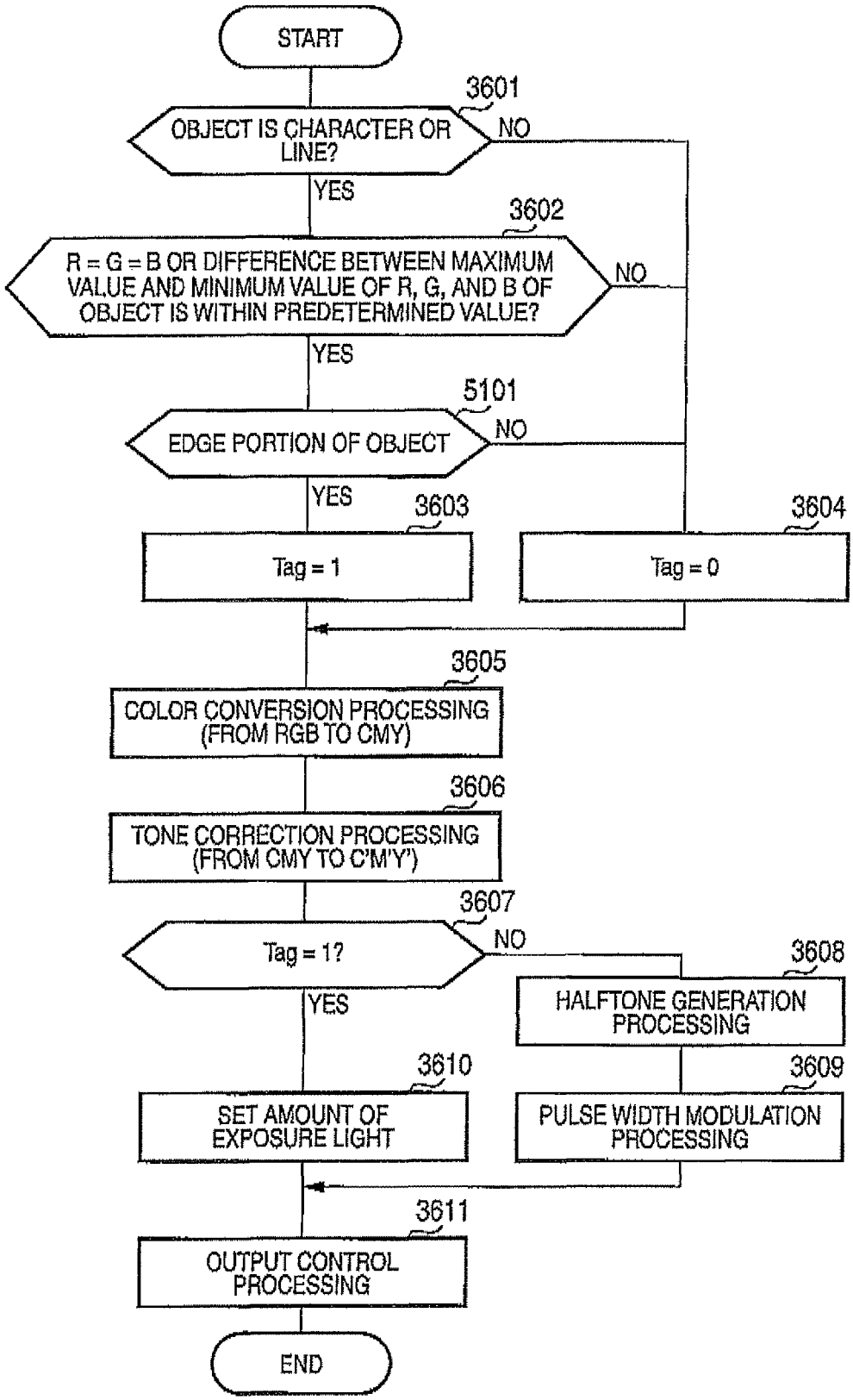
FIG. 51 is a flow chart illustrating a flow of processing performed in the image forming apparatus according to the exemplary embodiment of the invention.

FIG. 51 is a flow chart illustrating a flow of processing performed by the image forming apparatus according to the exemplary embodiment of the invention when the conditions that "R, G and B of the object are equal in lightness to each other (lightness of R=lightness of G=lightness of B) or a difference between maximum lightness and minimum lightness of R, G, and B of the object is within the predetermined value" and a condition of "an extraction of an edge portion of the object" are set.

Referring to FIG. 51, first, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or not each object meets the condition regarding the color material control at the time of printout.

As the condition regarding the color material control at the time of printout, it is first determined whether or not "values of R, G and B of the object are equal to each other (a value of R=a value of G=a value of B)" or whether or not "a difference between a maximum value and a minimum value of the values of R, G, and B of the object is within the predetermined value" (3602). If it does not meet the condition (NO in 3602), "0" is set as the tag information (3604). Moreover, fit meets the condition (YES in 3602), it is then determined as to whether or not it meets the condition of "extraction of an edge portion of the object" (5101).

In the case of the edge portion of the object (YES in 5101), "1" is set as the tag information (3603). In addition, if it does not meet the condition of "extraction of an edge portion of the object" (NO in 5101), "0" is set as the tag information (3604).

After the tag information is set as described above, processing for color conversion from RGB colors to CMY colors is then performed (3605). Then, tone correction of the CMY colors after conversion is performed (3606). Then, it is determined as to whether or not "1" is set as the tag information of the object for which tone correction processing was performed (3607). If "1" is set as the tag information (YES in 3607), the amount of exposure light is set (3610), and output control processing is performed (3611).

Then, if "0" is set as the tag information (NO in 3607), halftone generation processing is performed (3608) and pulse width modulation processing is performed (3609). After the pulse width modulation processing is performed, art output control on the printout of print data based on the processing is performed (3611).

Then, printout processing is performed on the basis of the output control.

FIGS. 52A to 52D show the states where the amount of exposure light is adjusted only for the edge portion and the printout is performed.

Figures 52A, 52B, 52C, 52D:
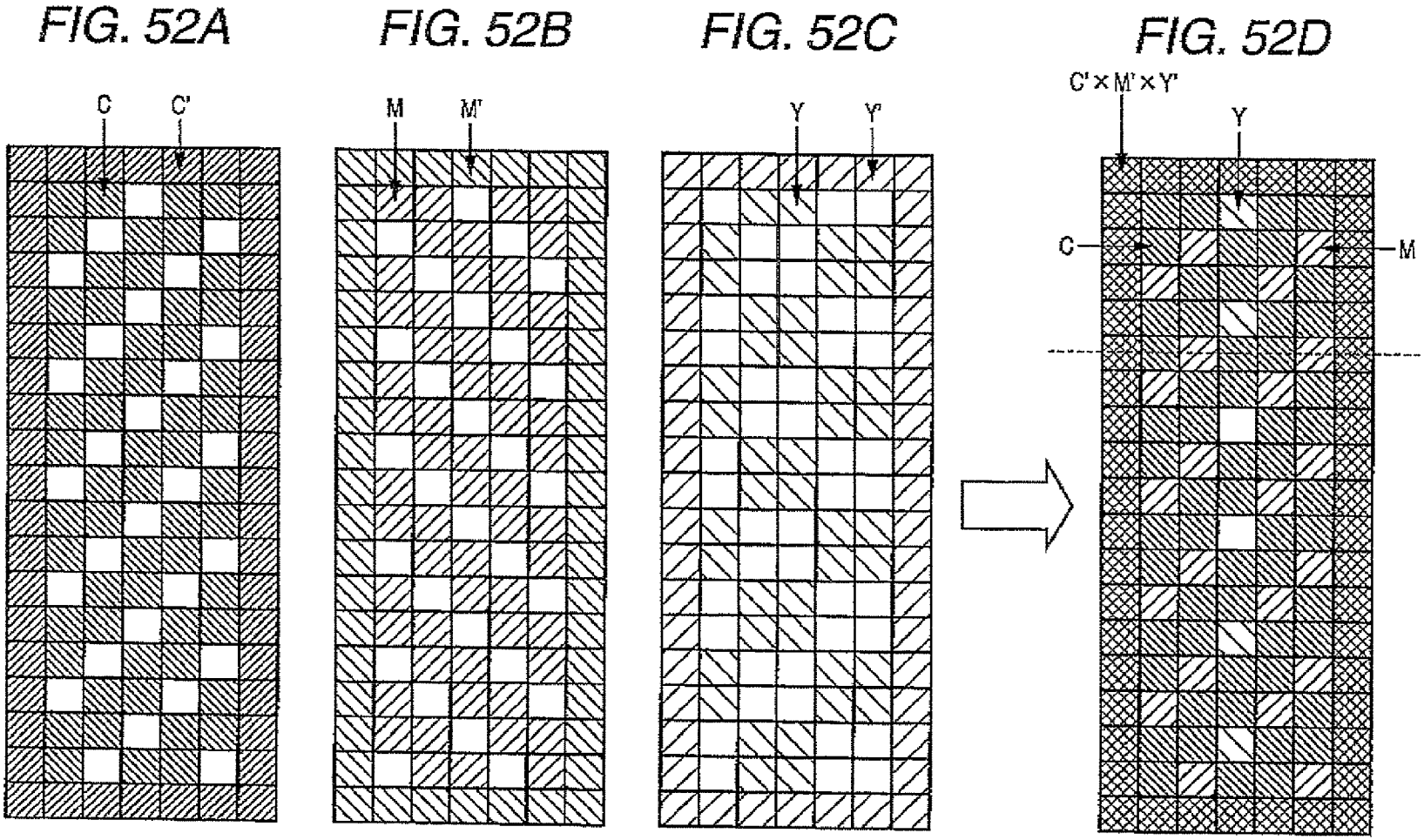
FIGS. 52A to 52D are views illustrating the states where the amount of exposure light is set only for the edge portion and the printout is performed.

FIG. 52A shows a print state of cyan in which the printout is performed with the amount of exposure light being smaller than the normal amount of exposure light (100%) only for the edge portions. FIG. 52B shows a print state of magenta in which the printout is performed with the amount of exposure light being smaller than the normal amount of exposure light (100%) only for the edge portions FIG. 52C shows a print state of yellow in which the printout is performed with the amount of exposure light being smaller than the normal amount of exposure light (100%) only for the edge portions.

FIG. 52D is a view illustrating the state where FIGS. 52A to 52C overlap. FIG. 52D is formed by the layers of color materials shown in FIG. 53.

Figure 53:
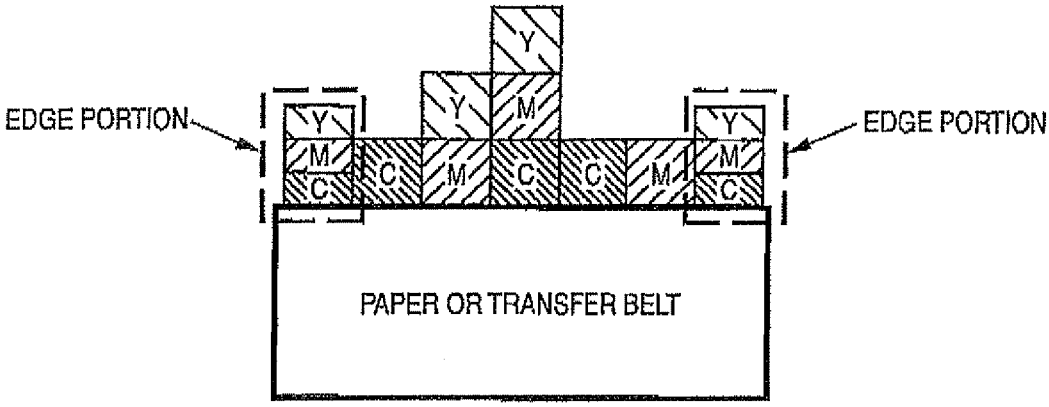
FIG. 53 is a view illustrating a printout state.

That is, FIG. 53 is a view illustrating the state where the amount of exposure light is set to 50% for the edge portions, and overlapping is performed.

Figure 54:
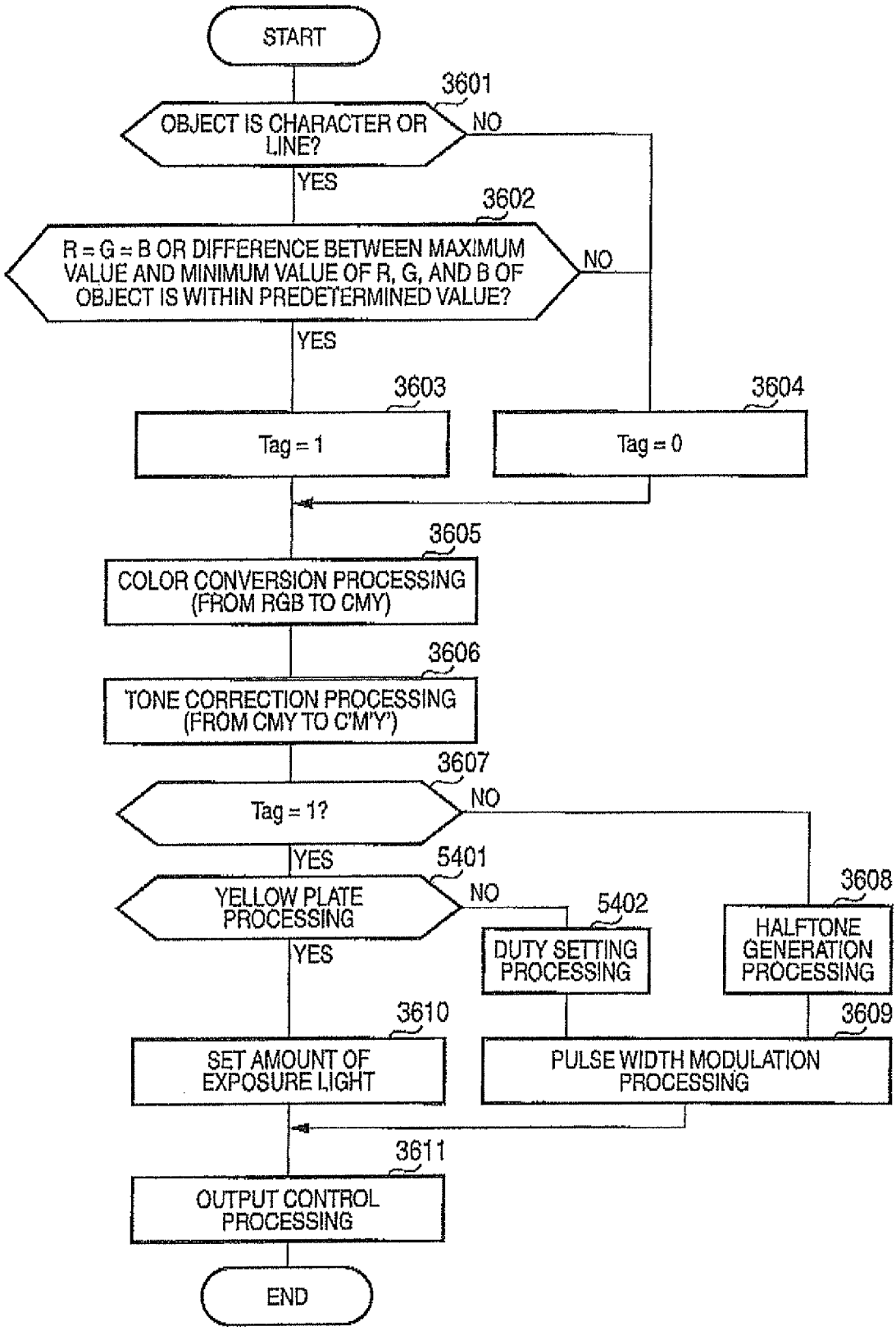
FIG. 54 is a flow chart illustrating a flow of processing performed in the image forming apparatus according to the exemplary embodiment of the invention.

FIG. 54 is a flow chart illustrating a flow of processing performed by the image forming apparatus according to the exemplary embodiment of the invention when the condition that "R, G and B of the object are equal in lightness to each other (lightness of R=lightness of C=lightness of B) or a difference between maximum lightness and minimum tightness of R, G, and B of the object is within the predetermined value" is set.

Referring to FIG. 54, first, it is determined as to whether the classified object is a character object or a line object (3601). If the classified object is neither a character object nor a line object (NO in 3601), "0" is set as the tag information (3604). In addition, if the classified object is determined to be a character object or a line object (YES in 3601), it is then determined as to whether or not each object meets the condition regarding the color material control at the time of printout (3602).

As the condition regarding the color material control at the time of printout, it is determined as to whether or not the "values of R, G and B of the object are equal to each other (a value of R=a value of C=a value of B)" or whether or not "a difference between a maximum value and a minimum value of the values of R, G, and B of the object is within the predetermined value" (3602). If it meets the condition (YES in 3602), "1" is set as the tag information (3603). In addition, if it does not meet the condition (NO in 3602), "0" is sets as the tag information (3604).

After the tag information is set as described above, processing for color conversion from RGB colors to CMY colors is then performed (3605). Then, tone correction of the CMY colors after conversion is performed (3606). Then, it is determined as to whether or not "1" is set as the tag information of the object for which tone correction processing was performed (3607). If "1" is set as the tag information (YES in 3607), processing is changed according to the color plate.

If "0" is set as the tag information (NO in 3607), halftone generation processing is performed (3608) and pulse width modulation processing is performed (3609). After the pulse width modulation processing is performed, an output control on the printout of print data based on the processing is performed (3611).

For example, in the case of plate processing using yellow (YES in 5401), the amount of exposure light is set (3610), and output control processing is performed (3611).

In the case of cyan and magenta other than yellow (NO in 5401), the duty is set (5402) and pulse width modulation processing is performed (3609).

Then, printout processing is performed on the basis of the output control.

FIGS. 55A to 55D are views illustrating print states where the amount of exposure light is made smaller than the normal amount of exposure light, only for yellow.

Figure 55A:
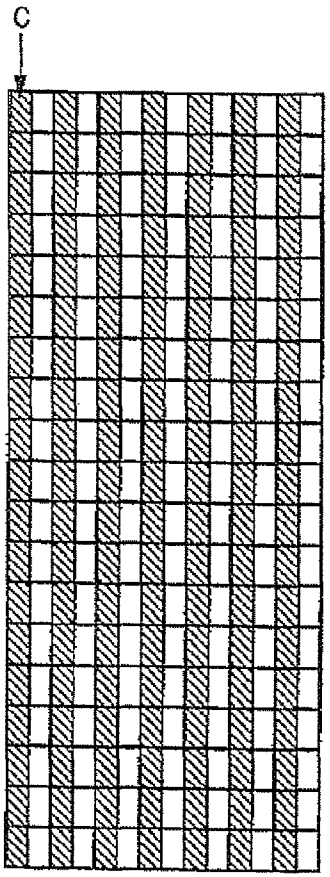
FIGS. 55A to 55D are views illustrating the print states where the amount of exposure light is made smaller than the normal amount of exposure light only for yellow.
Figure 55B:
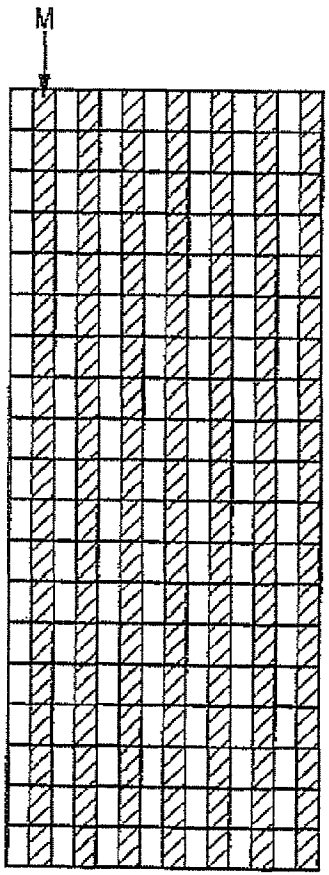
Figure 55C:
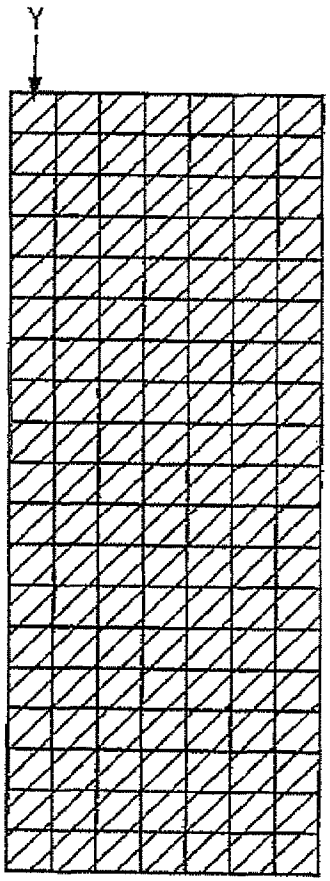

FIG. 55A shows a print state of yawn in which the duty is set to 50% and the left half of each pixel is colored. FIG. 55B shows a print state of magenta in which the duty is set to 50% and the right half of each pixel is colored. FIG. 55C shows a state where all pixels are printed with an amount of exposure light being smaller than the normal amount of exposure light.

Figure 55D:
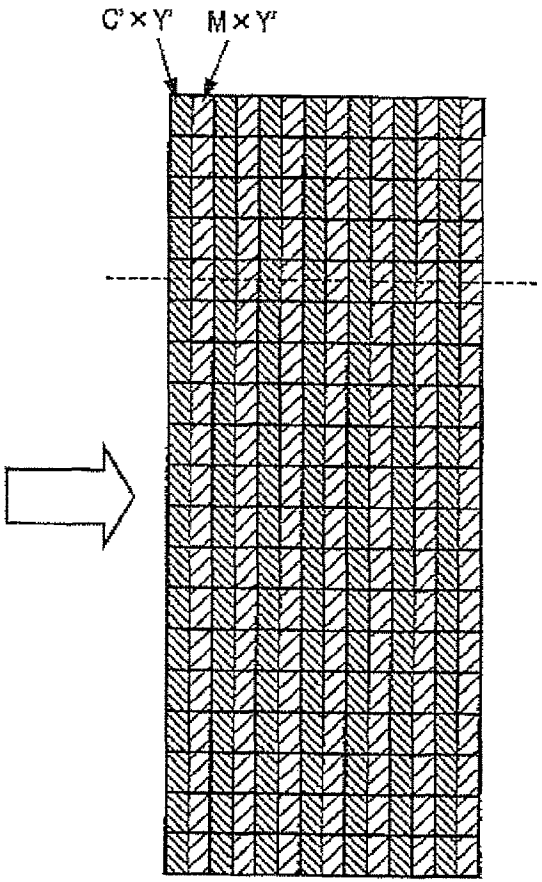

FIG. 55D is a view illustrating a state where cyan of FIG. 55A, magenta of FIG. 55B, and yellow of FIG. 55C overlap. The left half of each pixel is a color obtained by the overlapping of cyan and yellow for which the amount of exposure light is reduced, and the right half of each pixel is a color obtained by the overlapping the magenta the yellow for which the amount of exposure light is reduced.

Figure 56:
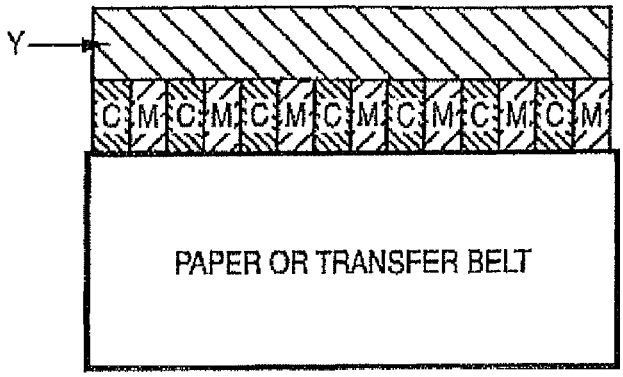
FIG. 56 is a view illustrating the overlapping state of the colors shown in FIGS. 55A to 55C.

FIG. 56 is a view illustrating the overlapping state of the colors shown in FIGS. 55A to 55C, which shows the state where yellow, for which the amount of exposure light is reduced, overlaps cyan and magenta with the duty of 50%.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an alternative printing unit that performs alternative printing of a black image by mixing images of color materials of three colors of cyan, yellow, and magenta, wherein the alternative printing unit includes a color material amount control unit that controls amounts of the respective color materials, which form the images of the color materials of the three colors, so as to be smaller than amounts of the respective color materials at a time of printing using a black color material.

2. The image forming apparatus according to claim 1, wherein the color material amount control unit controls at least one of (i) amounts of exposure light with which a photoconductor is exposed when electrostatic latent images corresponding to the images of the color materials of the three colors are formed on the photoconductor, (ii) a developing voltage of a developing device that develops the electrostatic latent images corresponding to the images of the color materials of the three colors with the respective color materials, and (iii) the number of pixels of print data corresponding to the images of the color materials of the three colors.

3. The image forming apparatus according to claim 1, wherein the color material amount control unit controls a maximum rate of application of each of the color materials of the three colors at a time of the alternative printing is performed so as to be different from that at the time of printing using the black color material.

4. An image forming apparatus comprising:

an alternative printing unit that performs alternative printing of a black image by mixing images of color materials of three colors of cyan, yellow, and magenta, wherein the alternative printing unit includes a resolution control unit that controls resolutions of the images of the color materials of the three colors so as to be lower than resolutions of the images of the color materials of the three colors at a time of printing using a black color material.

5. An image forming apparatus comprising:

an element identification unit that identifies an element of print data requested to be printed; and an alternative printing unit, wherein when the element identified by the element identification unit is a character element or a line-drawing element and when the element identified by the element identification unit meets a control condition based on a feature of the character element or a feature of the line-drawing element, the alternative printing unit performs alternative printing of a black image of the character element or the line-drawing element by mixing images of color materials of three colors of cyan, yellow, and magenta, the alternative printing unit includes an exposure light amount control unit, and when electrostatic latent images corresponding to the images of the color materials of the three colors are formed on a photoconductor, the exposure light amount control unit controls at least one of amounts of exposure light with which the photoconductor is exposed, so as to be lower than an amount of exposure light applied when using a black color material.

6. The image forming apparatus according to claim 5, wherein the control condition includes a condition that a difference between a maximum of a minimum of values of color information of the print data is within a predetermined range, and when the black image of the character element or the line-drawing element meets the control condition, the alternative printing unit performs the alternative printing using the color materials of the three colors.

7. The image forming apparatus according to claim 5, wherein the control condition includes at least one of (i) a condition that the character element is equal to or smaller than a predetermined character size and (ii) a condition that the line-drawing element is equal to or smaller than a predetermined line width, and when the black image of the character element or the line-drawing element meets the control condition, the alternative printing unit performs the alternative printing using the color materials of the three colors.

8. The image forming apparatus according to claim 5, wherein the exposure light amount control unit reduces the amounts of the exposure light at a fixed rate as densities of the color materials of the three colors increase.

9. The image forming apparatus according to claim 5, wherein when a density of each of the color materials of the three colors is higher than a predetermined density, the exposure light amount control unit reduces the amount of exposure light corresponding to each of the color materials at a fixed rate in accordance with a difference between the density of each of the color materials and the predetermined density.

10. The image forming apparatus according to claim 5, wherein the alternative printing unit further includes a color conversion unit, when the element identified by the element identification unit meets the control condition including a condition that a saturation of the identified element in a color space is equal to or less than a predetermined saturation and a lightness of the identified element in the color space is equal to or less than a predetermined lightness, the color conversion unit converts color information of the identified element in the color space into color information constituted by the color materials of the three colors, and the exposure light amount control unit controls the at least one of the amounts of exposure light, which correspond to the color materials and which are based on the color information converted by the color conversion unit, so as to be smaller than the amount of exposure light applied when using the black color material.

11. The image forming apparatus according to claim 10, wherein when the element identified by the element identification unit meets the condition that the saturation of the identified element in the color space is equal to or less than the predetermined saturation and the lightness of the identified element in the color space is equal to or less than the predetermined lightness, the exposure light amount control unit decreases the amounts of the respective exposure light in accordance with the saturation of the identified element and the lightness of the identified element, and when the saturation of the identified element exceeds the predetermined saturation and the lightness of the identified element exceeds the predetermined lightness, the exposure light amount control unit controls the amounts of the respective exposure light to be a predetermined amount.

12. The image forming apparatus according to claim 5, wherein the exposure light amount control unit further includes a tone correction unit, and when the element identified by the element identification unit meets the control condition, the tone correction unit performs tone correction for reproducing a color tone of black formed of the color materials of the three colors.

13. The image forming apparatus according to claim 5, wherein when the element identified by the element identification unit meets the control condition, the exposure light amount control unit selectively controls the amount of exposure light corresponding to an edge portion of the component identified by the element identification unit so as to be decreased.

14. An image forming apparatus comprising:

an element identification unit that identifies a element of print data requested to be printed; and an alternative printing unit, wherein when the element identified by the element identification unit is a character element or a line-drawing element and when the element identified by the element identification unit meets a control condition based on a feature of the character element or a feature of the line-drawing element, the alternative printing unit performs alternative printing of a black image of the character element or the line-drawing element by mixing images of color materials of three colors of cyan, yellow, and magenta, the alternative printing unit includes an exposure rate control unit, and when electrostatic latent images corresponding to the images of the color materials of the three colors are formed on a photoconductor, the exposure rate control unit controls an exposure rate of an actual exposure time to a unit pulse duration for a pixel of each image for exposing the photoconductor so as to be decreased to be smaller than that at the time of printing using a black color material.

15. The image forming apparatus according to claim 14, wherein the control condition includes a condition that a difference between a maximum and a minimum of values of color information of the print data is within a predetermined range, and when the black image of the character element or the line-drawing element meets the control condition, the alternative printing unit performs the alternative printing using the color materials of the three colors.

16. The image forming apparatus according to claim 14, wherein the control condition includes at least one of (i) a condition that the character element is equal to or smaller than a predetermined character size and (ii) a condition that the line-drawing element is equal to or smaller than a predetermined line width, and when the black image of the character element or the line-drawing element meets the control condition, the alternative printing unit performs the alternative printing using the color materials of the three colors.

17. The image forming apparatus according to claim 14, wherein the exposure light amount control unit reduces the exposure rate of the actual exposure time to the unit pulse duration at a fixed rate as densities of the color materials of the three colors increase.

18. The image forming apparatus according to claim 14, wherein when a density of each of the color materials of the three colors is higher than a predetermined density, the exposure light amount control unit reduces the exposure rate of the actual exposure time to the unit pulse duration at a fixed rate in accordance with a difference between the density of each of the color materials and the predetermined density.

19. The image forming apparatus according to claim 14, wherein the alternative printing unit further includes a color conversion unit, when the element identified by the element identification unit meets the control condition including a condition that a saturation of the identified element in a color space is equal to or less than a predetermined saturation and a lightness of the identified element in the color space is equal to or less than a predetermined lightness, the color conversion unit converts color information of the identified element in the color space into color information constituted by the color materials of the three colors, and the exposure light amount control unit controls the exposure ratio of at least one of exposure light, which correspond to the color materials and which are based on the color information converted by the color conversion unit, so as to be smaller than an exposure ratio when using the black color material.

20. The image forming apparatus according to claim 19, wherein when the element identified by the element identification unit meets the condition that the saturation of the identified element in the color space is equal to or less than the predetermined saturation and the lightness of the identified element in the color space is equal to or less than the predetermined lightness, the exposure light amount control unit decreases the amounts of the respective exposure light in accordance with the saturation of the identified element and the lightness of the identified element, and when the saturation of the identified element exceeds the predetermined saturation and the lightness of the identified element exceeds the predetermined lightness, the exposure light amount control unit controls the amounts of the respective exposure light to be a predetermined amount.

21. The image forming apparatus according to claim 19, the exposure light amount control unit further includes a tone correction unit, and when the element identified by the element identification unit meets the control condition, the tone correction unit performs tone correction for reproducing a color tone of black formed of the color materials of the three colors.

22. The image forming apparatus according to claim 19, wherein when the element identified by the element identification unit meets the control condition, the exposure light amount control unit selectively controls the exposure ratio of exposure light corresponding to an edge portion of the component identified by the element identification unit so as to be decreased.

* * * * *